US006116721A

United States Patent [19]

Higuchi et al.

[11] Patent Number: 6,116,721

[45] Date of Patent: Sep. 12, 2000

[54] INK JET RECORDING DEVICE

[75] Inventors: Kazuhiko Higuchi, Kawasaki; Chiaki Tanuma, Yokohama; Isao Amemiya, Tokyo, all of Japan

[73] Assignee: Kabushiki Kaisha Toshiba, Kawasaki, Japan

[21] Appl. No.: 09/156,694

[22] Filed: Sep. 18, 1998

[30] Foreign Application Priority Data

| | | | |
|---|---|---|---|
| Sep. 19, 1997 | [JP] | Japan | 9-255044 |
| Sep. 19, 1997 | [JP] | Japan | 9-255045 |
| Sep. 19, 1997 | [JP] | Japan | 9-255812 |

[51] Int. Cl.[7] ..... B41J 2/135

[52] U.S. Cl. ..... 347/46

[58] Field of Search ..... 347/7, 13, 10, 347/11, 15, 46, 57, 70, 71, 72, 85, 14, 19, 40; 399/319, 261

[56] References Cited

U.S. PATENT DOCUMENTS

| | | | |
|---|---|---|---|
| 5,612,723 | 3/1997 | Shirmura et al. | 347/46 |
| 5,798,779 | 8/1998 | Nakayasu et al. | 347/46 |
| 5,909,229 | 6/1999 | Moriguchi et al. | 347/13 |

FOREIGN PATENT DOCUMENTS 5-254116 10/1993 Japan .

*Primary Examiner*—John Barlow
*Assistant Examiner*—Raquel Yvette Gordon
*Attorney, Agent, or Firm*—Oblon, Spivak, McCelland, Maier & Neustadt, P.C.

[57] ABSTRACT

An ink jet recording device comprises an ultrasonic generating element array having a plurality of ultrasonic generating elements, a driving circuit for emitting ink droplets for each of element groups by setting a predetermined number of the ultrasonic generating elements out of the plurality of ultrasonic generating elements as one element group to drive individually each of the ultrasonic generating elements in the element group in accordance with the driving data corresponding to the image data, a driving data series buffer for storing a driving data series comprising at least one set of driving data for driving each of the ultrasonic generating elements in the element group, and a driving data generation circuit for reading repeatedly the driving data series which is stored in the driving data series buffer to generate the driving data corresponding to the image data.

16 Claims, 35 Drawing Sheets

| | | ZERO-DATA | |
|---|---|---|---|
| | | 0 | 1 |
| PAI-DATA | 0 | GND | SIGNAL ZERO |
| | 1 | SIGNAL PAI | GND |

FIG. 9

(A)

| 1 | 2 | 3 | 4 |
|---|---|---|---|
| PAI | ZERO | ZERO | PAI |

(B)

| | 1 | 2 | 3 | 4 |
|---|---|---|---|---|
| ZERO-DATA | 0 | 1 | 1 | 0 |
| PAI-DATA | 1 | 0 | 0 | 1 |

FIG. 10

(A)

| 1 | 2 | 3 | 4 | 5 | 6 | 7 | 8 |
|---|---|---|---|---|---|---|---|
| PAI | ZERO | PAI | ZERO | ZERO | PAI | ZERO | PAI |

(B)

| | 1 | 2 | 3 | 4 | 5 | 6 | 7 | 8 |
|---|---|---|---|---|---|---|---|---|
| ZERO-DATA | 0 | 1 | 0 | 1 | 1 | 0 | 1 | 0 |
| PAI-DATA | 1 | 0 | 1 | 0 | 0 | 1 | 0 | 1 |

(A)

| 1 | 2 | 3 | 4 | 5 | 6 | 7 | 8 | 9 |
|---|---|---|---|---|---|---|---|---|
| ZERO | PAI | PAI | ZERO | ZERO | ZERO | PAI | PAI | ZERO |

(B)

| | 1 | 2 | 3 | 4 | 5 | 6 | 7 | 8 | 9 |
|---|---|---|---|---|---|---|---|---|---|
| ZERO-DATA | 1 | 0 | 0 | 1 | 1 | 1 | 0 | 0 | 1 |
| PAI-DATA | 0 | 1 | 1 | 0 | 0 | 0 | 1 | 1 | 0 |

FIG. 11

(A)

| 1 | 2 | 3 | 4 | 5 | 6 | 7 | 8 | 9 | 10 |
|---|---|---|---|---|---|---|---|---|---|
| PAI | ZERO | PAI | ZERO | ZERO | ZERO | ZERO | PAI | ZERO | PAI |

(B)

| | 1 | 2 | 3 | 4 | 5 | 6 | 7 | 8 | 9 | 10 |
|---|---|---|---|---|---|---|---|---|---|---|
| ZERO-DATA | 0 | 1 | 0 | 1 | 1 | 1 | 1 | 0 | 1 | 0 |
| PAI-DATA | 1 | 0 | 1 | 0 | 0 | 0 | 0 | 1 | 0 | 1 |

FIG. 12

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| PAI | ZERO | PAI | ZERO | PAI | PAI | ZERO | ZERO | ZERO | ZERO | PAI | PAI | ZERO | PAI | ZERO | PAI |

(B)

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ZERO-DATA | 0 | 1 | 0 | 1 | 0 | 0 | 1 | 1 | 1 | 1 | 0 | 0 | 1 | 0 | 1 | 0 |
| PAI-DATA | 1 | 0 | 1 | 0 | 1 | 1 | 0 | 0 | 0 | 0 | 1 | 1 | 0 | 1 | 0 | 1 |

MODE 1

| 1 | 2 | 3 | 4 | 5 |
|---|---|---|---|---|
| PAI | ZERO | ZERO | PAI | NON |

MODE 2

| 1 | 2 | 3 | 4 | 5 |
|---|---|---|---|---|
| PAI | ZERO | ZERO | ZERO | PAI |

(A)

| 1 | 2 | 3 | 4 | 5 | 6 | 7 | 8 | 9 | 10 |
|---|---|---|---|---|---|---|---|---|---|
| ZERO | PAI | PAI | ZERO | ZERO | ZERO | PAI | PAI | ZERO | NON |

(B)

| | 1 | 2 | 3 | 4 | 5 | 6 | 7 | 8 | 9 | 10 |
|---|---|---|---|---|---|---|---|---|---|---|
| ZERO-DATA | 1 | 0 | 0 | 1 | 1 | 1 | 0 | 1 | 0 | 0 |
| PAI-DATA | 0 | 1 | 1 | 0 | 0 | 0 | 1 | 0 | 1 | 0 |

(A)

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| PAI | ZERO | PAI | ZERO | ZERO | ZERO | ZERO | PAI | ZERO | PAI | NON | NON | NON | NON | NON | NON |

(B)

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ZERO-DATA | 0 | 1 | 0 | 1 | 1 | 1 | 1 | 0 | 1 | 0 | 0 | 0 | 0 | 0 | 0 | 0 |
| PAI-DATA | 1 | 0 | 1 | 0 | 0 | 0 | 0 | 1 | 0 | 1 | 0 | 0 | 0 | 0 | 0 | 0 |

FIG. 25

(A)

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| NON | NON | NON | NON | NON | NON | PAI | ZERO | PAI | ZERO | ZERO | ZERO | ZERO | PAI | ZERO | PAI |

(B)

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ZERO-DATA | 0 | 0 | 0 | 0 | 0 | 0 | 0 | 1 | 0 | 1 | 1 | 1 | 1 | 0 | 1 | 0 |
| PAI-DATA | 0 | 0 | 0 | 0 | 0 | 0 | 1 | 0 | 1 | 0 | 0 | 0 | 0 | 1 | 0 | 1 |

FIG. 26

(A)

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| NON | NON | NON | PAI | ZERO | PAI | ZERO | ZERO | ZERO | ZERO | PAI | ZERO | PAI | NON | NON | NON |

(B)

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ZERO-DATA | 0 | 0 | 0 | 0 | 1 | 0 | 1 | 1 | 1 | 1 | 0 | 1 | 0 | 0 | 0 | 0 |
| PAI-DATA | 0 | 0 | 0 | 1 | 0 | 1 | 0 | 0 | 0 | 0 | 1 | 0 | 1 | 0 | 0 | 0 |

FIG. 27

| 1 | 2 | 3 | 4 | 5 |
|---|---|---|---|---|
| PAI | PAI2 | ZERO | PAI2 | PAI |

(B)

| | 1 | 2 | 3 | 4 | 5 |
|---|---|---|---|---|---|
| DATA1 | 1 | 0 | 1 | 0 | 1 |
| DATA2 | 1 | 1 | 0 | 1 | 1 |

| | | DATA1 | |
|---|---|---|---|
| | | 0 | 1 |
| DATA2 | 0 | GND | SIGNAL ZERO |
| | 1 | SIGNAL PAI2 | SIGNAL PAI |

| | | | | | | | | | | | | |
|---|---|---|---|---|---|---|---|---|---|---|---|---|
| MEMORY A | 1 | 2 | 3 | 4 | 5 | 6 | 7 | 8 | 9 | 10 | 11 | 12 |
| MEMORY B | 13 | 14 | 15 | 16 | 17 | 18 | 19 | 20 | 21 | 22 | 23 | 24 |

| | 1ST READ | | | 2ND READ | | | 3RD READ | | | 4TH READ | | |
|---|---|---|---|---|---|---|---|---|---|---|---|---|
| MEMORY A | 1 | 5 | 9 | 2 | 6 | 10 | 3 | 7 | 11 | 4 | 8 | 12 |
| MEMORY B | 13 | 17 | 21 | 14 | 18 | 22 | 15 | 19 | 23 | 15 | 20 | 24 |

FIG. 34

ELEMENT NUMBER

| SHIFT CLOCK | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | | | | | | | | | | | | 1A | | | | | | | | | | | | 13A |
| 2 | | | | | | | | | | | 1A | 1B | | | | | | | | | | | 13A | 13B |
| 3 | | | | | | | | | | 1A | 1B | 1C | | | | | | | | | | 13A | 13B | 13C |
| 4 | | | | | | | | | 1A | 1B | 1C | 1D | | | | | | | | | 13A | 13B | 13C | 13D |
| 5 | | | | | | | | 1A | 1B | 1C | 1D | 5A | | | | | | | | 13A | 13B | 13C | 13D | 17A |
| 6 | | | | | | | 1A | 1B | 1C | 1D | 5A | 5B | | | | | | | 13A | 13B | 13C | 13D | 17A | 17B |
| 7 | | | | | | 1A | 1B | 1C | 1D | 5A | 5B | 5C | | | | | | 13A | 13B | 13C | 13D | 17A | 17B | 17C |
| 8 | | | | | 1A | 1B | 1C | 1D | 5A | 5B | 5C | 5D | | | | | 13A | 13B | 13C | 13D | 17A | 17B | 17C | 17D |
| 9 | | | | 1A | 1B | 1C | 1D | 5A | 5B | 5C | 5D | 9A | | | | 13A | 13B | 13C | 13D | 17A | 17B | 17C | 17D | 21A |
| 10 | | | 1A | 1B | 1C | 1D | 5A | 5B | 5C | 5D | 9A | 9B | | | 13A | 13B | 13C | 13D | 17A | 17B | 17C | 17D | 21A | 21B |
| 11 | | 1A | 1B | 1C | 1D | 5A | 5B | 5C | 5D | 9A | 9B | 9C | | 13A | 13B | 13C | 13D | 17A | 17B | 17C | 17D | 21A | 21B | 21C |
| 12 | 1A | 1B | 1C | 1D | 5A | 5B | 5C | 5D | 9A | 9B | 9C | 9D | 13A | 13B | 13C | 13D | 17A | 17B | 17C | 17D | 21A | 21B | 21C | 21D |

FIG. 35

ELEMENT NUMBER

| SHIFT CLOCK | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | | | | | | | | | | | | 2A | | | | | | | | | | | | 14A |
| 2 | | | | | | | | | | | 2A | 2B | | | | | | | | | | | 14A | 14B |
| 3 | | | | | | | | | | 2A | 2B | 2C | | | | | | | | | | 14A | 14B | 14C |
| 4 | | | | | | | | | 2A | 2B | 2C | 2D | | | | | | | | | 14A | 14B | 14C | 14D |
| 5 | | | | | | | | 2A | 2B | 2C | 2D | 6A | | | | | | | | 14A | 14B | 14C | 14D | 18A |
| 6 | | | | | | | 2A | 2B | 2C | 2D | 6A | 6B | | | | | | | 14A | 14B | 14C | 14D | 18A | 18B |
| 7 | | | | | | 2A | 2B | 2C | 2D | 6A | 6B | 6C | | | | | | 14A | 14B | 14C | 14D | 18A | 18B | 18C |
| 8 | | | | | 2A | 2B | 2C | 2D | 6A | 6B | 6C | 6D | | | | | 14A | 14B | 14C | 14D | 18A | 18B | 18C | 18D |
| 9 | | | | 2A | 2B | 2C | 2D | 6A | 6B | 6C | 6D | 10A | | | | 14A | 14B | 14C | 14D | 18A | 18B | 18C | 18D | 22A |
| 10 | | | 2A | 2B | 2C | 2D | 6A | 6B | 6C | 6D | 10A | 10B | | | 14A | 14B | 14C | 14D | 18A | 18B | 18C | 18D | 22A | 22B |
| 11 | | 2A | 2B | 2C | 2D | 6A | 6B | 6C | 6D | 10A | 10B | 10C | | 14A | 14B | 14C | 14D | 18A | 18B | 18C | 18D | 22A | 22B | 22C |
| 12 | 2A | 2B | 2C | 2D | 6A | 6B | 6C | 6D | 10A | 10B | 10C | 10D | 14A | 14B | 14C | 14D | 18A | 18B | 18C | 18D | 22A | 22B | 22C | 22D |
| 13 | 2B | 2C | 2D | 6A | 6B | 6C | 6D | 10A | 10B | 10C | 10D | 14A ◄ | 14B | 14C | 14D | 18A | 18B | 18C | 18D | 22A | 22B | 22C | 22D | – |

FIG. 36

ELEMENT NUMBER

| SHIFT CLOCK | 1 | 2 | 3 | 4 | 5 | 6 | 7 | 8 | 9 | 10 | 11 | 12 | | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 1 | | | | | | | | | | | | 3A | | | | | | | | | | | | | 15A |
| 2 | | | | | | | | | | | 3A | 3B | | | | | | | | | | | | 15A | 15B |
| 3 | | | | | | | | | | 3A | 3B | 3C | | | | | | | | | | | 15A | 15B | 15C |
| 4 | | | | | | | | | 3A | 3B | 3C | 3D | | | | | | | | | | 15A | 15B | 15C | 15D |
| 5 | | | | | | | | 3A | 3B | 3C | 3D | 7A | | | | | | | | | 15A | 15B | 15C | 15D | 19A |
| 6 | | | | | | | 3A | 3B | 3C | 3D | 7A | 7B | | | | | | | | 15A | 15B | 15C | 15D | 19A | 19B |
| 7 | | | | | | 3A | 3B | 3C | 3D | 7A | 7B | 7C | | | | | | | 15A | 15B | 15C | 15D | 19A | 19B | 19C |
| 8 | | | | | 3A | 3B | 3C | 3D | 7A | 7B | 7C | 7D | | | | | | 15A | 15B | 15C | 15D | 19A | 19B | 19C | 19D |
| 9 | | | | 3A | 3B | 3C | 3D | 7A | 7B | 7C | 7D | 11A | | | | | 15A | 15B | 15C | 15D | 19A | 19B | 19C | 19D | 23A |
| 10 | | | 3A | 3B | 3C | 3D | 7A | 7B | 7C | 7D | 11A | 11B | | | | 15A | 15B | 15C | 15D | 19A | 19B | 19C | 19D | 23A | 23B |
| 11 | | 3A | 3B | 3C | 3D | 7A | 7B | 7C | 7D | 11A | 11B | 11C | | | 15A | 15B | 15C | 15D | 19A | 19B | 19C | 19D | 23A | 23B | 23C |
| 12 | 3A | 3B | 3C | 3D | 7A | 7B | 7C | 7D | 11A | 11B | 11C | 11D | | 15A | 15B | 15C | 15D | 19A | 19B | 19C | 19D | 23A | 23B | 23C | 23D |
| 13 | 3B | 3C | 3D | 7A | 7B | 7C | 7D | 11A | 11B | 11C | 11D | 15A | ◄ | 15B | 15C | 15D | 19A | 19B | 19C | 19D | 23A | 23B | 23C | 23D | – |
| 14 | 3C | 3D | 7A | 7B | 7C | 7D | 11A | 11B | 11C | 11D | 15A | 15B | ◄ | 15C | 15D | 19A | 19B | 19C | 19D | 23A | 23B | 23C | 23D | – | – |

FIG. 37

ELEMENT NUMBER

| SHIFT CLOCK | 1 | 2 | 3 | 4 | 5 | 6 | 7 | 8 | 9 | 10 | 11 | 12 | | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|---|
| 1 | | | | | | | | | | | | 4A | | | | | | | | | | | | | 16A |
| 2 | | | | | | | | | | | 4A | 4B | | | | | | | | | | | | 16A | 16B |
| 3 | | | | | | | | | | 4A | 4B | 4C | | | | | | | | | | | 16A | 16B | 16C |
| 4 | | | | | | | | | 4A | 4B | 4C | 4D | | | | | | | | | | 16A | 16B | 16C | 16D |
| 5 | | | | | | | | 4A | 4B | 4C | 4D | 8A | | | | | | | | | 16A | 16B | 16C | 16D | 20A |
| 6 | | | | | | | 4A | 4B | 4C | 4D | 8A | 8B | | | | | | | | 16A | 16B | 16C | 16D | 20A | 20B |
| 7 | | | | | | 4A | 4B | 4C | 4D | 8A | 8B | 8C | | | | | | | 16A | 16B | 16C | 16D | 20A | 20B | 20C |
| 8 | | | | | 4A | 4B | 4C | 4D | 8A | 8B | 8C | 8D | | | | | | 16A | 16B | 16C | 16D | 20A | 20B | 20B | 20D |
| 9 | | | | 4A | 4B | 4C | 4D | 8A | 8B | 8C | 8D | 12A | | | | | 16A | 16B | 16C | 16D | 20A | 20B | 20B | 20D | 24A |
| 10 | | | 4A | 4B | 4C | 4D | 8A | 8B | 8C | 8D | 12A | 12B | | | | 16A | 16B | 16C | 16D | 20A | 20B | 20B | 20D | 24A | 24B |
| 11 | | 4A | 4B | 4C | 4D | 8A | 8B | 8C | 8D | 12A | 12B | 12C | | | 16A | 16B | 16C | 16D | 20A | 20B | 20B | 20D | 24A | 24B | 24C |
| 12 | 4A | 4B | 4C | 4D | 8A | 8B | 8C | 8D | 12A | 12B | 12C | 12D | | 16A | 16B | 16C | 16D | 20A | 20B | 20B | 20D | 24A | 24B | 24C | 24D |
| 13 | 4B | 4C | 4D | 8A | 8B | 8C | 8D | 12A | 12B | 12C | 12D | 16A | ◄ | 16B | 16C | 16D | 20A | 20B | 20B | 20D | 24A | 24B | 24C | 24D | – |
| 14 | 4C | 4D | 8A | 8B | 8C | 8D | 12A | 12B | 12C | 12D | 16A | 16B | ◄ | 16C | 16D | 20A | 20B | 20B | 20D | 24A | 24B | 24C | 24D | – | – |
| 15 | 4D | 8A | 8B | 8C | 8D | 12A | 12B | 12C | 12D | 16A | 16B | 16C | ◄ | 16D | 20A | 20B | 20B | 20D | 24A | 24B | 24C | 24D | – | – | – |

FIG. 45

(A)

| 1 | 2 | 3 | 4 | 5 | 6 |
|---|---|---|---|---|---|
| PAI | ZERO | ZERO | PAI | NON | NON |

(B)

| | 1 | 2 | 3 | 4 | 5 | 6 |
|---|---|---|---|---|---|---|
| ZERO-DATA | 0 | 1 | 1 | 0 | 0 | 0 |
| PAI-DATA | 1 | 0 | 0 | 1 | 0 | 0 |

FIG. 46

(A)

| 1 | 2 | 3 | 4 | 5 | 6 | 7 |
|---|---|---|---|---|---|---|
| PAI | ZERO | ZERO | PAI | NON | NON | NON |

(B)

| | 1 | 2 | 3 | 4 | 5 | 6 | 7 |
|---|---|---|---|---|---|---|---|
| ZERO-DATA | 0 | 1 | 1 | 0 | 0 | 0 | 0 |
| PAI-DATA | 1 | 0 | 0 | 1 | 0 | 0 | 0 |

(A)

| 1 | 2 | 3 | 4 | 5 | 6 | 7 | 8 |
|---|---|---|---|---|---|---|---|
| PAI | ZERO | ZERO | PAI | NON | NON | NON | NON |

(B)

| | 1 | 2 | 3 | 4 | 5 | 6 | 7 | 8 |
|---|---|---|---|---|---|---|---|---|
| ZERO–DATA | 0 | 1 | 1 | 0 | 0 | 0 | 0 | 0 |
| PAI–DATA | 1 | 0 | 0 | 1 | 0 | 0 | 0 | 0 |

FIG. 47

(A)

| 1 | 2 | 3 | 4 | 5 | 6 | 7 | 8 | 9 |
|---|---|---|---|---|---|---|---|---|
| PAI | ZERO | ZERO | PAI | NON | NON | NON | NON | NON |

(B)

| | 1 | 2 | 3 | 4 | 5 | 6 | 7 | 8 | 9 |
|---|---|---|---|---|---|---|---|---|---|
| ZERO–DATA | 0 | 1 | 1 | 0 | 0 | 0 | 0 | 0 | 0 |
| PAI–DATA | 1 | 0 | 0 | 1 | 0 | 0 | 0 | 0 | 0 |

FIG. 48

FIG. 56

| READ | PIXEL NO. | | | | | |
|---|---|---|---|---|---|---|
| 1ST | 1 | 8 | 15 | 22 | 29 | ··· |
| 2ND | 5 | 12 | 19 | 26 | 33 | ··· |
| 3RD | 2 | 9 | 16 | 23 | 30 | ··· |
| 4TH | 6 | 13 | 20 | 27 | 34 | ··· |
| 5TH | 3 | 10 | 17 | 24 | 31 | ··· |
| 6TH | 7 | 14 | 21 | 28 | 35 | ··· |
| 7TH | 4 | 11 | 18 | 25 | 32 | ··· |

FIG. 57

ELEMENT NUMBER

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| (A) DRIVE 1 | 1A | 1B | 1C | 1D | | | | | 9A | 9B | 9C | 9D | | | | |
| (B) DRIVE 2 | W | 2A | 2B | 2C | 2D | | | | | 10A | 10B | 10C | 10D | | | |
| (C) DRIVE 3 | W | W | 3A | 3B | 3C | 3D | | | | | 11A | 11B | 11C | 11D | | |
| (D) DRIVE 4 | W | W | W | 4A | 4B | 4C | 4D | | | | | 12A | 12B | 12C | 12D | |
| (E) DRIVE 5 | W | W | W | W | 5A | 5B | 5C | 5D | | | | | 13A | 13B | 13C | 13D |
| (F) DRIVE 6 | W | W | W | W | W | 6A | 6B | 6C | 6D | | | | | 14A | 14B | 14C |
| (G) DRIVE 7 | W | W | W | W | W | W | 7A | 7B | 7C | 7D | | | | | 15A | 15B |
| (H) DRIVE 8 | W | W | W | W | W | W | W | 8A | 8B | 8C | 8D | | | | | 16A |

INK JET RECORDING DEVICE

BACKGROUND OF THE INVENTION

The present invention relates to an ink jet recording device for emitting ink droplets to record an image, and more particularly to an ink jet recording device for emitting ink droplets by individually driving a plurality of ultrasonic generating elements to generate ultrasonic beams.

The ink jet recording device which emits a liquid ink as small droplets onto a recording medium to record an image has many advantages such that the image can be directly recorded on plain paper. In the ink jet recording device, however, the liquid ink is likely to concentrate because of evaporation or volatilization of a solvent for liquid ink. Therefore, there is a disadvantage in that a nozzle for emitting ink droplets is clogged, thereby causing a trouble in emitting ink droplets.

In a so-called line-type head which is provided with a number of nozzles, it is inevitable to prevent the clogging of nozzles. As a consequence, there is such a disadvantage that it is necessary to provide additional means for cleaning the nozzles, or nozzles having small diameters cannot be used. In other words, in the conventional ink jet recording device, it is more difficult to use the line-type head having a lower reliability and a higher resolution.

In order to overcome these disadvantages, there has been proposed a method for emitting ink from a liquid ink surface by using the pressure of the ultrasonic beams which are generated by a piezoelectric element array comprising a thin film piezoelectric material.

The method is a so-called nozzle-less method which does not require a partitioning wall for a nozzle or an ink flow channel for each of individual dots. As a consequence, the method is advantageous in the prevention of the clogging of nozzles which causes a large trouble in forming a line head. The method is suitable for an increase in the resolution because ink droplets having very small diameters can be stably generated and emitted.

However, since this method converges ultrasonic beams in the ink by using an acoustic lens having a diameter larger than a recorded picture point or a recording resolution (for example, the diameter is thirty times as large as the recorded picture point), an interval for emitting ink droplets must be set to a wide level. In order to reduce the interval for emitting ink, a recording head is normally constituted by arranging a plurality of piezoelectric element arrays in a zigzag manner. However, because of the zigzag arrangement thereof, a periodical disuniformity in concentration and a slight deviation in position between adjacent dots affect the image quality.

Therefore, there has been proposed, as another method for converging ultrasonic beams disclosed in Jpn. Pat. Appln. KOKAI Publication No. 2-18443, a method which is referred to as the sector electronic scanning method in which the respective piezoelectric elements at piezoelectric element array which is constituted by arranging a plurality of piezoelectric elements at predetermined intervals are driven at predetermined delay time differences thereby exciting ultrasonic waves whose phases are controlled to converge the ultrasonic waves onto one point in the vicinity of the ink liquid surface. According to this method, it is possible to perform recording images in a high resolution by changing emission positions for ink droplets without being restricted by an arrangement pitch of the piezoelectric element array.

However, in the sector electronic scanning method, in order to emit an ink droplet at each of desired positions on the ink liquid surface, it is necessary to control the piezoelectric elements by calculating accurately delay time differences for driving the piezoelectric elements so that the ultrasonic beams are converged on each of the positions with the result that the driving circuit becomes complicated and expensive. In a case where an ink droplet is emitted at a position other than one point on the ink liquid surface which is aligned with the central position of the piezoelectric element array, the converged ultrasonic waves have a directionality with the result that the ink droplet is emitted in a slanting direction to the ink liquid surface. As a result, there is a disadvantage in that the attainment position of the ink droplet is deviated due to a change in a height of the ink liquid surface or a distance between the ink liquid surface and a paper.

With respect to these disadvantages, there has been proposed a method which is referred to as a linear electronic scanning method in which a predetermined number of piezoelectric elements (a group of piezoelectric elements) in the piezoelectric element array are simultaneously driven to emit one ink droplet, and the position of the group of piezoelectric elements which are simultaneously driven is shifted sequentially to shift the emission position for ink droplet. In this method, since the delay time for each piezoelectric element is set to be symmetrical in a right and a left directions with respect to the center of the group of piezoelectric elements, each ink droplet is always emitted straightly in a direction perpendicular to the liquid surface. As a method for solving the troubleness in the control of the delay time, there has been proposed a more simple method in which the piezoelectric array is divided into two groups on the basis of the Fresnel's diffraction theory and the delay time is set so that the phases of the two groups are different from each other by a half wave-length.

In the piezoelectric element array driving circuit for realizing such a linear electronic scanning method, the group of piezoelectric elements which should be driven on the basis of image data must be selected from the piezoelectric element array. In other words, in the linear electronic scanning method, a plurality of piezoelectric elements must be simultaneously driven with respect to the image data corresponding to one imaging point. As a consequence, a driving circuit having a special structure is required which is completely different from the structure of a normally used ink jet recording device in which one driving element is allowed to correspond to one image data.

In the ink jet recording device according to the conventional linear electronic scanning method, ink droplets are emitted at the same interval as the arrangement pitches of the piezoelectric element array. Since it is difficult to emit ink droplets in pitches narrower than the arrangement pitches, an increase in the recording resolution is restricted.

In order to improve a recording speed in the linear electronic scanning method, it is desired that driving data for driving each of the piezoelectric elements by the driving circuit can be appropriately set in an efficient manner.

In a thermal head which is used in a conventional ink jet recording device utilizing a method of emitting an ink droplets by using pressure of a bubble generated, for example, by heat, or in a conventional thermal transfer recording device, there has been known a method for shortening a time for transmitting driving data for recording one line by using a shift register which has the same number of steps as the number of heat generation elements which constitute the thermal head, dividing the shift register into a plurality of groups, and providing input ports for the respective groups to input driving data simultaneously from these input ports.

However, the driving data transmission method in which driving data is input simultaneously from a plurality of input ports cannot be applied as it is to the ink jet recording device according to the linear electronic scanning method. In other words, in the linear electronic scanning method, a plurality of piezoelectric elements must be allocated to one image data with the result that there is generated a case in which driving data corresponding to one image data is input over two adjacent input ports. As a consequence, when an attempt is made to shorten the transmission time of driving data by providing a plurality of input ports, a complicated processing must be carried out for generation of the driving data, or a driving circuit in which the driving data is transmitted in a complicated manner must be constituted.

In a case where data is recorded particularly at a high speed, each of piezoelectric elements is continuously or intermittently driven frequently over a long time. Consequently, ultrasonic waves are not sufficiently generated because of the generation of heat in the piezoelectric elements, and ultrasonic waves having desired frequencies are not generated with the result that the emission of ink droplets becomes unstable, and the piezoelectric elements are deteriorated in a short period.

In a line head in which thousands of piezoelectric elements are arranged, there are some cases where the number of elements which are driven simultaneously increases and the capacity of the power supply for the driving circuit becomes large.

As described above, the ink jet recording device utilizing a method for emitting ink droplets by driving piezoelectric element array according to the linear electronic scanning method is capable of recording without clogging in principle. On the other hand, since it is necessary to drive a plurality of piezoelectric elements simultaneously according to the image data to be recorded and emit one ink droplet, there is a subject in that how the driving circuit is simply constituted.

The ink droplets are emitted at the same intervals as the arrangement pitches of piezoelectric element array, and it is difficult to emit ink droplets in pitches narrower than the arrangement pitches.

Therefore, there is a limit in increase in the resolution for recording.

Furthermore, since it is necessary to emit one ink droplet according to the image data to be recorded by driving a plurality of piezoelectric element at the same time, it is a subject how is a driving circuit constituted.

Particularly, with an elongated line type head, it is desired that driving data is input and set simultaneously from a plurality of input ports in order to improve a recording speed. There occurs a case in which driving data corresponding to one image data is input over two adjacent input ports. Therefore, a complicated processing must be carried out for generation of driving data, and a driving circuit in which driving data is transmitted in a complicated manner must be constituted so that there is a disadvantage in that it is difficult to set appropriate data in a simple structure.

For such a reason that heat is generated by repeatedly driving the piezoelectric elements over a long time, ultrasonic waves are not sufficiently generated and ultrasonic waves having the desired frequency cannot be obtained with the result that it is feared that the emission of ink droplets becomes unstable, the image quality is lowered, and the piezoelectric elements are deteriorated in a short period. There is also a disadvantage in that the capacity of power supply for the driving circuit increases with an increase in the number of piezoelectric elements which are simultaneously driven in the line head.

BRIEF SUMMARY OF THE INVENTION

An object of the present invention is to provide an ink jet recording device as described as follows while adopting a linear electronic scanning method in which clogging is hardly generated in principle.

(1) The setting of driving data which should be allowed to correspond to ultrasonic generating elements is enabled in a relatively simple structure, and the device can be realized at an inexpensive cost.

(2) A driving circuit which is capable of setting at a high speed driving data which is allowed to correspond to the ultrasonic generating elements is realized in a relatively simple structure, and the device can be realized at an inexpensive cost.

(3) Recording in a higher resolution can be performed by emitting ink droplets in pitches narrower than the arrangement pitches of the ultrasonic generating elements.

(4) The deterioration in image quality can be alleviated and the lifetime of the ultrasonic generating elements can be prolonged even in the case where the ultrasonic generating elements are repeatedly driven.

(5) The capacity of the power supply for the driving circuit can be reduced even in the case where a line head provided with a number of ultrasonic generating elements is constituted.

In order to solve the aforementioned disadvantages, the present invention has the following structure.

An ink jet recording device according to the present invention comprises: an ultrasonic generating element array having a plurality of ultrasonic generating elements; a driving circuit for emitting ink droplets for each of element groups by setting a predetermined number of the ultrasonic generating elements out of the plurality of ultrasonic generating elements as one element group to drive individually each of the ultrasonic generating elements in the element group in accordance with the driving data corresponding to the image data; a driving data series buffer for storing a driving data series comprising at least one set of driving data for driving each of the ultrasonic generating elements in the element group; and a driving data generation circuit for reading repeatedly the driving data series which is stored in the driving data series buffer to generate the driving data corresponding to the image data.

The driving data which is generated in this manner is successively transmitted, for example, to the succeeding stages of the a shift register, and each ultrasonic generating element is driven in accordance with an output of each stage of this shift register.

In the present invention, a driving data series comprising driving data items in the same number as the number of ultrasonic generating elements required for emitting one ink droplet is set and stored in the buffer, thereby generating the driving data in accordance with the image data by repeatedly reading the stored driving data series. Consequently, it is possible to set the driving data in a simple structure and the capacity of the buffer for storing the driving data series can be minimized.

Preferred manners of the aforementioned ink jet recording device will be described as follows.

(1) The driving data series includes a first and a second driving data series which are set to emit the ink droplets to mutually different positions, and driving data series selecting section is further provided for selecting either of the first or the second driving data series. The generated driving data is successively transmitted, for example, to the next step, on the shift register, and each of the ultrasonic generating elements is driven in accordance with an output at each step of the shift register.

(2) In preferred manner (1), the selected driving data series may be temporarily stored in the driving data series buffer. In this case, the driving data series which is stored in this driving data series buffer may be read subsequently in accordance with each of the ultrasonic generating element in the group or repeatedly in accordance with each group.

When the switching between the first driving data series and the second driving data series is effected and the switched one is selected in this manner, the switching between a mode for emitting by the first driving data series an ink droplets to a first position and a mode for emitting by the second driving data series an ink droplets to a second position which is different from the first position with respect to the arrangement position of the ultrasonic generating element can be easily performed. Consequently, ink droplets can be emitted in a pitch narrower than the arrangement pitch of the ultrasonic generating element array without changing the arrangement pitches of the ultrasonic generating elements with the result that an image can be recorded in a high resolution.

(3) The driving data series is data showing a phase of the driving data corresponding to each of the ultrasonic generating elements in the element group. Here, in preferred manners (1) and (2), the driving data series includes a first and a second driving data series.

(4) The driving data series includes the first and the second driving data series, and at least one of the first and the second driving data series includes at least one of non-driving data for setting the corresponding ultrasonic generating element in a non-driving state.

In the aforementioned preferred manners (1) and (2), as a method for selecting one of the first and the second driving data series, for example, three methods can be considered.

(1) As a first method for selecting a driving data series, there is provided a method for selecting the first driving data or the second driving data by switching alternately the first and the second driving data for each operation for emitting an ink droplets. In this method, an image can be recorded in a high resolution more than the arrangement pitch of the ultrasonic generating element array in a simple circuit structure. Besides, since the relation between the arrangement order of the image data and the emission position of the ink droplets is simple, the method for reading the image data can be simplified. In addition, in any emission operation, the emission position of ink droplets is arranged in a predetermined interval so that the recording operation can be stabilized.

(2) As a second method for selecting the driving data series, there is provided a method for selecting the first and the second driving data by mixing the first and the second driving data series. In this method, the driving data which allows the ultrasonic generating element to be set in a non-driving state in each cycle of emission operation of ink droplets can be allowed to be present at all times, there is an advantage in that the maximum number of ultrasonic generating elements which are simultaneously driven is reduced, and an attempt can be made to reduce the capacity of the power supply of the driving circuit. Since the non-driving data can be provided in a definite interval with respect to the arrangement direction of the ultrasonic generating elements, the mutual interference at the time of emitting ink droplets from each group can be prevented, and the emission operation can be stabilized.

(3) As a third method for selecting a driving data series, there is provided a method for selecting the first and the second driving data by switching the first and the second driving data at the first half and the second half of the operation period of emitting a series of ink droplets in one line. In a continuous emission operation, the emission position of the ink droplets is deviated by one pixel with the result that the emission position of the ink droplets is separated further by a half pixel portion, for example, with respect to the method for selecting the driving data. Consequently, the ink infiltration after the emission and fixture of the ink on the recording medium can be effectively prevented.

According to the ink jet recording device of the present invention, a linear electronic scanning operation can be realized with a relatively simple structure without needing a complicated circuit nor a complicated processing.

According to the ink jet recording device of the present invention, the ink droplets can be emitted in an interval narrower than the arrangement pitch of the ultrasonic generating element with relatively simple structure. In other words, it becomes possible to realize recording of images in a higher resolution without heightening the arrangement pitch of the ultrasonic generating element.

Another ink jet recording device of the present invention comprises: an ultrasonic generating element array having a plurality of ultrasonic generating elements; a driving circuit for emitting ink droplets for each of element groups by setting a predetermined number of the ultrasonic generating elements out of the plurality of ultrasonic generating elements as one element group to drive each of the ultrasonic generating elements in the element group in accordance with the driving data corresponding to the image data; a plurality of shift registers including at least a first and a second shift registers for inputting driving data corresponding to each of the ultrasonic generating elements from an input port as time series data to subsequently transmit the data to the next step in accordance with a predetermined transmission clock, and outputting the driving data corresponding to each of the plurality of ultrasonic generating elements from an output at each step; a first input section for inputting the first driving data to the input port of the first shift register; a second input section for inputting the second driving data to the input port of the second shift register; and an input switching section for inputting the driving data which is output from an output port at the last step of the first shift register to an input port of the second shift register.

Preferred manners of the aforementioned ink jet recording device will be as follows.

(1) The input switching section inputs the second driving data to the input port of the second shift register when a plurality of driving data items corresponding to the plurality of ultrasonic generating elements in the group are input to either of the first or the second shift register, while the input switching section inputs the driving data which is output from the output port at the last step of the shift register when a plurality of driving data items corresponding to the plurality of ultrasonic generating elements in the group are input both to the first and the second shift register.

(2) The plurality of shift register further includes a third shift register, a third input section is further provided on the input port of the third shift register, and the input switching section includes a first input switching section for inputting the driving data which is output from the output port at the last step of the first register to the input port of the second shift register, and a second input switching section for inputting the driving data which is output from the output port at the last step of the second shift register to the input port of the third shift register.

By constituting the ink jet recording device of the present invention in this manner, it is possible to set at a high speed driving data by simultaneously inputting the driving data to a plurality of input ports of the shift register. At the same time, by providing an input switching section, the driving data can be appropriately set without carrying out a complicated processing even in the case where the driving data corresponding to the ultrasonic generating unit in one group is input to a plurality of input ports, namely over a plurality of shift registers.

In other words, even in the case where a line head having a large number of driving data is used, a complicated data processing is not required. Without using a complicated hardware structure, it becomes possible to shorten time required for setting the driving data.

A basic structure of this ink jet recording device can be used in the setting of data input in a device in which parallel processing is carried out. In this case, this ink jet recording device can be defined as a data setting device. At this time, a data setting device for subsequently transmitting a plurality of the group to arrange the group in one line is selected as an object. This data setting device comprises: at least first and a second shift register for subsequently transmitting to a next step time series data in accordance with a predetermined transmission clock by inputting the time series data from an input port; first input means for inputting first time series data to the input port of the first shift register; and an input switching section for switching and inputting to the input port of the first shift register a second time series data and time series data which is output from the output at the last step of the second shift register.

According to the ink jet recording device of the present invention, there is provided at an inexpensive cost an ink jet recording device in which the driving data can be set at a high speed, and an image can be recorded at a high speed in a relatively simple structure without needing a complicated circuit and a complicated processing.

A basic structure of further another ink jet recording device of the present invention comprises: an ultrasonic generating element array having a plurality of ultrasonic generating elements; and a driving circuit for setting a predetermined number of the ultrasonic generating elements out of the plurality of ultrasonic generating elements as an element group to drive individually each of the ultrasonic generating elements in the element group in accordance with the driving data corresponding to the image data thereby differentiating the emission position of the operation for emitting the ink droplets for each of the element groups to record one line image repeatedly over a plurality of times, and the driving circuit sets the element group so as to sandwich at least one of non-driving ultrasonic generating elements between the element groups to drive the ultrasonic generating elements by giving two or more different phases to the ultrasonic wave elements in the element group. Here, the non-driving ultrasonic generating element refers to a piezoelectric element which is not driven.

Preferred manner of the aforementioned ink jet recording device of the present invention is described as follows.

(1) The driving circuit selects and drives the ultrasonic generating elements in such a manner that the number N of the ultrasonic generating elements in the element group is larger than the number M of the non-driving ultrasonic generating elements sandwiched between the element groups, and the number of ultrasonic generating elements which are continuously driven in continuous different cycles of the operation for emitting the ink droplets is set to N−M.

(2) The driving circuit selects and drives the ultrasonic generating elements in such a manner that the number of ultrasonic generating elements in the element group is set to be equal with the number of non-driving ultrasonic generating elements between the respective element groups, and the number of ultrasonic generating elements which are continuously driven in continuous different cycles of the operation for emitting ink droplets is set to 0 or one.

According to these preferred manners (1) and (2), the number of ultrasonic generating elements which are continuously driven in a continuous emission operation is reduced in average. As a consequence, firstly, an instant consumed power can be reduced and the capacity of the power supply can be reduced. Secondly, a continuous driving time to the same ultrasonic generating element is reduced, and the heat generation of the ultrasonic generating elements can be either alleviated or prevented. In other words, an attempt can be made to stabilize the image recording free from the generation of a disorder in the ultrasonic wave because of heat generation and deterioration, and at the same time, the lifetime of individual elements can be prolonged.

(3) The number of the non-driving ultrasonic wave generating elements is larger than the number of ultrasonic generating elements, and the driving circuit selects and drives ultrasonic wave elements so that the same ultrasonic generating elements are not continuously driven between continuous different cycles of the operation for emitting ink droplets. In a continuous emission operation, the same ultrasonic generating element is not carried out so that a non-driving period is provided without fail in a period subsequent to the emission operation period in a predetermined ultrasonic generating elements. As a consequence, the heat generation of the ultrasonic generating element can be alleviated and prevented. In other words, an attempt can be made to stabilize the image recording free from the generation of a disorder in the ultrasonic wave because of heat generation and deterioration, and at the same time, the lifetime of individual elements can be prolonged. Besides the capacity of power supply can be alleviated.

(4) An ink jet recording device comprises: an ultrasonic generating element array having a plurality of ultrasonic generating element array; and a driving circuit for setting a predetermined number of ultrasonic generating elements out of the plurality of ultrasonic generating elements as an element group to drive individually each of the ultrasonic generating elements in the element groups in accordance with the driving data corresponding to the image data thereby differentiating the emission position of the operation for emitting ink droplets for each of the element groups to record one line image repeatedly over a plurality of times, and the driving circuit drives the ultrasonic generating elements so that the emission position of the ink droplets is shifted by two or more elements of the ultrasonic generating elements for each cycle of the emission operation. In a plurality of cycles of emission operation in one line, since a control is carried out in such a manner that the emission operation is shifted by two or more elements in a continuous emission operation, the ink droplets are not emitted adjacent to each other onto a medium such as a paper or the like in a continuous emission operation, and the ink droplets emitted onto the medium in the previous emission operation are likely to be infiltrated into the medium and is likely to get dry. In other words, the image quality is stabilized and there is no fear of the deterioration in the image quality in a high speed recording of images as compared with the case in which ink droplets reaches the next pixel position in a continuous emission position.

(5) In (4), The driving circuit sets the element group so as to sandwich at least one of non-driving ultrasonic generating elements between the groups and selects and drives ultrasonic generating elements in each cycle of the emission operation so that the number of ultrasonic generating elements which are continuously driven in continuous different cycles of the operation for emitting ink droplets becomes uniform over one line emission operation. Since the number of ultrasonic generating elements which are driven at the same time becomes average, and is not deviated for each of the emission operations, a uniform emission characteristics can be obtained, and the capacity of the power supply can be restricted to a minimum level.

(6) The input switching section inputs the second driving data to the input port of the second shift register when a plurality of driving data items corresponding to the plurality of ultrasonic generating elements in the group are input to either of the first or the second shift register, while the input switching section inputs the driving data which is output from the output port at the last step of the shift register when a plurality of driving data items corresponding to the plurality of ultrasonic generating elements in the group are input both to the first and the second shift register. In a plurality of cycles of emission operation in one line, since a control is carried out in such a manner that the emission position is shifted in an equal interval, the number of elements which are driven continuously in the emission operation becomes definite and fewer in average. As a consequence, the instant consumed power can be restricted to a low level, and the capacity of the power supply can be reduced. A continuous driving of the same element over the emission operation period can be reduced, and the heat generation and deterioration of the elements can be prevented and alleviated. In other words, the generation of the ultrasonic waves does not get disordered with the heat generation and the deterioration of the elements with the result that an attempt can be made to stabilize the recording of the images and the lifetime of individual elements can be prolonged.

Preferred manners (4) through (6) can be applied to a case in which at least one of non-driving ultrasonic generating elements is sandwiched between respective groups, and to a case in which no non-driving ultrasonic generating element is sandwiched.

According to the ink jet recording device of the present invention, a linear electronic scanning method with few clogging in principle is adopted. Even in the case where the ultrasonic generating elements are driven repeatedly, the reduction in the image can be alleviated, and the lifetime of the ultrasonic generating elements can be prolonged. It is also expected that there is also provided an advantage in that the capacity of the power supply can be reduced even in the case in which a line head is constituted which is provided with a larger number of ultrasonic generating elements.

Since the expected value of the number of ultrasonic generating elements which are driven continuously is set to a minimum level in each cycle of emission operation, a surplus continuous operation in which the ultrasonic generating elements generate heat is prevented, the stabilization of the emission operation and the prolongation of the lifetime of the ultrasonic generating elements can be realized, and the capacity of the power supply can be reduced.

The number of the ultrasonic generating elements which are continuously driven in the continuous emission operation becomes average by rendering uniform in one line emission operation the number of the ultrasonic generating elements which are continuously driven in the continuous emission operation with the result that the capacity of the power supply can be set to a minimum level, and, at the same time, each cycle of the emission operation becomes uniform and a stable emission operation can be realized.

The stabilization of the emission of ink droplets and the long lifetime of the ultrasonic generating elements can be realized by arranging a plurality of groups of the ultrasonic generating elements so as to sandwich non-driving ultrasonic generating elements in the number larger than the number of the ultrasonic generating elements which constitutes a group between the groups to prevent the continuous operation of the same ultrasonic generating elements in a continuous emission operation thereby preventing a surplus continuous driving which generates heat of the ultrasonic generating elements.

A stable fixture of ink droplets after reaching the recording medium can be made possible by shifting the emission position by two or more ultrasonic wave elements for each of the emission operation, and an improvement in the image quality can be realized in a high speed recording of images.

Since the number of the ultrasonic generating elements which are continuously driven becomes definite and average by shifting the emission position in an equal distance for each of the emission operation in this case, the instant consumed power can be reduced and a stable emission operation can be realized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 9 is a view showing an example of the driving data series;

FIG. 10 is a view showing another example of the driving data series;

FIG. 11 is a view showing further another example of the driving data series;

FIG. 12 is a view showing further another example of the driving data series;

FIG. 25 is a view showing another example of the driving data series;

FIG. 26 is a view showing another example of the driving data series;

FIG. 27 is a view showing another example of the driving data series;

FIG. 34 is a view for explaining an operation for transmitting driving data in a shift register in FIG. 30;

FIG. 35 is a view for explaining an operation for transmitting the driving data in a shift register in FIG. 30;

FIG. 36 is a view for explaining an operation for transmitting driving data in a shift register in FIG. 30;

FIG. 37 is a view for explaining an operation for transmitting driving data in a shift register in FIG. 30;

FIG. 45 is a view showing another example of the driving data series;

FIG. 46 is a view showing another example of the driving data series;

FIG. 47 is a view showing another example of the driving data series;

FIG. 48 is a view showing another example of the driving data series;

FIG. 56 is a view for explaining an order of reading data from line memory;

FIG. 57 is a view for explaining a relation between the arrangement of the driving data and the emission position of the ink droplets;

DETAILED DESCRIPTION OF THE INVENTION

Figure 1:
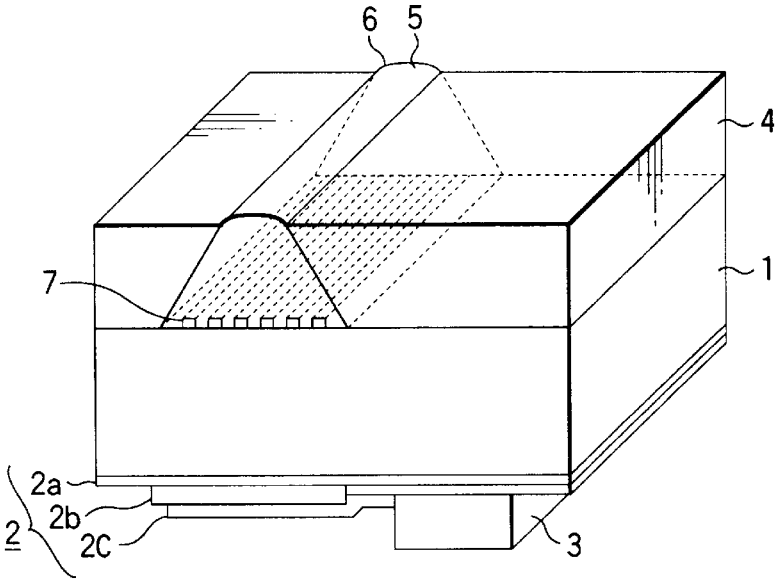
FIG. 1 is a view showing a schematic structure of an ink jet recording device according to an embodiment of the present invention.

An embodiment of the present invention will be explained by referring to the drawings.

Overall Structure of an Ink Jet Recording Device

FIG. 1 is a perspective view of an essential part showing a schematic structure of an ink jet recording device according to one embodiment of the present invention. In the beginning, a emission principle of ink droplets of the ink jet recording device in the present invention will be briefly explained. With respect to the details of this principle, Jpn. Pat. Appln. Publication No. 6-220713 can be referred to. In this embodiment, an example will be explained wherein a piezoelectric element is used as an ultrasonic generating element, and ink droplets are emitted by the pressure of the ultrasonic beams. However, ultrasonic beams having an audible frequency may be used.

As shown in FIG. 1, a piezoelectric element array 2 is formed on a glass plate 1 which serves as a support and as an ultrasonic wave interference layer (an acoustic matching layer). The piezoelectric 6 element array 2 is formed of a common electrode layer 2*a* which is allowed to form a surface junction with one main surface of the glass plate 1, a piezoelectric layer 2*b* which is located and joined on the other surface of this common electrode layer 2*a*, and an individual electrode layer 2*c* which is provided on the other surface of the piezoelectric layer 2*b* and separates the piezoelectric layer 2*b* in an array configuration.

On one main surface of the glass plate 1, a driving circuit 3 is further provided for driving the piezoelectric element array 2. A nozzle substrate 4 is located and joined on the other main surface of the glass plate 1. On the nozzle substrate 4, an ink chamber 5 is formed which is provided with a slit-like nozzle hole 6 which is formed by being cut in a trapezoidal cross section. On an interface between the ink chamber 5 and the glass plate 1, a one-dimensional Fresnel zone plate 7 is formed.

Here, the piezoelectric element array 2 is separated into a plurality of piezoelectric elements corresponding to the individual electrode layer 2*c*. The number of elements in the piezoelectric element is about 5000 in the case of a line head having a size equal to A4 size paper, for example, in a resolution of 600 dpi. The individual electrode layer 2*c* in this number of elements is arranged in one line. The piezoelectric element array 2 can be manufactured in the following manner.

In other words, on one main surface of the glass plate 1, a common electrode layer 2*a* comprising a metal thin layer 2*a* is formed, for example, in vapor deposition method. On the surface of this common electrode layer 2*a*, a piezoelectric material such as, for example, ZnO, PbTi or, $ZrO_3$ is sputtered to provide a piezoelectric material layer 2*b*. After that, the individual electrode layer 2*c* which forms a pair with the common electrode 2*a* on the surface of the piezoelectric layer 2*b* is formed in a pitch corresponding to a recording pitch. The piezoelectric layer 2*b* is designed so that the thickness of thereof is determined with a desired ultrasonic wave, and it is generally desired that the equivalent thickness 2*a* and 2*b* of the electrode layers 2*a* and 2*c* becomes half of ultrasonic wave.

The one-dimension Fresnel zone plate 7 is constituted by alternately arranging a first area which allows ultrasonic wave to pass to a position from X=0 to $1^{1/2}$K, from $3^{1/2}$k to $5^{1/2}$k, from $7^{1/2}$k to $9^{1/2}$k, and from $11^{1/2}$k to $13^{1/2}$k without an accompaniment of the phase shift, and a second area which allows ultrasonic wave to shift by a half wave length to a position from x=$1^{1/2}$K to $3^{1/2}$k, from $5^{1/2}$k to $7^{1/2}$k, from $9^{1/2}$k to $11^{1/2}$k and from $13^{1/2}$k to $15^{1/2}$k where a distance from the center is set to x. However, when the thickness of the nozzle substrate 4 (focal distance) is set to p, and a wave length of ultrasonic wave to be used is set to λ, a relation of $k=(\lambda p/2)^{1/2}$. These first and second areas may have a relatively half wave length phase difference. Consequently, either one of the two areas may be formed of light lithography of metal vapor deposition film. Besides, the thickness of the film is selected from about several μm to about tens of μm at which the half wave length phase shift is generated by a difference with a sound speed in the ink.

(Recording Principle of Ink Jet Recording Device of FIG. 1)

Figure 2A:
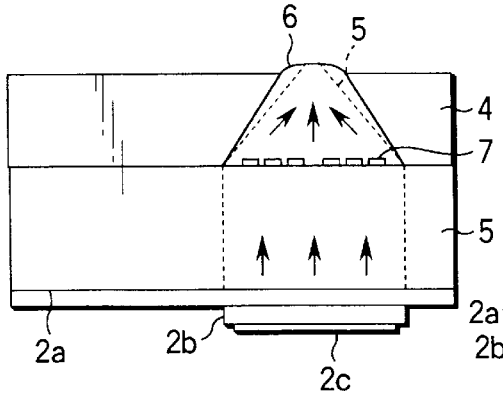
FIGS. 2A and 2B are views for explaining a recording principle of the ink jet recording device.
Figure 2B:
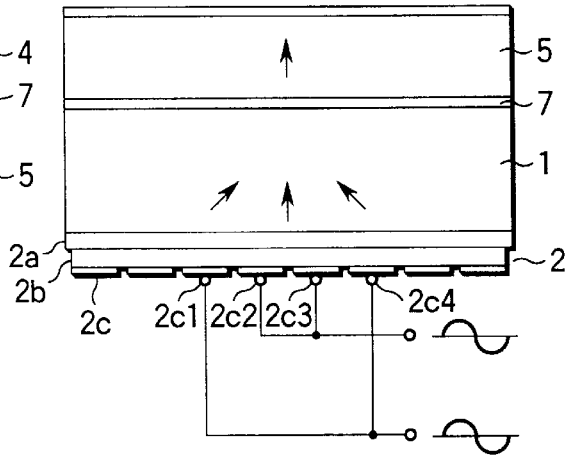

Next, a basic recording operation of the ink jet recording device of FIG. 1 will be explained by referring to FIGS. 2A and. 2B. FIG. 2A is a sectional view of an ink jet recording device, the view taken in a direction running at right angle with a nozzle hole 4. FIG. 2B is a sectional view thereof, the view taken along the nozzle hole 6.

In the beginning, in order to converge ultrasonic wave on a straight line passing a central line in an array direction of a group of piezoelectric elements which are to be driven out of the piezoelectric element array 2 and providing a position at which vertical surface and a liquid surface crosses in an array direction, a burst voltage comprising an alternate current having a predetermined frequency or a pulse series is applied to part of the piezoelectric array 2, for example, individual electrode layers 2*c*1, 2*c*2, 2*c*3, and 2*c*4 which are arranged in an equal distance. Here, the frequency of the burst voltage to be applied is set in such a manner that the wave length of the ultrasonic wave in the glass plate 1 which functions as an acoustic matching layer is longer than the pitch of the piezoelectric element array 2.

Then, a predetermined burst voltage is applied to inside two individual electrode layers 2*c*2, and 2*c*3 out of the individual electrode layers 2*c*1, 2*c*2, 2*c*3 and 2*c*4 while a burst voltage which is advanced in the phase than the inside two individual electrodes 2*c*2 and 2*c*3 is applied to outside two individual electrode layers 2*c*1 and 2*c*4 so that ultrasonic beams are converged on a straight line where the vertical surface and the liquid surface crosses in an array direction. At this time, mutual interference ultrasonic beams interfere with each other so that a lens effect is generated in an array direction (main scanning direction) of the piezoelectric element array 2.

On the other hand, the ultrasonic beams which reaches an interference between the glass plate 1 and the ink chamber 5 receives a lens effect such that the beams are converged with the Fresnel zone plate 7 in a centripetal manner in a direction of running at right angle with the array direction of the piezoelectric element array 2. In other words, the convergence in the main scanning direction of the ultrasonic beams starts from the inside of the glass plate 1 which serves as an acoustic matching layer (ultrasonic wave interference layer) while the convergence in the sub-scanning direction can be carried out only in the ink chamber 5 of the nozzle substrate 4.

At this time, the nozzle substrate 4 is set in such a manner that the thickness thereof is selected and set in advance so as to agree with the focus. As a consequence, the focus is allowed to agree with the surface of the ink with surface tension at a slit-like open part which forms the nozzle hole 6. Consequently, with the pressure of the ultrasonic beams which are converged in the main scanning direction and in the sub-scanning direction, the ink droplets are easily emitted from the surface of the ink so that a clear image can be recorded which is free from a disuniformity in concentration on a recording medium not shown.

(Method for Driving the Ink Jet Recording Device)

FIGS. 3A through 3D are views schematically showing an operation in the case where the ultrasonic beams are converged by setting four adjacent piezoelectric elements out of the piezoelectric element array 2. In other words, this is an operation in the case where one picture point of one line portion is divided at least in ¼ lines or more. A driving voltage is applied to individual electrode layers 2*c*1, 2*c*2, 2*c*3, 2*c*4, 2*c*5, 2*c*6, 2*c*7 and 2*c*8 in the main scanning direction in a linear electronic scanning operation.

Figure 3A:
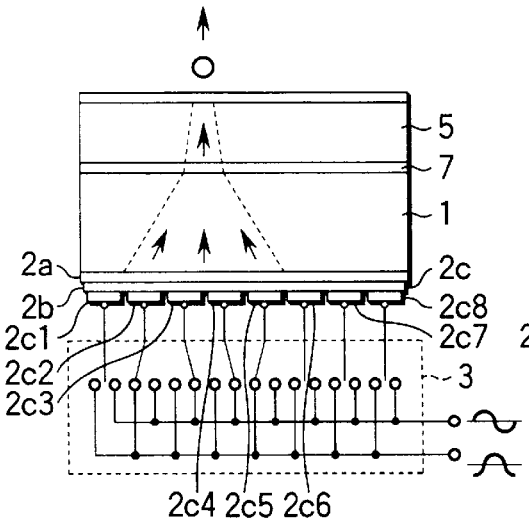
FIGS. 3A through 3D are views for explaining a driving method of the ink jet recording device.

In FIG. 3A, a predetermined burst voltage is applied to the inside two individual electrodes 2*c*3 and 2*c*4 out of the grouped individual electrode layers 2*c*2, 2*c*3, 2*c*4 and 2*c*5 while a burst voltage which is advanced in the phase than the inside two individual electrodes 2*c*2 and 2*c*3 is applied to outside two individual electrode layers 2*c*1 and 2*c*4 as described above.

Figure 3C:
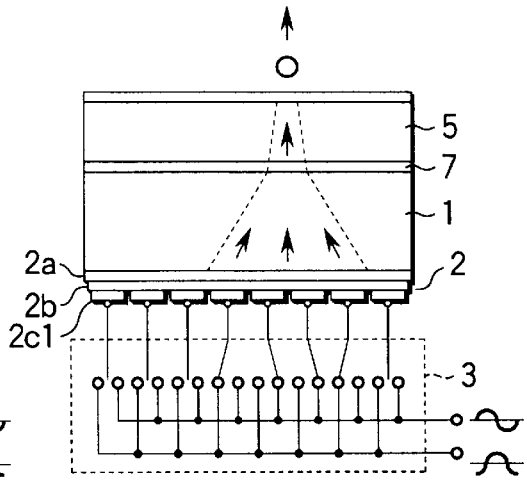
Figure 3B:
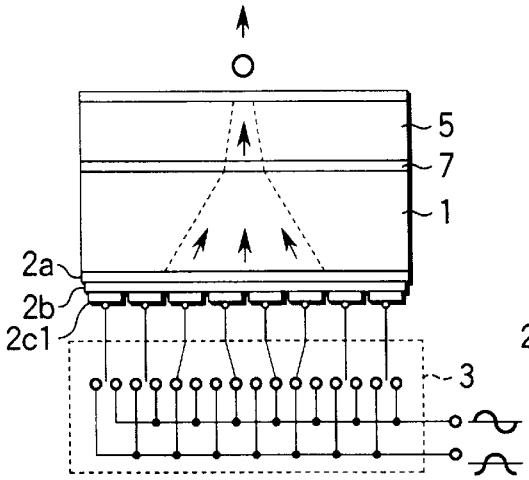

In FIG. 3B, next, the burst voltage is applied to the inside two individual electrode layers 2*c*4 and 2*c*5 out of the grouped individual electrode layers 2*c*3, 2*c*4, 2*c*5 and 2*c*6 while the burst voltage which is advanced in phase than the inside two individual electrode layers 2*c*4 and 2*c*5 is applied to the outside individual electrode layers 2*c*3 and 2*c*6.

In FIG. 3C, the burst voltage is applied to the inside two individual electrode layer 2*c*5 and 2*c*6 out of the individual electrode layers 2*c*4, 2*c*5, 2*c*5, 2*c*6 and 2*c*7 while the burst voltage which is advanced in phase is applied to the outside two individual electrode layers 2*c*4, and 2*c*7.

Figure 3D:
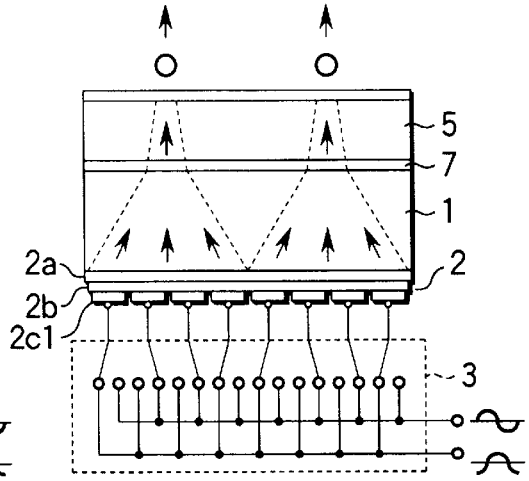

In FIG. 3D, there is shown an operation in the case where the individual electrode layers 2*c*1, 2*c*2, 2*c*3, 2*c*4, 2*c*5, 2*c*6, 2*c*7, and 2*c*8 are divided into a group of individual electrode layers 2*c*1, 2*c*2, 2*c*3, and 2*c*4 and a group of individual electrode layers 2*c*5, 2*c*6, 2*c*7 and 2*c*8 with the result that these two groups are driven at the same time, and two ink droplets are emitted in a predetermined pitch.

In this operation example, four piezoelectric elements constitute one group in order to record one pixel. When the number of piezoelectric elements which constitute one group is increased, the surface of the ultrasonic beams which is converged in a centripetal manner becomes smooth, and an energy density becomes high with the result that an attempt can be made to reduce the disuniformity of ink droplets and to reduce the driving voltage which is applied to the piezoelectric element array 2.

Figure 4:
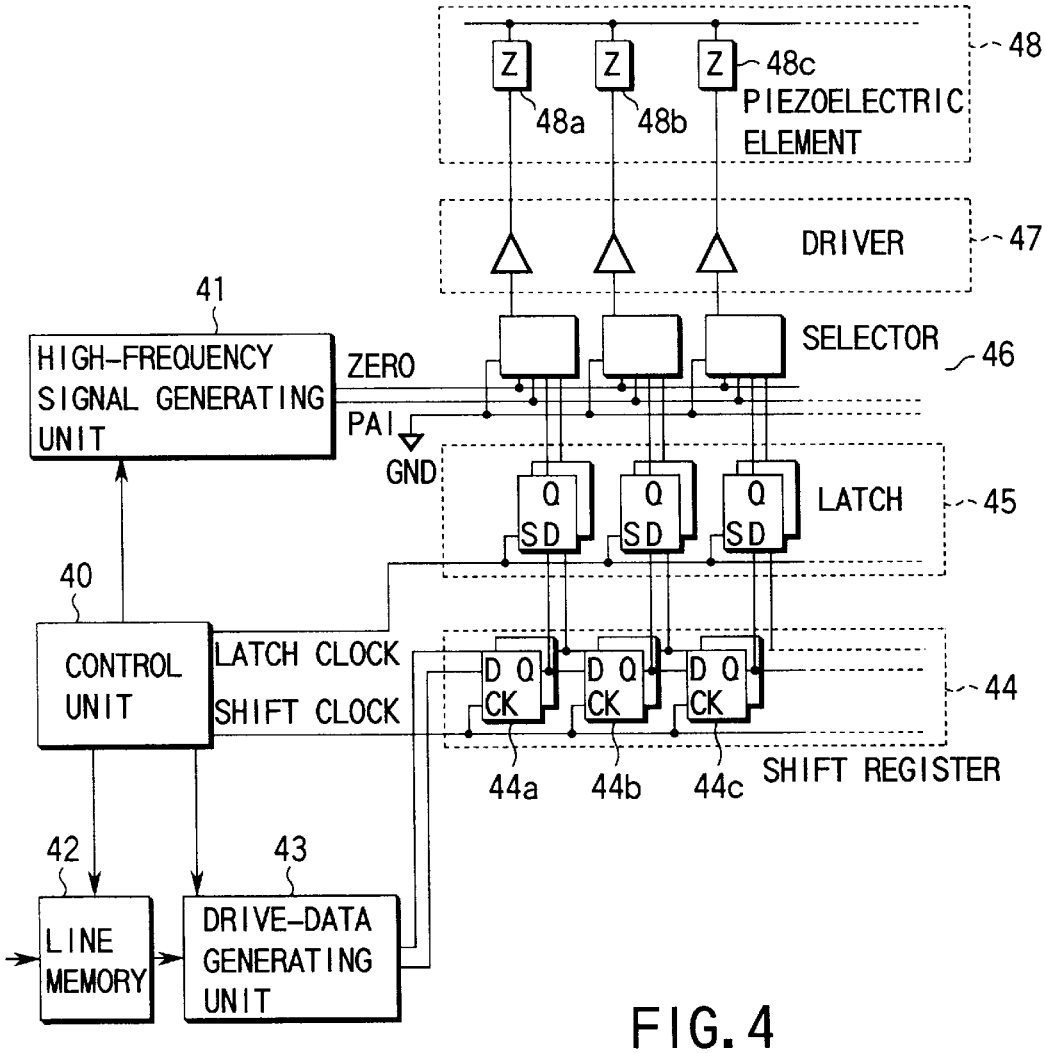
FIG. 4 is a block diagram showing a driving circuit in the ink jet recording device according to one embodiment.

One Embodiment of Driving Circuit 3 (FIG. 4)

Next, one embodiment of the driving circuit 3 in FIG. 1 will be explained.

FIG. 4 is a block diagram showing an essential part of a first embodiment of the driving circuit 3. In FIG. 4, a control unit is a part for controlling a timing of a system and the unit may have a CPU. The line memory 42 is controlled with a timing signal from the control unit 40 so that the image data is written and read.

The driving data generating section 43 generates driving data for driving a piezoelectric element of the piezoelectric element array 2 of FIG. 1. Here, for simplicity, the piezoelectric elements 48 are individually shown as 48*a*, 48*b* and 48*c*. It is possible to consider that the piezoelectric elements 48 correspond to the individual electrode layer from FIG. 1 to FIG. 3D. The details of this driving data generating section 43 will be explained later by using FIG. 7.

The image data which is sent from an output of a scanner not shown and a transmission channel is input to a line memory 42, and a timing is controlled with the control unit 40 so that the image data is written onto the line memory 42. The image data comprises one bit data per one pixel. The line memory 40 has a capacity of 4960 bits and can memorize data in one line portion having a size of A4 paper at a resolution of 600 dpi.

The image data which is temporarily memorized in the line memory 42 is subsequently read to be sent to the driving data generating section 43. At the driving data generating section 43, a selection signal is generated to drive the piezoelectric element 48 as described later.

(Operation of the Driving Circuit 3 of FIG. 4)

Figure 5:
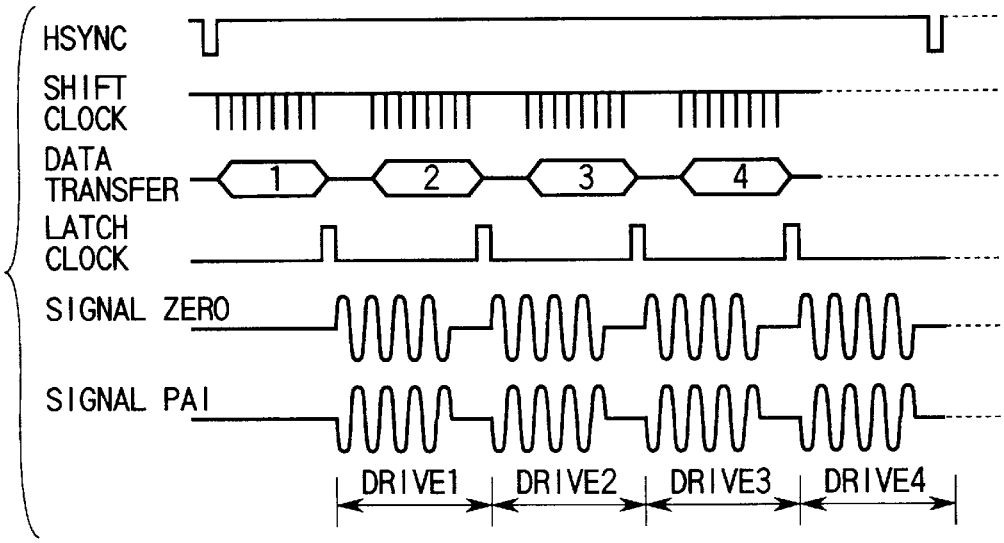
FIG. 5 is a timing chart for explaining an operation of the driving circuit shown in FIG. 4.

Next, an operation of the driving circuit 3 of FIG. 4 will be explained by referring to a timing chart of FIG. 5 showing a driving data transmission and a driving timing of the piezoelectric element.

The driving circuit 3 starts the operation at a rise of a horizontal synchronous signal HSYNC. The driving data which is generated at the driving data generating section 43 is given to the input of the shift register element 44*a* at the first step of the shift register 44. In synchronization with a clock SHIFT CLOCK from the control unit 40, the driving data is subsequently transmitted to the shift register elements 44*b*, 44*c*, - - - at the next step. When all the 4960 driving data items are transmitted to the shift register 44, the driving data items in the shift register 44 is fetched in a latch 45 with a latch signal LATCH CLOCK from the control unit 40.

In accordance with the driving data which is output from the latch 45 in the selector 46, either of two kinds of high frequency signals SIGNAL ZERO, SIGNAL PAI having different phases and a ground signal GND is selectively output.

Figures 6, 7:
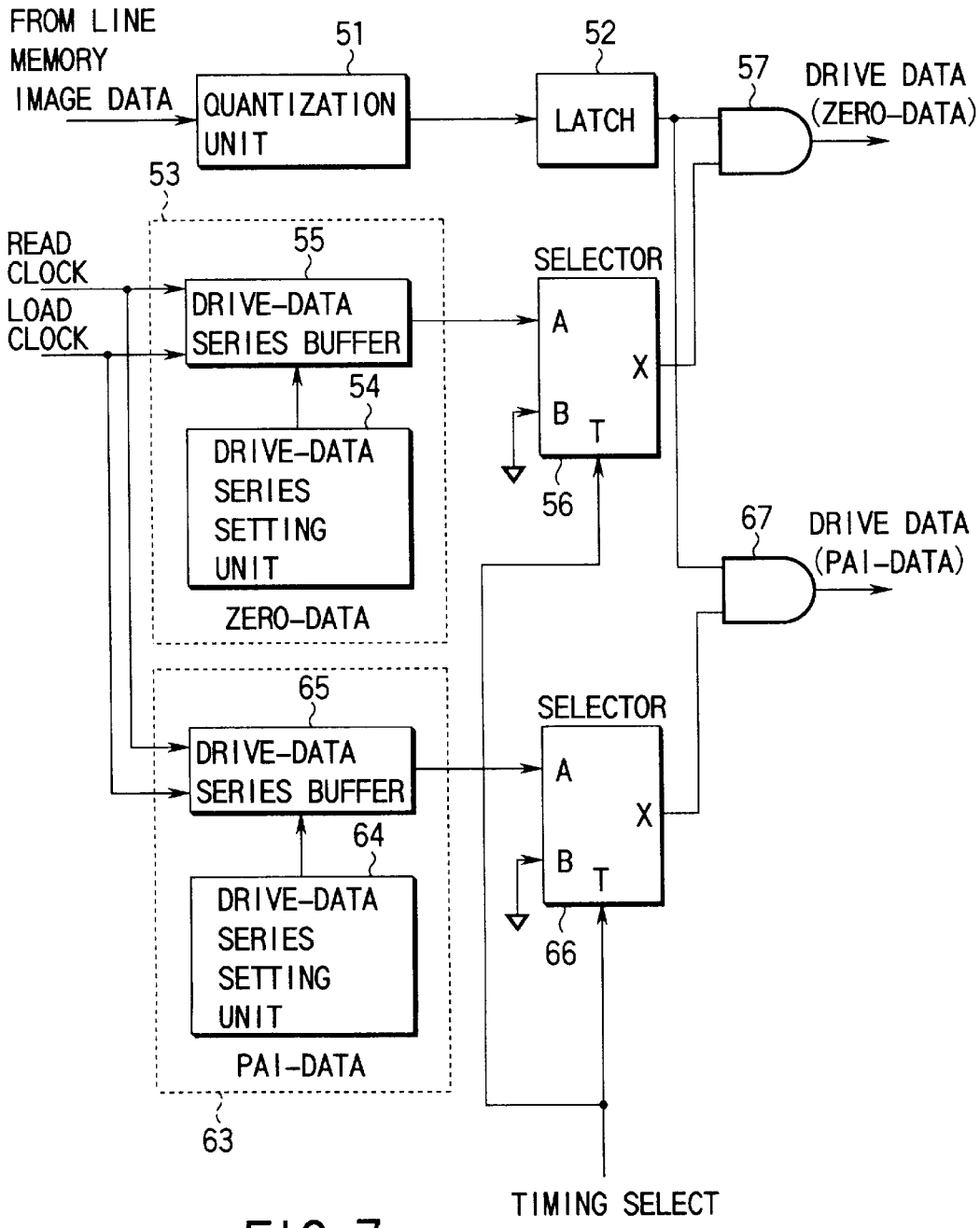
FIG. 6 is a view showing a table of truth value for explaining driving data and a drive phase.
FIG. 7 is a block diagram showing a structure of a driving data generating section in FIG. 4.

The driving data which is generated at the driving data generating section 43 is data for controlling ON and OFF of the piezoelectric element 48 respectively with these two kinds of high frequency signals SIGNAL ZERO and SIGNAL PAI and is one bit data with respect to one high frequency signal. In other words, the driving data is output as two-bit data for the ON and OFF of two kinds of high frequency signal. Consequently, the shift register 44 and the latch 45 corresponding to one piezoelectric element 48 are constituted so that two bits constitute one set. The high frequency signal in the selector 46 is selected on the basis of a table of truth value as shown in FIG. 6.

After the high frequency signal which is output from the selector 46 is amplified in voltage with the driver 47, the signal is applied to the corresponding piezoelectric element 48. To one piezoelectric element 48, a voltage with an amplitude of substantially 10V to 30V is applied. In order to emit ink droplets at about 600 dpi, the frequency of this high frequency signal is selected to about 50 MHz.

On the other hand, while a burst-like high frequency signal with respect to the piezoelectric element 48 is applied in this manner, the driving data is transmitted to the shift register 44 for applying the second high frequency signal. When the application period DRIVE 1 of the first high frequency signal, namely, the first ink droplets emission operation is terminated, the second application period DRIVE 2 of the high frequency signal starts. In the same manner, the high frequency signal is repeated applied so that the one line recording operation is terminated after a required cycles of the application is carried out. In FIG. 5, an example is shown in which one line is recorded in four cycles of emission operation for simplicity.

(About Driving data generating section 43)

FIG. 7 shows a schematic structure of the driving data generating section 43 of FIG. 4. In FIG. 7, the driving data series setting units 54 and 64 is designed for setting data series for driving a plurality of required number of piezoelectric elements in order to emit one ink droplet. In the case where one ink droplet is emitted by, for example, simultaneously driving four piezoelectric elements, four driving data items are set as one set of data series. Two kinds of the driving data series are prepared for selecting two kinds of high frequency signals SIGNAL ZERO and SIGNAL PAI having the aforementioned different phases.

In other words, the driving data generating section 43 has driving data series generation blocks 53 and 63 for generating two kinds of driving data series ZERO-DATA and PAI-DATA corresponding to two kinds of high frequency signals SIGNAL ZERO and SIGNAL PAI. These two driving data series generation blocks 53 and 63 can be realized in the same structure. The driving data series setting units 54 and 64 can be formed in a simple switch structure, or can be constituted by using a RAM or a ROM.

The driving data series buffers 55 and 56 are buffers for fetching a driving data series from the driving data series setting units 54 and 64, and subsequently reading in time series one by one data constituting the driving data series. In this embodiment, the driving data series buffers 55 and 65 are constituted with a shift register of a parallel input/serial output to read the driving data series from the driving data series setting units 54 and 64 with a load signal LOAD CLOCK from the control unit 40.

The selectors 56 and 66 selects the driving data which is sent from the driving data series buffers 55 and 65 respectively in accordance with a timing select signal TIMING SELECT from the control unit 40 and sends the driving data to AND circuits 57 and 67.

The AND circuits 57 and 67 send AND of the driving data from the selectors 56 and 66 and the image data from line memory 42 in FIG. 4 to the shift register 44 in FIG. 4 as the driving data DRIVE DATA. Here, it is necessary to allow a plurality of driving data items to correspond to one pixel portion of image data. Consequently, in this example, after the AND of four driving data items corresponding to four reading signals READ CLOCK and one image data item is sent respectively, the process moves to a process of processing one image data which is read from line memory 42. As a consequence, a latch 52 is provided for storing one image data which is read from line memory 42 in a period of reading the data four times.

In FIG. 7, the embodiment is constituted so that the image data from line memory 42 in FIG. 4 is input to the latch 52 via a quantization unit 51. However, in the case where two-value data is handled as image data as seen in the present embodiment, it is not necessary that the quantization unit 51 has some function. However, in the case where the image data which is input, for example, to the line memory 42 is multiple value data such as 8 bits per one pixel, a processing for converting an appropriate value into two values is carried out at this quantization unit 51.

In this manner, the data which is sent from the AND circuits 57 and 67 is the driving data for driving a predetermined piezoelectric element, and is two value data for selecting high frequency signals SIGNAL ZERO and SIGNAL PAI. In the same manner as the generation of the driving data ZERO-DATA for selecting the high frequency signal SIGNAL ZERO, the driving data PAI-DATA for selecting the high frequency signal SIGNAL PAI is also output. In other words, 2 bit data is input to the shift register 44 of FIG. 4.

(Operation of the Driving data generating section 43)

Next, an operation of the driving data generating section 43 will be explained in more detail by referring to the timing chart concerning the generation and the transmission of the driving data shown in FIGS. 8A through 8C.

Figure 8A:
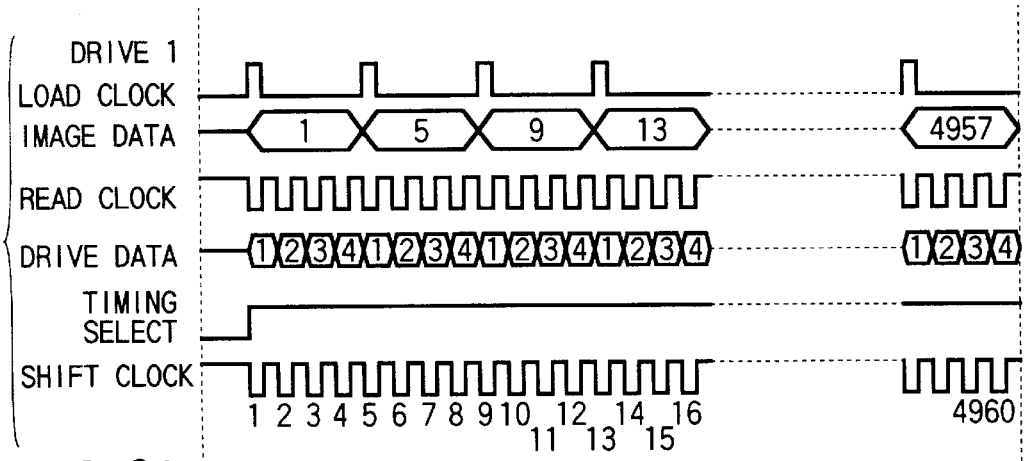
FIGS. 8A through 8C are timing charts for explaining an operation of the driving data generating section of FIG. 7.

As shown in FIG. 8A, the driving data series is fetched into the driving data series buffers 55 and 65 with a load signal LOAD CLOCK from the control unit 40 in the beginning. At this time, the image data IMAGE DATA on a first pixel is read from line memory 42 to be temporarily memorized in latch 52. Four driving data items DRIVE DATA are generated in synchronization with the reading signal READ CLOCK with respect to the image data on the first pixel.

Next, the image data on the fifth pixel which is located ahead by four pixels from the image data on the first pixel is read from line memory 42 and four driving data items are generated and sent with respect to the image data on this fifth pixel. Further, the image data which is shifted by four addresses is read from line memory 42 in the same manner. In other words, the driving data is set in such a manner that the ink droplets are emitted at every four positions of the piezoelectric elements.

In this manner, when 4960 driving data items are transmitted in this manner, a series of recording operation is carried out for fetching the driving data into the latch 45 from the latch signal LATCH CLOCK to emit ink droplets at every four positions of the piezoelectric elements as previously explained in the timing chart of FIG. 5.

Since the ink droplets are emitted at every four positions of elements, the ink droplets are emitted by shifting by one element the emission position at the time of the next cycle of emitting the ink droplets. In other words, as shown in FIG. 8B, the sending of the transmission clock SHIFT CLOCK with respect to the shift register 44 is started. The timing signal TIMING SELECT from the control unit 40 is OFF with respect to the transmission clock on the first pixel. The output of the selectors 56 and 66 of FIG. 7 sends the non-driving data (here, the ground signal GND) without selecting the driving data series. This serves to shift by one position the position of the piezoelectric elements which are used at the previous time of emitting ink droplets, and is intended to forcibly set the piezoelectric element corresponding to the tip-most end in a non-driving state.

After this, the timing select signal TIMING SELECT is turned ON so that the signal after the LOAD CLOCK is sent in the same manner as FIG. 8A. At this time, the image data which is read from line memory 42 is read at every four pixel positions, such as the second pixel, the sixth pixel, the tenth pixel, the fourteenth pixel and so on.

Figure 8B:
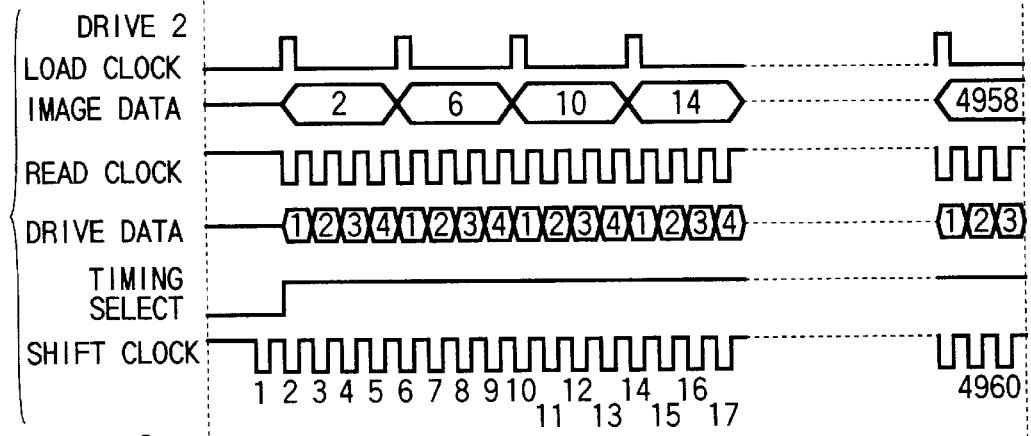
Figure 8C:
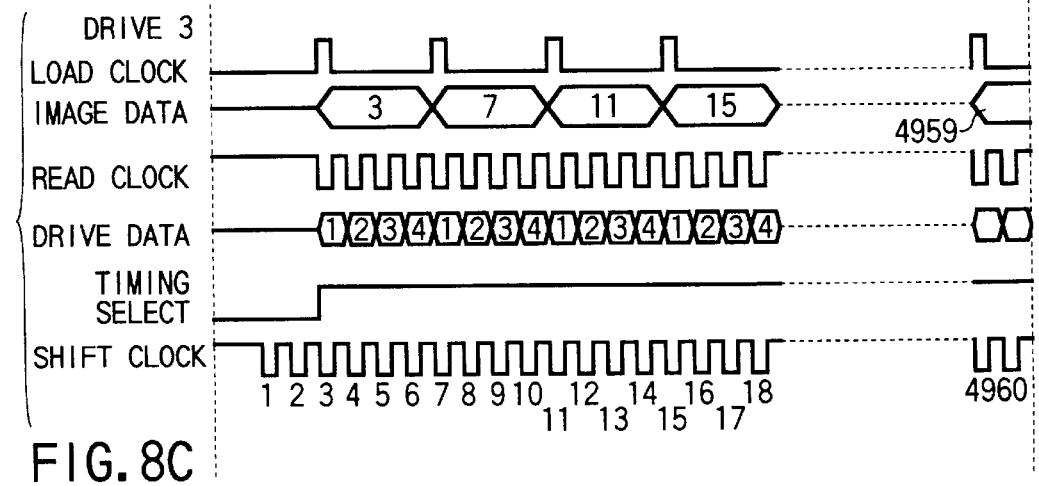

In the same manner, at the third cycle of emitting ink droplets, as shown in FIG. 8C, the relation between the timing select signal TIMING SELECT and the transmission clock SHIFT CLOCK is set so that only two elements from the end is set to a non-driving state in the third cycle of the operation for emitting the ink droplets. Though not shown, the same operation is carried out in the fourth cycle of the operation for emitting the ink droplets, and the emission of all the ink droplets in one line portion is completed so that the operation same as the first line is carried out in the emission of the next line.

(Concrete Example of Driving Data Series)

FIG. 9 shows one example of the driving data series which comprises four driving data items which are needed in the case of simultaneously driving four piezoelectric elements as described above. FIG. 9(A) shows a phase of a high frequency signal which is selected in an order of the arrangement of elements. FIG. 9(B) shows a driving data series at that time. Here, in this example, the data series refers to the data series in which PAI, ZERO, ZERO and PAI are provided in an order of the arrangement of piezoelectric elements 48. Here, ZERO and PAI refer to data for selecting respectively a high frequency signal having mutually different phases by 180°. The emission principle of the ink droplets in the case where such driving data is given is such as is explained in the aforementioned FIG. 2A and FIG. 3D.

Figures 13, 14:
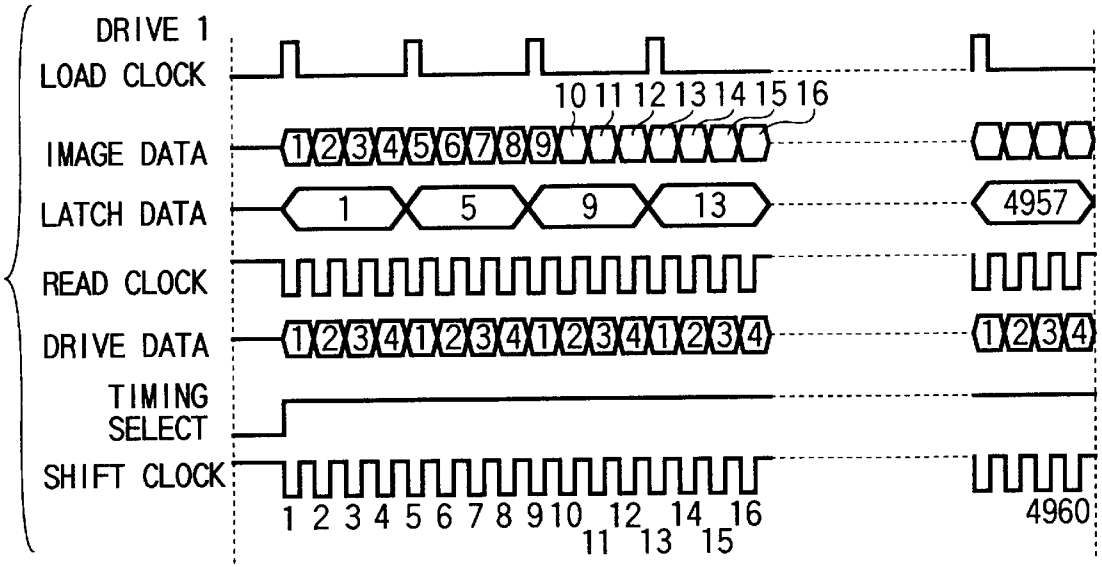
FIG. 13 is a view showing further another example of the driving data series.
FIG. 14 is another timing chart for explaining an operation of the driving data generating section in FIG. 7.

FIGS. 10 through 13 show an example of the driving data series in the case where the number of piezoelectric elements which are simultaneously driven (the number of elements which are simultaneously driven) is different. FIG. 10 shows an example in which the number of elements which are simultaneously driven is eight. FIG. 11 shows an example in which the number of elements which are simultaneously driven is nine. FIG. 12 shows an example in which the number of elements which are simultaneously driven is ten. FIG. 13 shows an example in which the number of elements which are simultaneously driven is sixteen.

As described above, in this embodiment, a driving data series comprising one set of driving data items as shown in FIG. 9(B) is set with the driving data series setting units 54 and 64, this driving data series is stored in the driving data series buffers 55 and 65 so that the driving data series is read subsequently via the selectors 56 and 66 to generate the driving data DRIVE DATA by taking AND with the image data at the AND circuits 57 and 67 and to transmit the driving data DRIVE DATA at the shift register 44 so as to correspond to each of the piezoelectric elements 48 with the result that a circuit for setting the driving circuit can be constituted in a relatively simple structure.

Particularly, as can be seen from the timing chart of FIGS. 8A through 8C, since the correspondence relation between the image data IMAGE DATA and the driving data DRIVE DATA series is concise, the image data corresponding to a pixel which is shifted by several data items of the driving data series may be read. For example, in the case where the ink droplets are emitted with sixteen piezoelectric elements as shown in FIG. 13, the image data corresponding to a pixel which is shifted by sixteen pixels may be read from line memory 42.

When a further development is made with the aforementioned operation, the operation timing of FIG. 8A can be controlled as shown, for example, in the timing chart of FIG. 14. In other words, the image data reading from line memory 42 is allowed to be synchronized with the reading signal READ CLOCK of the driving data series to fetch the image data in the latch 52 with the load signal LOAD CLOCK of the driving data series. In this case, image data is read from line memory 42 by one pixel for convenience to latch the data by every four pixels with the latch 52. By doing so, it becomes unnecessary to control the line memory 42 by every four pixels and the circuit can be simplified.

(Another Embodiment of Driving data generating section (FIG. 17))

Next, an embodiment of the driving data generating section 43 will be explained which enables the recording images at a high resolution by emitting ink droplets in a pitch narrower than the arrangement pitch of the piezoelectric element array 2.

Figures 15, 16:
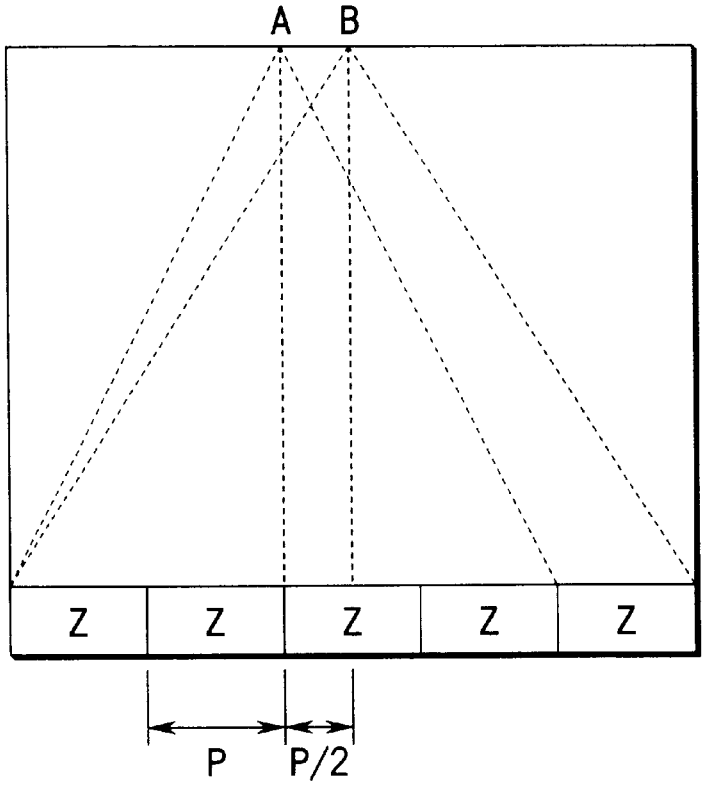
FIG. 15 is a view for explaining a relation between the number of driven elements of the piezoelectric element array and the emission position of ink droplets.
FIG. 16 is a view showing an example of first and second driving data series having different emission mode of ink droplets.

In the beginning, the principle of the present embodiment will be described by using FIG. 15 and FIG. 16(B). FIG. 15 is a view schematically showing a relation between a position of the non-driving piezoelectric element and the emission position of the ink droplets in the case where four or five adjacent piezoelectric elements are simultaneously driven to emit one ink droplets.

Here, in the case where four piezoelectric elements are simultaneously driven by using the driving data shown in FIG. 16(A), ultrasonic waves are converged on point A on the ink liquid surface so that ink droplets are emitted from point A. On the other hand, in the case where five piezoelectric elements are simultaneously driven which uses the driving data shown in FIG. 16(B), the ultrasonic waves are converged on point B which is deviated by P/2 (P refers to an arrangement pitch of the piezoelectric element array) from point A on the ink liquid so that the ink droplets are emitted from point B.

In this manner, the emission position of ink droplets is deviated by ½ with respect to the arrangement pitch P of the piezoelectric element array when two cases are compared; one is a case in which the number of piezoelectric elements which are driven for emitting one ink droplet is even and the second is a case in which the number of elements which are driven for emitting the ink droplets is odd. This embodiment uses such principle. Incidentally, with respect to this principle, for example, Jpn. Pat. App. KOKAI Publication No. 7-45661 can be referred to.

Figure 17:
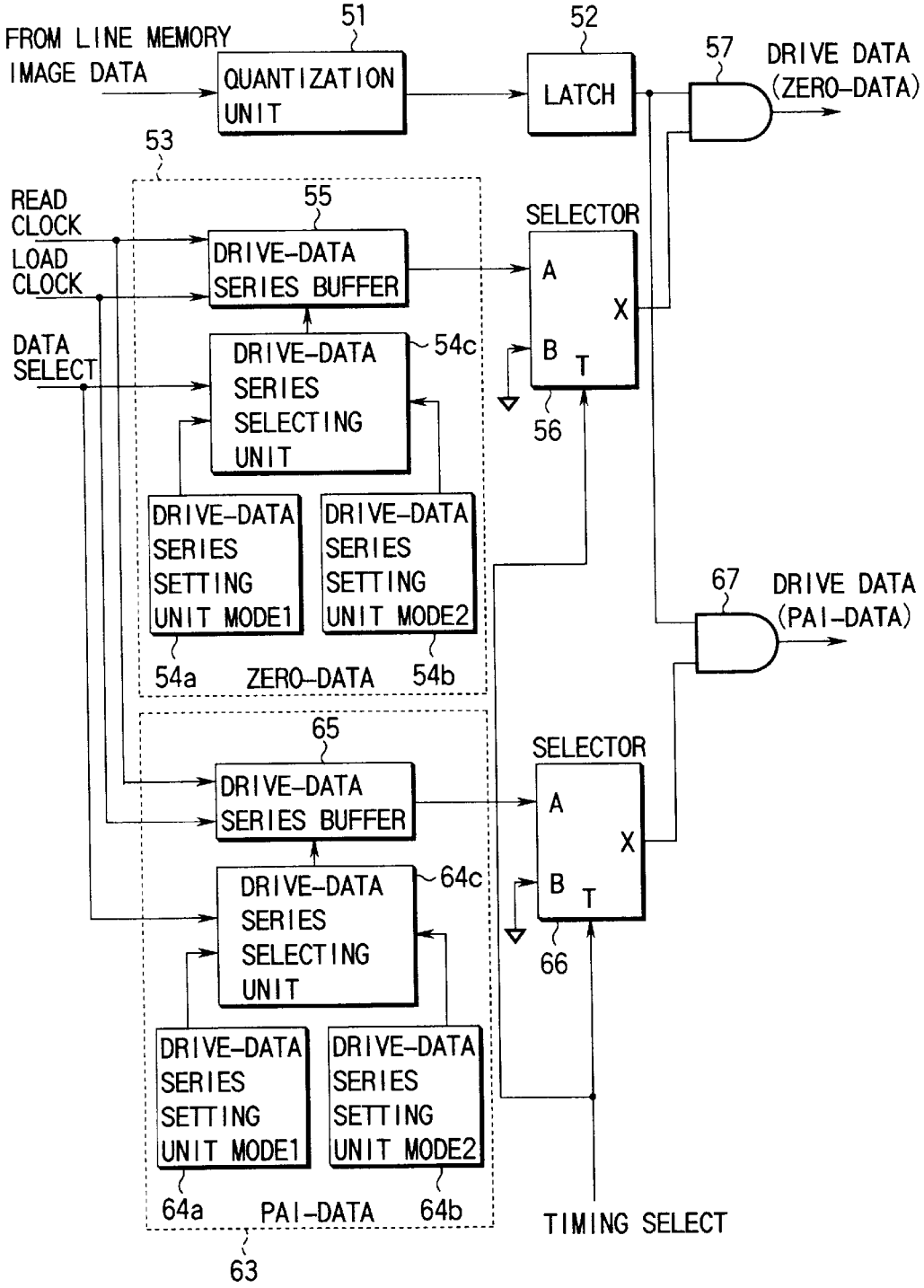
FIG. 17 is a block diagram showing a structure of the driving data generating section in FIG. 4 according to another embodiment of the present invention.

FIG. 17 is a block diagram showing a structure of an essential part of the driving data generating section 43 in the present embodiment. The driving data generating section 43 of FIG. 17 is constituted so that the unit 43 is provided with two driving data series generation blocks 53 and 63 for generating two kinds of driving data series ZERO-DATA and PAI-DATA corresponding to two kinds of high frequency signals SIGNAL ZERO and SIGNAL PAI. These two driving data generating sections 53 and 63 are operated in the same manner in the same structure. Here, only one driving data series generation block 53 will be explained.

In this embodiment, two driving data series setting units are prepared for selecting one high frequency signal. In other words, the driving data series setting part 54*a* is for the first emission mode for emitting the ink droplets onto the first emission position while the driving data series setting unit 54*b* is for the second emission mode for emitting the ink droplets onto the second emission position. When the structure is allowed to correspond to FIG. 15, the first emission mode is a case in which an odd number of the piezoelectric elements are simultaneously driven while the second emission mode corresponds to a case in which an even number of piezoelectric elements are simultaneously driven. As an example of the driving data series which are respectively set in these driving data setting units 54*a* and 54*b*, for example, FIG. 10, and FIG. 11 can be cited.

The driving data series selecting unit 54*c* is operated as a data selector to output one of the first and the second driving data series which are respectively set in the driving data series setting units 54*a* and 54*b* with a selection signal DATA SELECT from the control unit 40 is output to the driving data series buffer 55.

The driving data series which is selected by the driving data series selecting unit 54*c* is stored in the driving data series buffer 55 with a load signal LOAD CLOCK from the control unit 40 to be read from the driving data series buffer 55 in synchronization with the reading signal READ CLOCK. Hereinafter, a basic operation will be explained in accordance with an operation of FIG. 7.

Next, an operation will be explained in detail in the case where the driving data series shown in FIG. 16 is used respectively as a first and a second driving data series.

FIG. 16(A) shows a driving data series for simultaneously driving four piezoelectric elements, and the driving data series comprises five data items. The fifth data NON is neither of two kinds of high frequency signals, and shows data for setting the corresponding piezoelectric elements in a non-driving state. In other words, this driving data series comprises five data items, but only the four driving data items are substantially driven. In this case, the driving data corresponding to the four piezoelectric elements which are driven is set in a right and left symmetrical configuration so that the ink droplets are emitted at a central position (shown by an arrow) of the four piezoelectric elements which are driven.

FIG. 16(B) shows a driving data series for simultaneously driving five piezoelectric elements. Since this driving data series is set in a right and left symmetrical configuration, the ink droplets are emitted from the center (shown by an arrow) of five piezoelectric elements which are driven.

As can be seen from FIGS. 16(A) and 16(B), in these first and the second driving data series, the emission positions of the ink droplets are mutually shifted by ½ with respect to the arrangement pitch of piezoelectric elements.

Next, an operation of the driving data generating section 42 of FIG. 17 in the case where this driving data series is used will be explained. In the driving data generating section 43 in this embodiment, the three kinds of methods shown below can be appropriately adopted with respect to the selection of the driving data series at the driving data series selecting unit 54*c*. Each of the aforementioned methods for selecting driving data series will be explained Hereinafter.

(First Method for Selecting the Driving Data Series)

This first method for selecting the driving data series is a method for alternately switching and selecting the first and the second driving data series in each cycle of the operations of emitting the ink droplets.

Figures 18A, 18B, 18C:
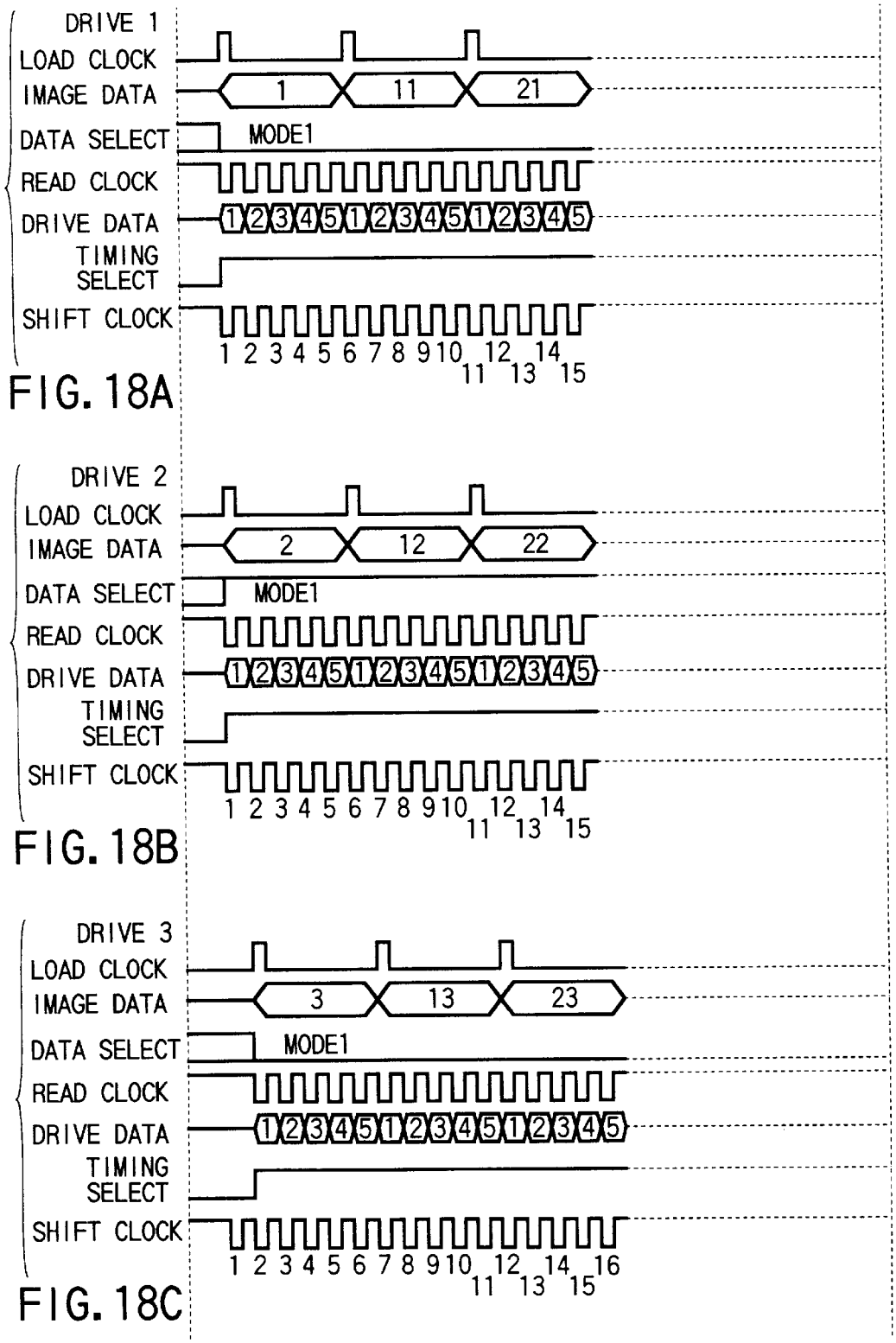
FIGS. 18A to 18C are timing charts for explaining an operation of the driving data generating section of FIG. 17 in the first method for selecting driving data series.
Figure 19:
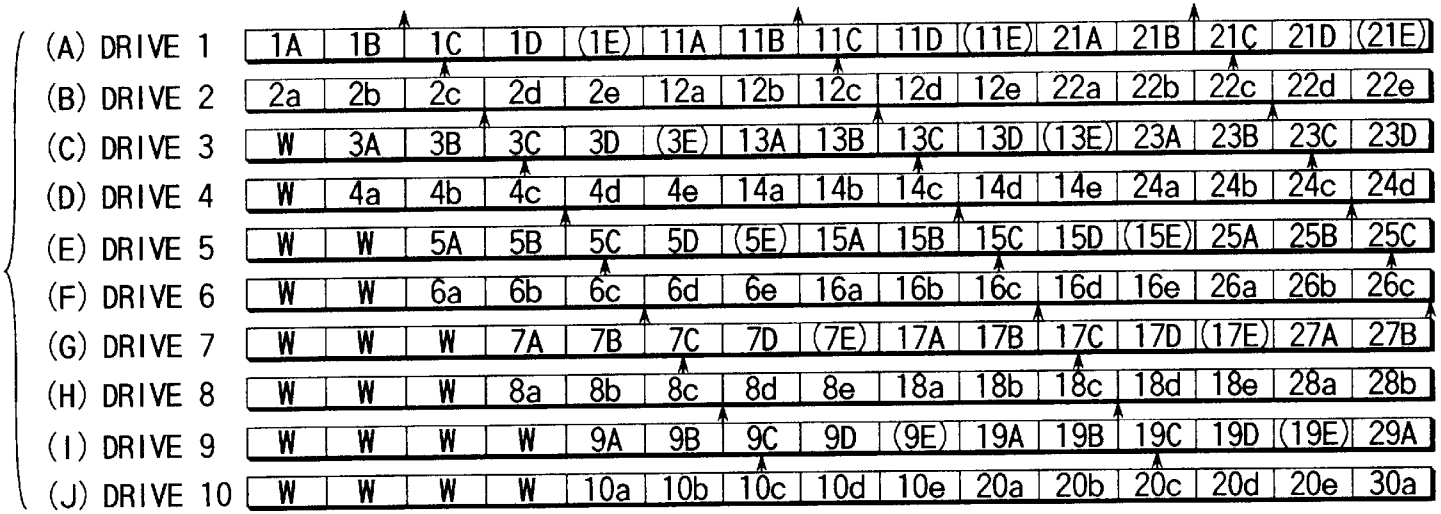
FIG. 19 is a view for explaining an arrangement of driving data and the emission position of ink droplets in the first method for selecting the driving data series.

FIGS. 18A to 18C are views showing operation timing charts of the driving data generating section 43 on the basis of the first method for selecting the driving data series. FIG. 19 is a view schematically showing a relation between the arrangement of the driving data which is set in the shift register 44 of FIG. 4 and the emission position of the ink droplets.

In the beginning, a first cycle of the operation for emitting the ink droplets will be explained by referring to FIG. 18A.

In FIG. 17, the image data on the first pixel is fetched into the latch 52 from line memory 42 in FIG. 4. At the same time, the driving data series is read from the driving data series buffer 55 in synchronization with the reading signal READ CLOCK. At this time, the driving data series which is read from the driving data series buffer 55 is a first driving data series which is set at the driving data series selecting unit 54*a*, and is selected at the driving data series selecting unit 54*c* in accordance with the selection signal DATA SELECT from the control unit 40. This first driving data series is set for simultaneously driving the adjacent four piezoelectric elements as shown in FIG. 16(A). This will be referred to as a driving data series of mode 1 (MODE 1).

By taking AND with the image data on the first pixel at the AND circuit 57 while subsequently reading the driving data series in this manner, the AND is output as driving data to the shift register 44. When five driving data items are output at the same time, the driving data series of mode 1 is set from the driving data series setting unit 54*a* again with a load signal LOAD CLOCK from the control unit 40. At the same time, the image data on the first pixel is fetched in the latch 52 from line memory 42 so that the driving data series of the mode 1 is subsequently read from the driving data series buffer 55 in synchronization with the reading clock READ CLOCK to generate the driving data corresponding to five piezoelectric elements. In the same manner, the image data is fetched in the latch 52 and five driving data items are output to the shift register 44.

When all the 4960 driving data items are transmitted per one line to the shift register 44 by repeating such operation, the driving data is fetched into the latch 45 with the latch signal LATCH CLOCK from the shift register 44 in the same manner as the operation timing shown in FIG. 5 so that each of the piezoelectric elements is driven on the basis of the driving data which is fetched in this latch 45. Thus, the first cycle of the operation for emitting the ink droplets is terminated.

Here, the operation from FIG. 18A to FIG. 18C is largely different from the operation shown in FIG. 8A to FIG. 18C in that the image data is arranged in every ten pixels, which is attributed to the usage of two kinds of driving data items which comprise five driving data items.

Next, a second cycle of the operation for emitting the ink droplets will be explained by referring to FIG. 18B.

In this case, in the same manner as the first cycle of the emission operation, the image data on the second pixel is fetched in the latch 52. At the same time, the driving data series is read from the driving data series buffer 55 in synchronization with the reading signal READ CLOCK. At this time, the driving data series which is read from the driving data series buffer 55 is the first driving data series which is set with the driving data series buffer 55 and is selected with the driving data series selecting unit 54*c* in accordance with the selection signal DATA SELECT from the control unit 40. This second driving data series is intended for simultaneously driving adjacent five piezoelectric elements as shown in FIG. 16(B). This is referred to as the driving data series of mode 2 (MODE 2).

When five driving data items corresponding to the image data on the second pixel are generated and output to the shift register 44 in this manner, the process moves next to the processing of the image data on the twenty-second pixel. All the driving data is transmitted to the shift register 44 to carry out a second cycle of the operation for emitting the ink droplets.

Next, a third cycle of the operation for emitting the ink droplets will be explained by referring to FIG. 18C. At the time of generating the driving data for the third cycle of the operation for emitting the ink droplets, the driving data of mode 1 is selected in the same manner as the first cycle of the emission operation. In the same manner, in the fourth cycle of the emission operation, the driving data of mode 2 is selected so that the driving data of mode 1 and the driving data of mode 2 are mutually selected in each of the operations for emitting the ink droplets. The switching of the selection of such driving data series is carried out with a signal from the control unit 40. In this manner, in the present embodiment, ten cycles of the operations for emitting the ink droplets are carried out with respect to one line recording operation.

FIG. 19 is a view showing a relation between the arrangement of driving data set in the shift register 44 in these ten cycles of the operations for emitting the ink droplets and the emission position at that time. In FIG. 19, the order of the arrangement of the driving data series of mode 1 is set to A, B, C, D and E, and the arrangement order of the driving data of mode 2 is set to a, b, c, d, and e so that the driving data on the first driving data corresponding to the image data on the nth pixel is described as nA or na. The emission position of the ink droplets is shown by an arrow in the drawings. For example, in the first cycle of the emission operation, it is shown that the ink droplets are emitted at a middle position between the driving data 1B and 1C, and the ink droplets are emitted at a position of the driving data 2*c* in the second cycle of the emission operation.

As apparent from the aforementioned fact, in the first to the tenth cycle of the emission operation, the operation is carried out in such a manner that the emission position of the ink droplets is shifted by ½ of the arrangement pitch of the piezoelectric element array 2 at each time. It is shown that data attached with 0 such as the driving data (1E) refers to the data which sets the corresponding piezoelectric element in a non-driving state. These data items are formed in an operation of the selector 56 as explained in the previous FIGS. 8A through 8C.

The aforementioned first method for selecting the driving data series is a method for switching and selecting two driving data series for each cycle of the operations for emitting the ink droplets. In a simple circuit structure, the image can be recorded in a high resolution having a pitch larger than the arrangement pitch of the piezoelectric element array. Since the relation between the order of the arrangement of the image data and the emission position of the ink droplets is particularly simple, it is possible to simplify a method for reading the image data from line memory 42. There is an advantage in that an attempt can be made to stabilize the recording operation because the emission position of the ink droplets is arranged in a predetermined interval in any operation for emitting the ink droplets.

(Second Method for Emitting Driving Data Series)

A second method for emitting the driving data series is a method for selecting the driving data series by mixing the first driving data series (driving data series of mode 1) and the second driving data series (driving data of mode 2), namely alternately switching the arrangement order of the driving data series in one cycle of the operation for emitting the ink droplets.

Figure 21:
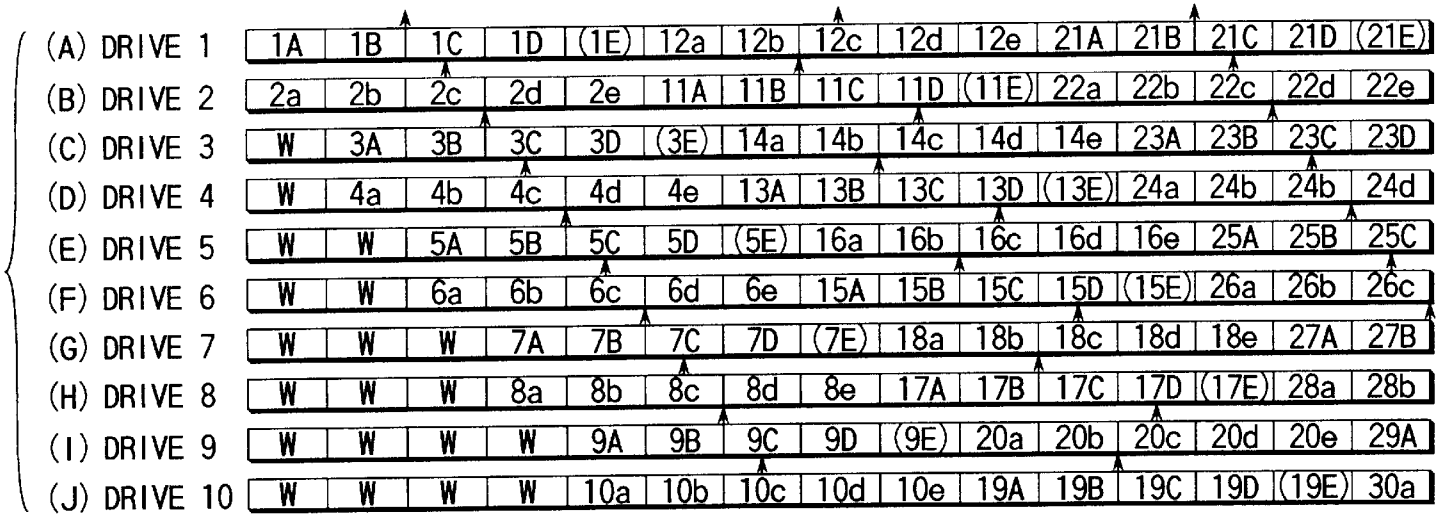
FIG. 21 is a view for explaining the arrangement of driving data and the emission position of ink droplets.
Figure 20A:
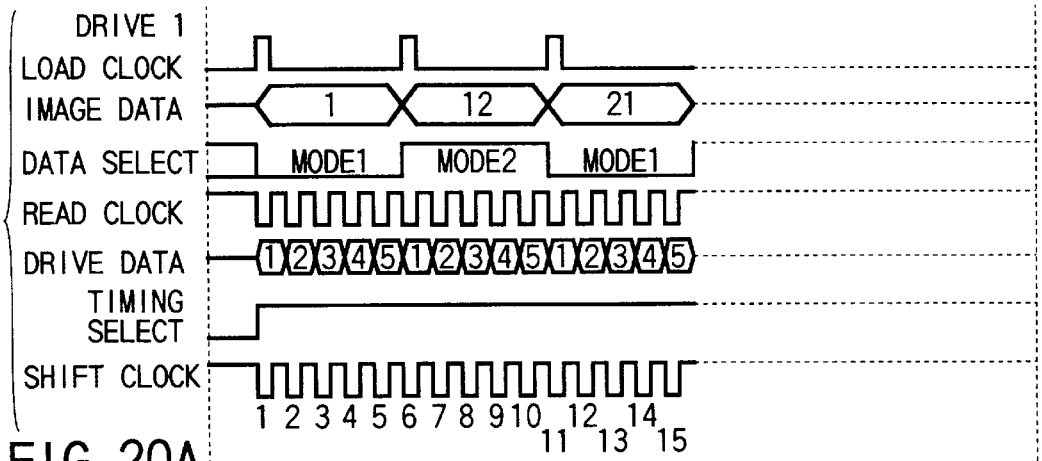
FIGS. 20A through 20C are timing charts for explaining an operation of the data generating part of FIG. 17 in the first method for selecting the driving data series.

FIGS. 20A through 21(J) show an example in which the arrangement order of two driving data series are alternately switched and selected in the order of the arrangement of adjacent driving data series. FIGS. 20A through 20C show an operation timing. FIG. 21 shows a relation between the order of the arrangement of the driving data and the emission position of the ink droplets.

Figure 20B:
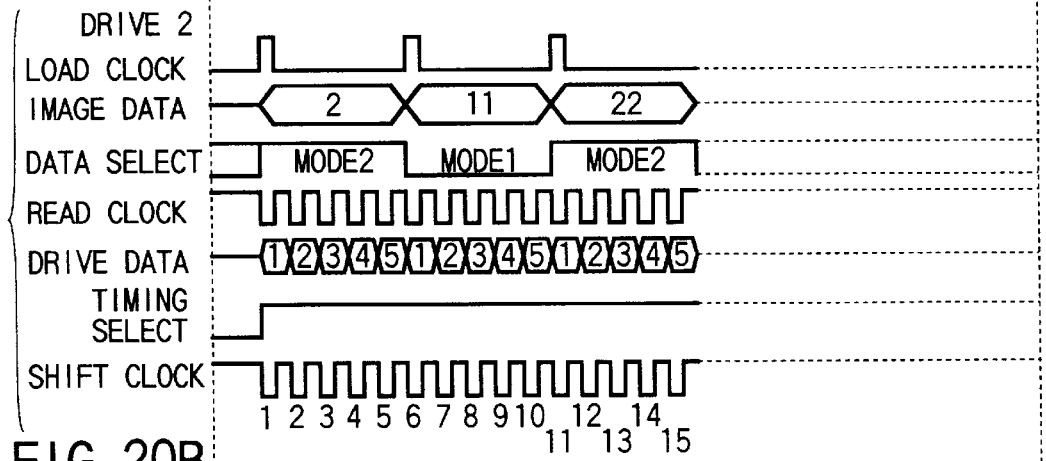
Figure 20C:
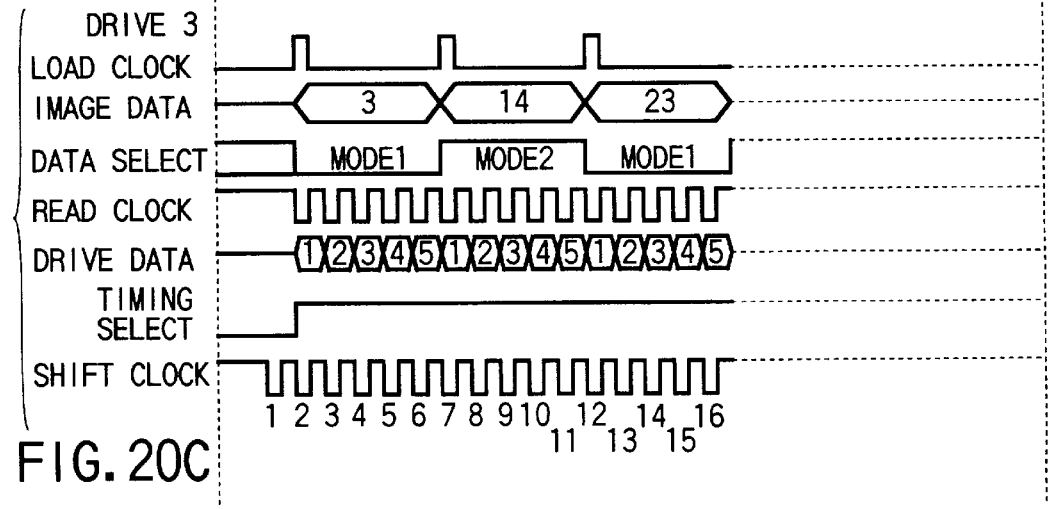

In FIGS. 20A through 20C, the driving data series of mode 1 is used to generate five driving data items corresponding to the image data on the first pixel in the first cycle of the operation for emitting the ink droplets. Next, the driving data series of mode 2 is used to generate five driving data items corresponding to the image data on the twelfth pixel. In other words, the driving data series are alternately switched and selected to generate the driving data series. The driving data is generated in the same operation with respect to the operation for emitting the ink droplets in the operation for emitting the ink droplets after the second cycle of the operation.

As a point which is different from the case shown in FIGS. 18A to 18C, there is cited a point such that the image data is processed in an order of the first pixel, the twelfth pixel, the twenty-first pixel and so on in the first cycle of the operation for emitting the ink droplets while the image data is processed in an order of the second pixel, the eleventh pixel, the twenty-second pixel and so on in the operation for emitting the ink droplets after the second cycle thereof. As can be seen from FIG. 21, the emission operation corresponding to the image data on the pixel in the order of an odd number is alternately shifted in each cycle of the operation for emitting the ink droplets. However, when ten cycles of the operation for emitting the ink droplets are terminated, the operation is correctly carried out as a one-line recording operation.

In this manner, the second method for selecting the driving data series is a method for selecting the driving data by switching alternately the arrangement order of the driving data and mixing the driving data of mode 1 and the driving data of mode 2 in one cycle of the operation for emitting the ink droplets. Since the driving data which sets the piezoelectric element in a non-driving state, for example, the driving data (1E) is always present in each cycle of the operation for emitting the ink droplets, it is possible to reduce a maximum number of the piezoelectric elements which are simultaneously driven. As a consequence, there is an advantage in that the capacity of power supply of the driving circuit can be reduced. There is also an advantage in that a mutual interference of the emission of the ink droplets can be prevented from each group thereby stabilizing the emission operation because the non-driving data is provided in a definite interval with respect to the arrangement direction of the piezoelectric elements.

(Third Method for Selecting the Driving Data Series)

Figures 22A, 22B, 22C:
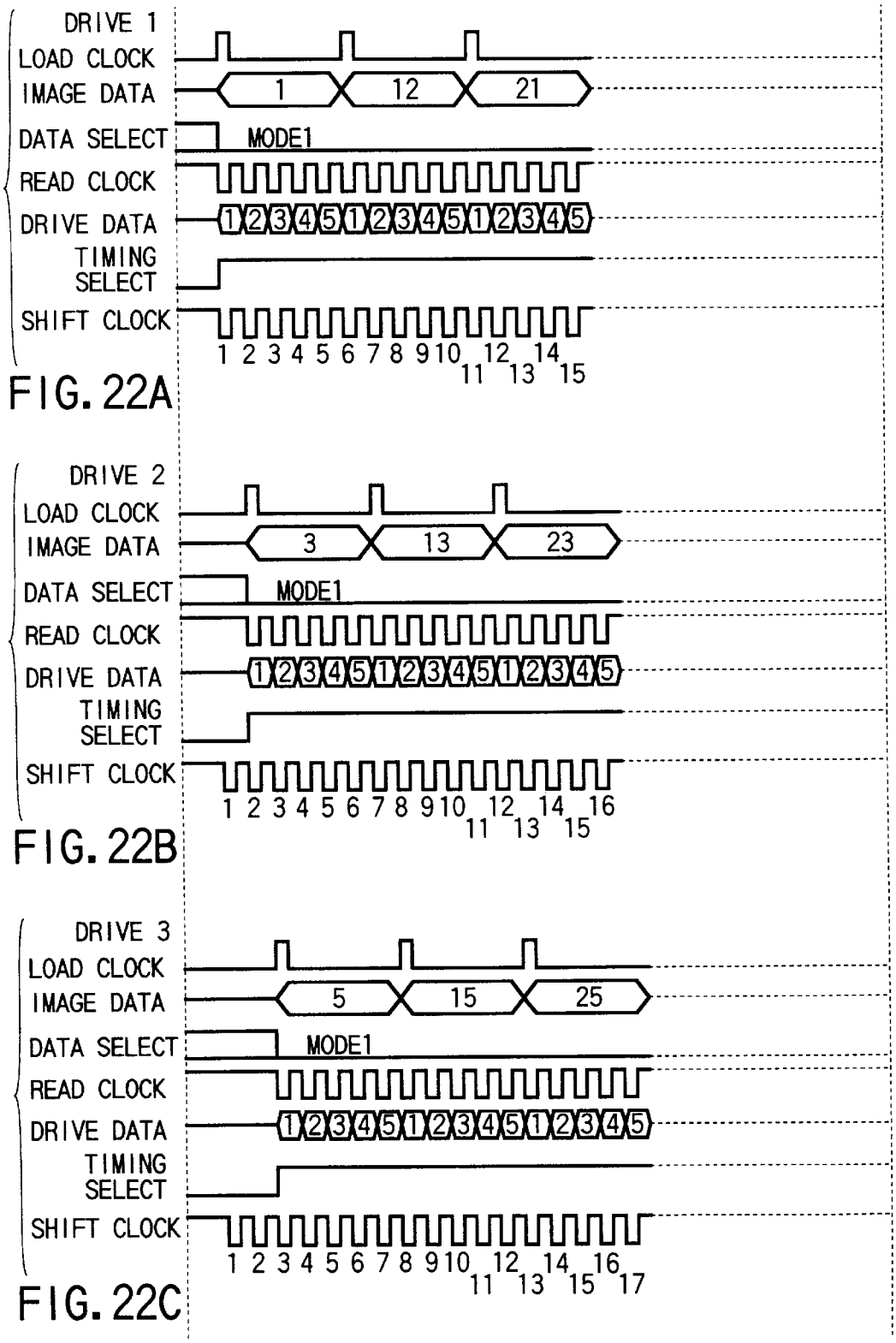
FIGS. 22A through 22F are timing charts for explaining an operation of the driving data generating section of FIG. 17 in the third method for selecting the driving data series.

A third method for selecting the driving data series is a method for selecting the driving data series by switching and selecting the driving data series of mode 1 and the driving data series of mode 2 in the first half and the second half of the period of the operation for emitting the ink droplets in one line. The third method for selecting the driving data series will be concretely explained by using FIGS. 22A through 23(J). FIGS. 22A through 22F show an operation timing while FIG. 23 shows a relation between the order of the arrangement of the driving data and the emission position of the ink droplets.

In this example, the one-line recording operation is carried out in ten cycles of the operation for emitting the ink droplets. In the first half of the five cycles of the emission operation, the driving data of mode 1 is used to generate the driving data series of mode 1 while in the second half of the five cycles of the operations for emitting the ink droplets, the driving data of mode 2 is used to generate the driving data series. FIGS. 22A through 22C show an operation of the driving data generating section 43 at the time of the first, the second and the third cycles of the operation for emitting the ink droplets. In other words, the driving data series of mode 1 with respect to the first cycle of the operation for emitting the ink is repeatedly read to generate the driving data corresponding to the image data on the first pixel, the eleventh pixel and the twenty-first pixel. The same operation is carried out at the time of the operation for emitting the ink droplets after the second cycle.

Figures 22D, 22E, 22F:
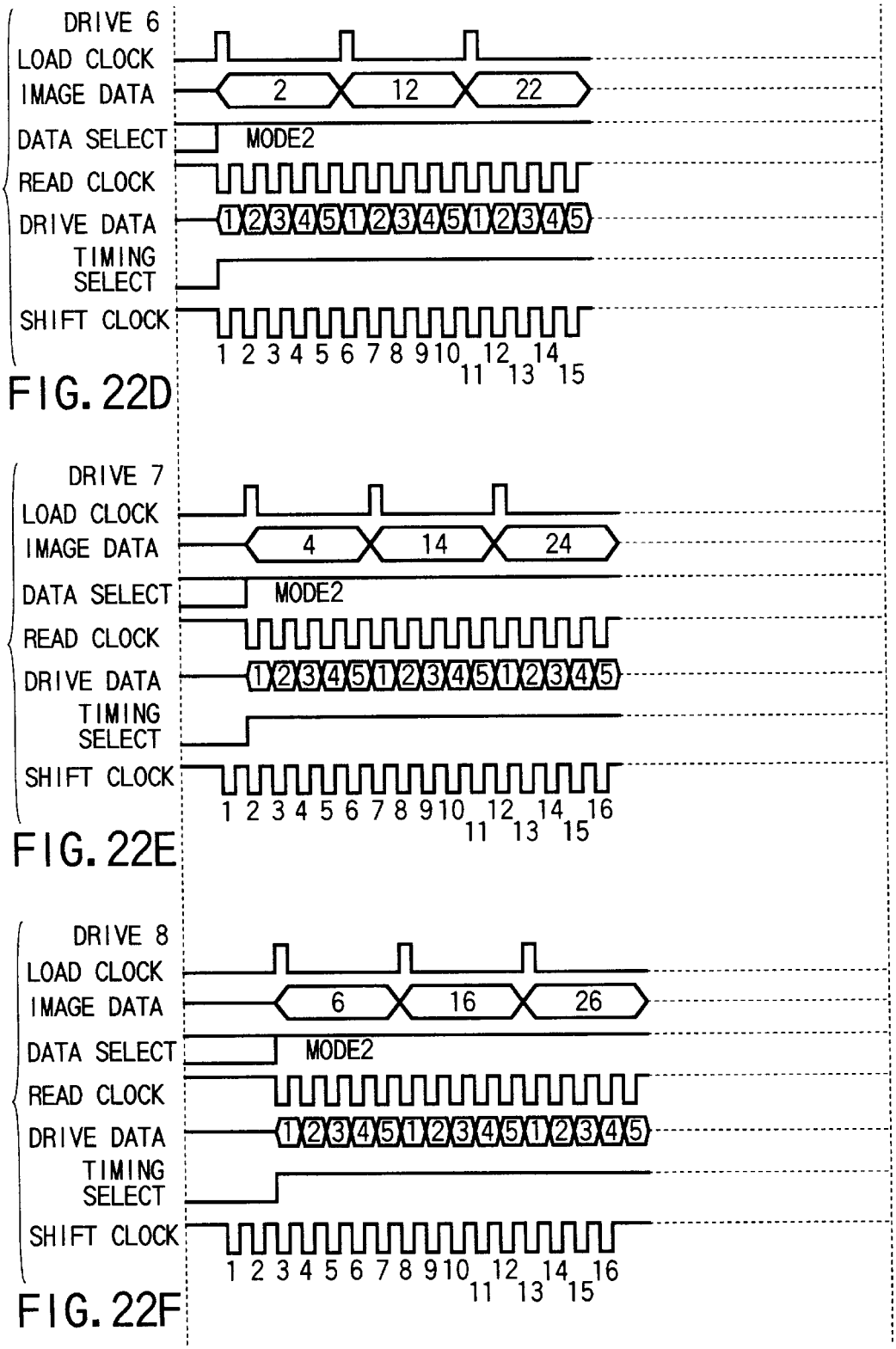
Figures 23, 24:
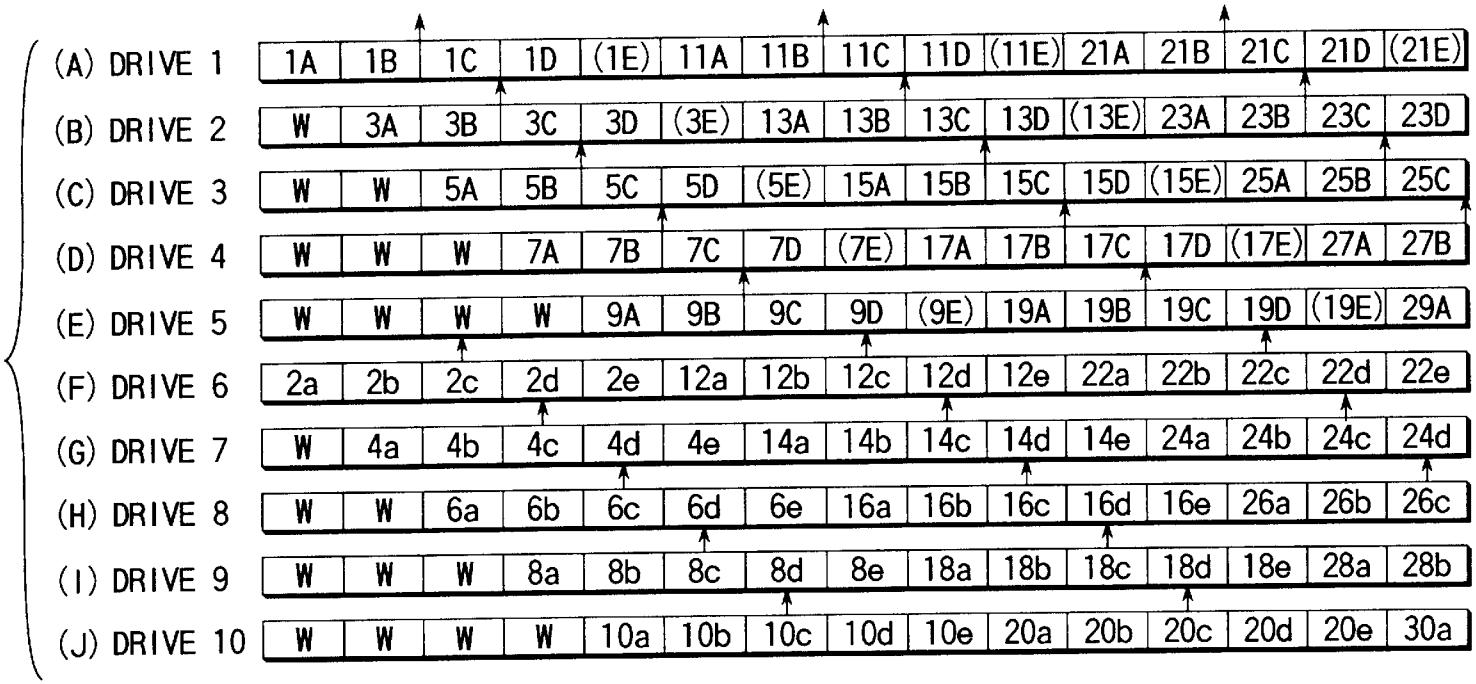
FIG. 23 is a view for explaining the arrangement of driving data and the emission position of the ink droplets in the third method for selecting the driving data series.
FIG. 24 is a view showing another example of the driving data series.

FIGS. 22D through 22F show an operation timing of the driving data generation at the time of the operation for emitting the ink droplets in the sixth cycle, the seventh cycle and the eighth cycle of the operations for emitting the ink droplets respectively. By using the driving data series of mode 2 to generate the driving data, the operation is carried out in such a manner that the emission position is shifted by ½ of the arrangement pitch of the piezoelectric element array with respect to the first half of the first to the fifth cycles of the operation for emitting the ink droplets as shown in FIG. 23.

In this manner, in the third method for selecting the driving data series, the one-line recording period is separated into a period of the operation for emitting the ink droplets by means of the driving data series of mode 1 a period for the operation for emitting the ink droplets by means of the driving data series of mode 2 which is different from mode 1 with the result that the emission position (attainment position) of the ink droplets is shifted by one pixel in a continuous emission operation. As a consequence, in the second method for selecting the driving data series which is explained, for example, in FIGS. 18A to 18C, the emission position is shifted by ½ pixel at the time of the operation for emitting the ink droplets whereas in the third method for selecting the driving data series the emission position of the ink droplets is further separated by ½ pixel. Consequently, there is an advantage in that the infiltration of the ink droplets after the attainment of the ink droplets onto he recording paper can be prevented.

By selecting and switching different driving data series by using any of the aforementioned method for selecting three driving data series, it is possible to emit the ink droplets in a half pitch with respect to the arrangement pitch of the piezoelectric element array in a relatively simple structure. Without increasing the concentration of the arrangement pitch of the piezoelectric element array, it becomes possible to record images at a higher resolution. These methods can be selectively used by using a difference in merits which can be obtained from difference in the aforementioned methods for selecting the aforementioned driving data series.

In the aforementioned explanation, the case in which four piezoelectric elements are simultaneously driven is defined as mode 1 while the case in which five piezoelectric elements are simultaneously driven is defined as mode 2. However, the present invention is not limited with the number of piezoelectric elements which are simultaneously driven. In other words, as shown in FIG. 10, and FIG. 11, and FIG. 12, the present invention can be applied by changing the number of piezoelectric elements to eight or nine elements, or nine or ten elements in various ways.

FIGS. 24(A) through 27(B) show another example of the driving data series. In other words, in FIG. 24(A) and FIG. 24(B), the driving data series comprises ten data items. This is an example in which substantially nine piezoelectric elements are simultaneously driven by including non-driving data in the same manner.

By appropriately including non-driving data in the driving data series in this manner, the interval for simultaneously emitting the ink droplets can be separated so that an attempt can be made to stabilize the emission operation. As shown in FIG. 16, even in the case where the number of elements which are driven are substantially driven as can be seen in mode 1 and mode 2 is different, the elements can be driven in more simple structure as described above by handling the case as a case in which the driving data series has the same number of data items.

In the aforementioned explanation, there is described a case in which there is described a case in which the driving data series for driving the piezoelectric elements is either of high frequency signals SIGNAL ZERO or SIGNAL PAI having two phases which have different driving data corresponding to each of the piezoelectric elements. Concretely, the phase of one of the high frequency signals SIGNAL ZERO is used as a reference while the phase of the other high frequency signal SIGNAL PAI is shifted by 180°. However, it is not required that the driving data series in the present invention is data having such phase relation. One of the two kinds of high frequency signal is used as a reference and a driving data series can be used in which the phase of the other high frequency is shifted by 90°. In this case, in the same manner as the driving data series, for example, shown in FIG. 9(A) and FIG. 9(B), the driving data series may be set.

It is possible to form a structure in which only one out of the two kinds of the high frequency signals SIGNAL ZERO is used without using the high frequency signal SIGNAL PAI. In this case, by appropriately selecting the driving data series, the ink droplets can be emitted. In the generation of the driving data in this case, there may be provided a structure in which only driving data ZERO-DATA is generated for selecting a high frequency signal SIGNAL ZERO, for example, in FIG. 7. The overall structure of the driving circuit 3 in this case can be simplified so that the shift register 44 and the latch 45, for example, in FIG. 4 handle one bit data with the result that as an output signal from the high frequency signal generating unit 41, naturally only the high frequency signal SIGNAL ZERO is output, and in the selector 46, only the high frequency signal SIGNAL ZERO may be selected in accordance with ON and OFF of the driving data ZERO-DATA.

As data constituting the driving data series, three kinds of high frequency signal can be used. FIG. 28(A) and FIG. 28(B) show an example of the driving data series comprising five data items in the case where three kinds of high frequency signals are used. In this example, three kinds of high frequency signals SIGNAL ZERO, SIGNAL PAI and SIGNAL PAI 2 are used. On the basis of the high frequency signal SIGNAL ZERO, the phase of the high frequency signal SIGNAL ZERO is shifted by 180° and the phase the high frequency signal SIGNAL PAI 2 is shifted by 90°.

In this case, the driving data series comprises a first data series DATA 1 and a second data series DATA 2. The driving data generating section using such driving data series can be constituted, for example, in FIG. 7. The structure may be such that a first data series DATA 1 is set in the driving data series buffer 54 for generating the driving data ZERO-DATA while a second data series DATA 2 is set in the driving data series buffer 64 for generating the driving data PAI-DATA respectively. The overall structure of the driving circuit 3 in this case may be such that three kinds of high frequency signals are generated from the high frequency signal generating unit 41, for example, in FIG. 4, and a high frequency signal is selected in the selector 46 on the basis of the table of true values shown in FIG. 29.

By adopting a structure in which three kinds of high frequency signals are used in this manner, the number of high frequency signals which are prepared increases, and the handling of the signals becomes complicated. There is an advantage in that a smooth sound area can be formed with the ultrasonic wave which is generated from individual piezoelectric elements, and the stability in the emission of the ink droplets is further improved.

Figures 28, 29, 30:
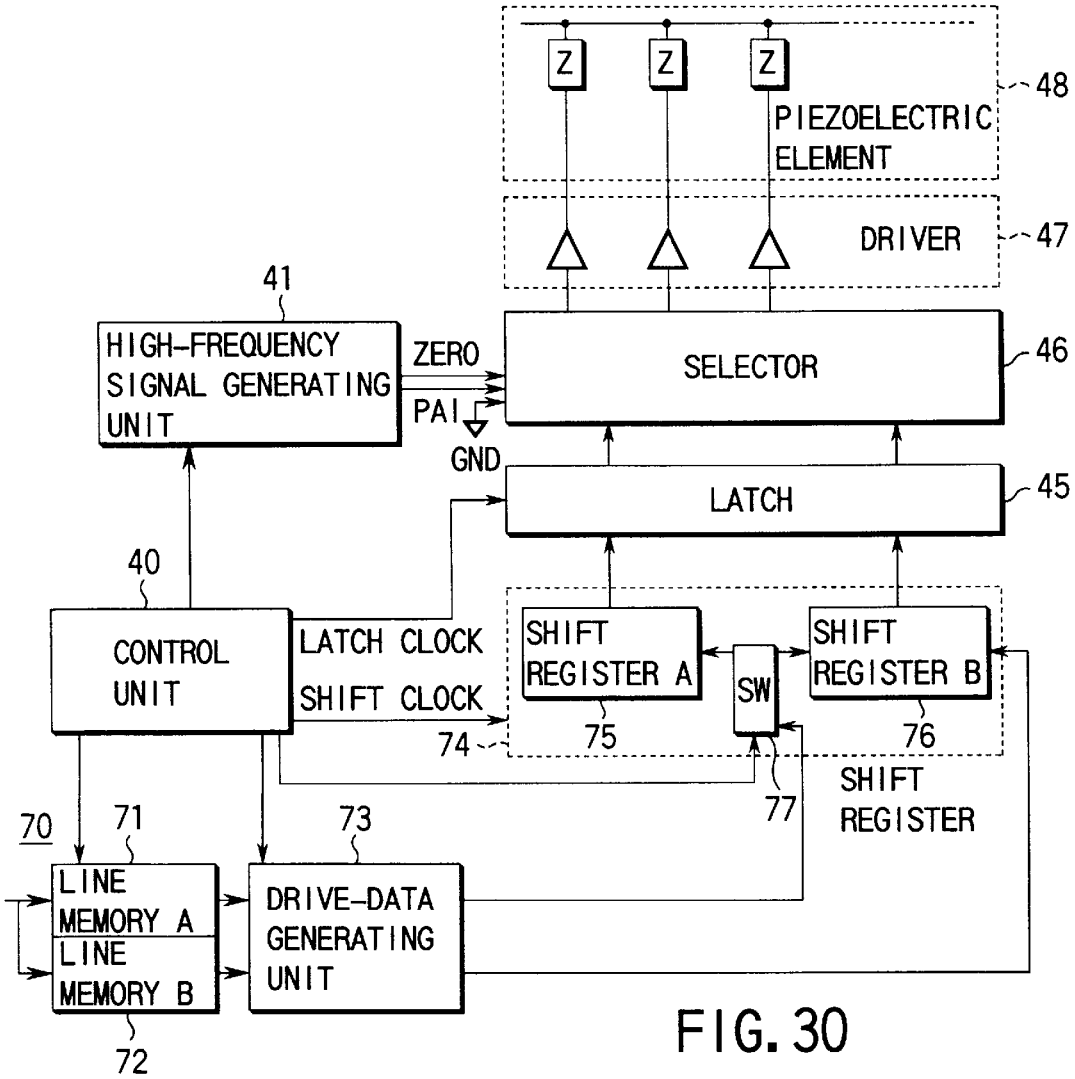
FIG. 28 is a view showing examples of driving data series for selecting three kinds of high frequency signals.
FIG. 29 is a view showing a table of true value for selecting three kinds of high frequency signals.
FIG. 30 is a block diagram showing a drive circuit in the ink jet recording device according to more preferred embodiment.

Another Preferred Embodiment of Driving Circuit 3 (FIG. 30)

In FIG. 10(A) and 10(B), and FIG. 13(A) and FIG. 13(B), there is described a case in which the driving data is input and set from one input port with respect to 4960 pixels in one line. In this case, for example, when the transmission clock SHIFT CLOCK is set to 10 MHz, a transmission time of 496 μsec is required for setting 4960 driving data items. As a consequence, the time required for emitting one ink droplet cannot be set to 496 μsec or less. In order to carry out further higher speed recording in such structure, it is necessary to provide a design such that the frequency of the transmission clock is heightened, but there is a limit in the heightening of the clock.

Then, as more preferred embodiment of the driving circuit 3, there is described a case in which a plurality of input ports are provided so that the driving data is set in a simple structure without heightening the frequency of the transmission clock.

Figure 40:
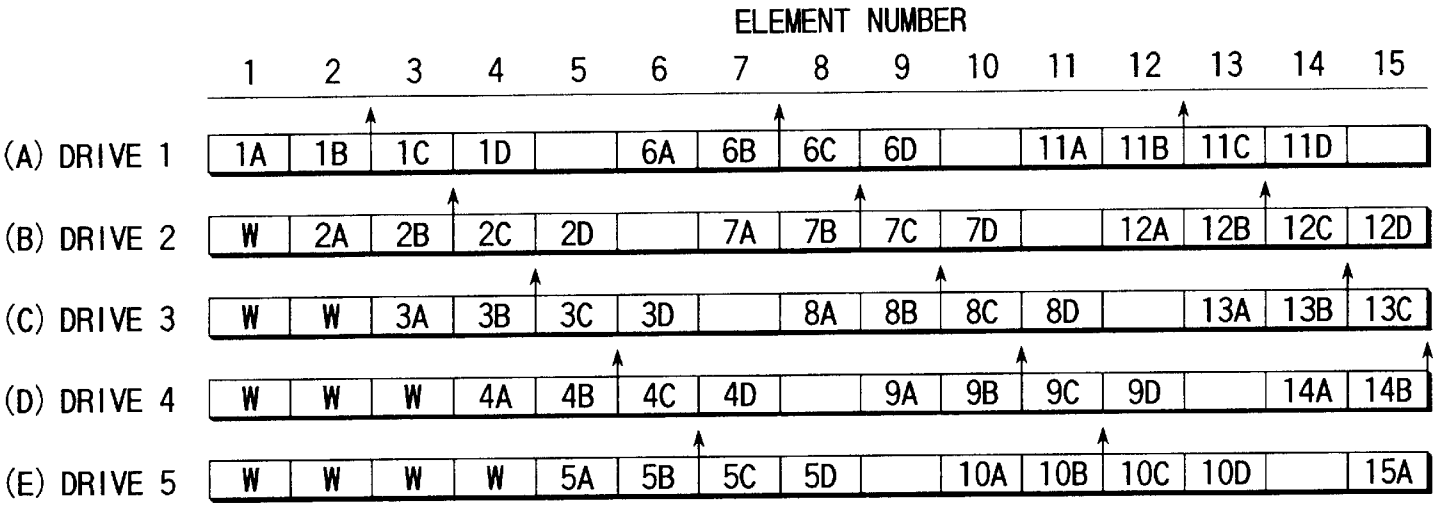
FIG. 40 is a view for explaining a relation between the arrangement of driving data and the emission position of the ink droplets.

The driving circuit 3 shown in FIG. 30 is shown in a view showing a case in which two input ports are provided. The block which is the same as FIG. 40 is added with the same numeral. The latch 45 and the selector 46 form one block in summary respectively. A point which is largely different from the structure of FIG. 4 is that two line memories A71 and B72 are provided as line memory 70, and two shift registers A75 (second shift register) and B76 (first shift register) are provided and an input switching section 77 is further added thereto.

In other words, FIG. 30 is a view showing a structure in which the line memory 42 and the shift register 44 of FIG. 4 are divided into two parts. As the line memory 70, a line memory having the same structure as the line memory 42 of FIG. 4 can be used. The capacity of each of the two line memories A71 and B72 which are obtained by dividing the line memory 70 may be half of the line memory 42.

The driving data from the driving data from the driving data generating section 73 is input to the input port (input on the first stage) of the shift register B76. On the other hand, to the input port (input on the first stage) of the shift register A75 either the driving data which is output from the driving data generating section 73 or the driving data which is output from the output port provided on the last stage of the shift register A76 is selectively input via the input switching section 77 which is switched with a timing select signal from the control unit 40. The input switching section 77 will be described later.

FIG. 30 is a view showing a case in which there are provided two shift registers. The number of shift registers may be three or more. For example, in the case where three shift registers are used, there may be provided a structure in which a third shift register is arranged at the rear stage of the shift register A75 (second shift register) so that either the driving data which is output from the driving data generating section 73 or the driving data which is output from the output port at the last stage of the shift register A75 is selectively input via the second input switching section to the input port of the third shift register.

(About Driving Data Generating Section 73)

Figure 31:
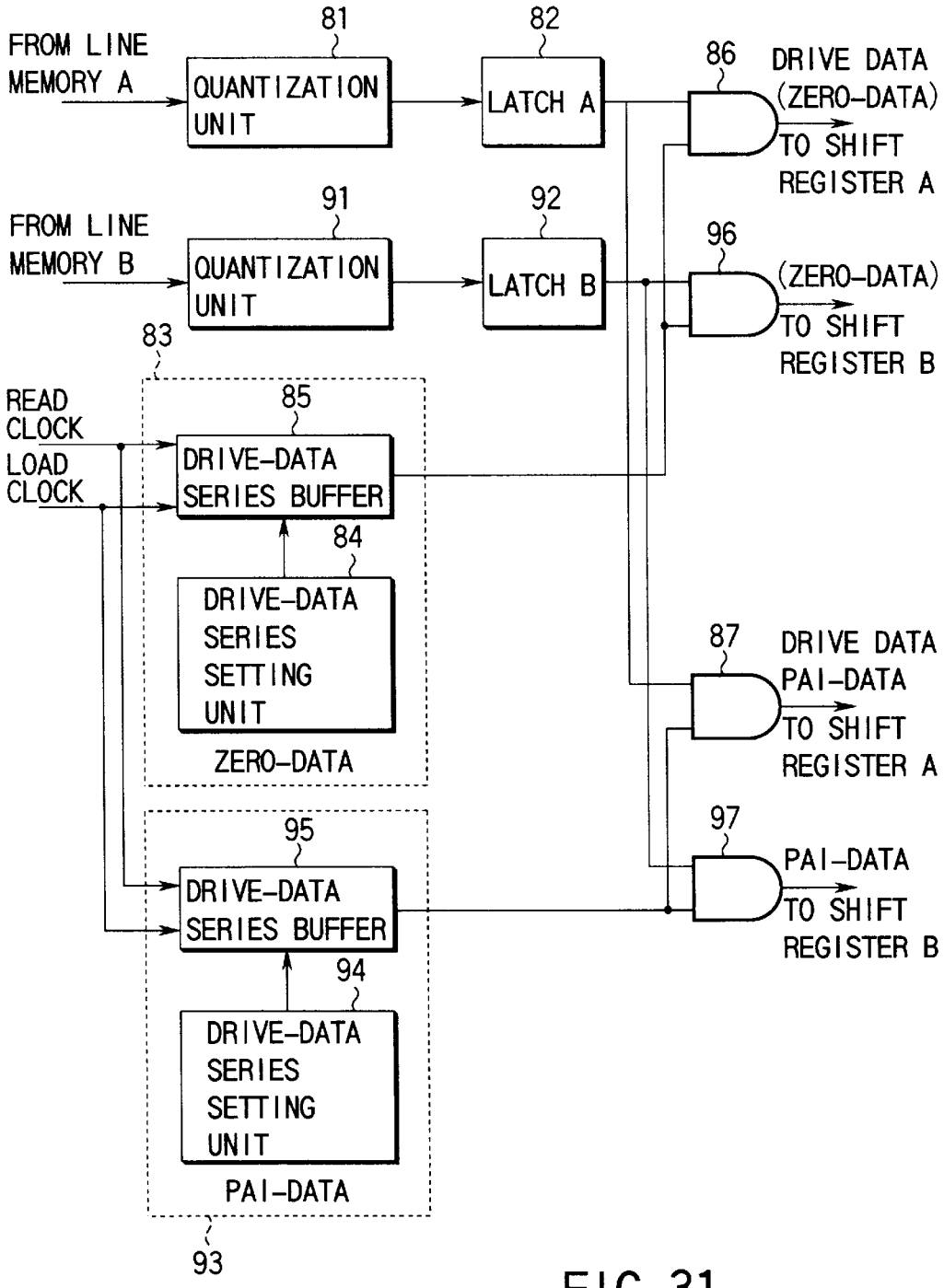
FIG. 31 is a block diagram showing a structure of a driving data generating section in FIG. 30.

FIG. 31 is a block diagram showing a structure of an essential part of the driving data generating section 73 of FIG. 30. In this driving data generating section 73, the driving data series from the driving data series setting units 84 and 94 is fetched into the driving data series buffers 85 and 95 in the same manner as the driving data generating section 43 of FIG. 4, and is input to the AND circuits 86, 87, 96 and 97 respectively in synchronization with the reading signal READ CLOCK.

The output of the line memory A71 and the line memory B72 pass the quantization units 81 and 91 respectively to be further input to the AND circuits 86, 87, 96 and 97 respectively via the latches 82 and 92. The output of the AND circuits 86 and 87 is connected to the input of the shift register A74. The output of the AND circuit 96 and 97 is connected to the input of the shift register B75. The shift register 74 and the latch 45 are constituted so that two bits constitute one set as explained in FIG. 4.

(About Input Switching section 77)

Figures 32, 33A, 33B:
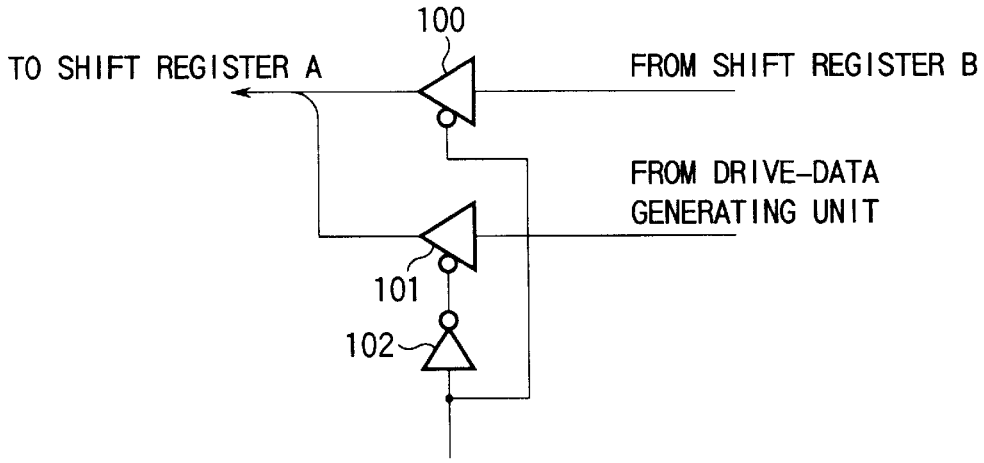
FIG. 32 is a circuit diagram showing one example of an input switching section in FIG. 30.
FIGS. 33A and 33B are views for explaining an order in the data storage in a line memory in FIG. 30.

FIG. 32 is a view showing a structure per one bit of an input to the shift register A75 of the input switching section 77 of FIG. 30. In other words, the input switching section 77 comprises two buffers 100 and 101 in three states so that either an output from the AND circuits 86 and 87 in FIG. 31 inside of the driving data generating section 73 or an output at the last stage of the shift register B76 in FIG. 30 serves as an input at the first stage of the shift register A75.

A timing select signal from the control unit 40 either directly supplied to the buffer 100 or is supplied to the buffer 101 via an inverter 102 with the result that the input switching section 77 is switched as to whether data either from an output from the driving data generating section 73 or from an output at the last stage of the shift register B76 is input to the shift register A75.

(Operation of Driving Circuit 3 of FIG. 30)

The present embodiment originally handles data comprising 4960 pixels in one line. For simplicity of the explanation, there is described a case in which a head is constituted of 24 pixels in one line, one ink droplet is emitted by a control with four driving data items. Consequently, the driving data corresponding to twelve pixels respectively is transmitted to two shift registers A75 and B76 to be output in parallel to the latch 45.

In the beginning, in the line memories A71 and B72, image data is temporarily stored in an arrangement order as shown in FIG. 33A under a timing control by the control unit 40. The reference numerals correspond to pixel numbers of the image data. Here, the driving data series comprising four driving data items is described as A, B, C and D in an arrangement order, and the driving data constituting an output from the AND circuit with respect to the nth pixel will be described as nA, nB, nC and nD.

FIGS. 34 through 37 are views for explaining an order of the transmission clock and an arrangement order of the driving data in the shift register 74. There is shown an operation in which data is shifted from the right to the left of FIGS. 34 through 37. The timing chart shown in FIGS. 38A through 38C show an operation of the driving data generating section 73.

Figures 38A, 38B, 38C:
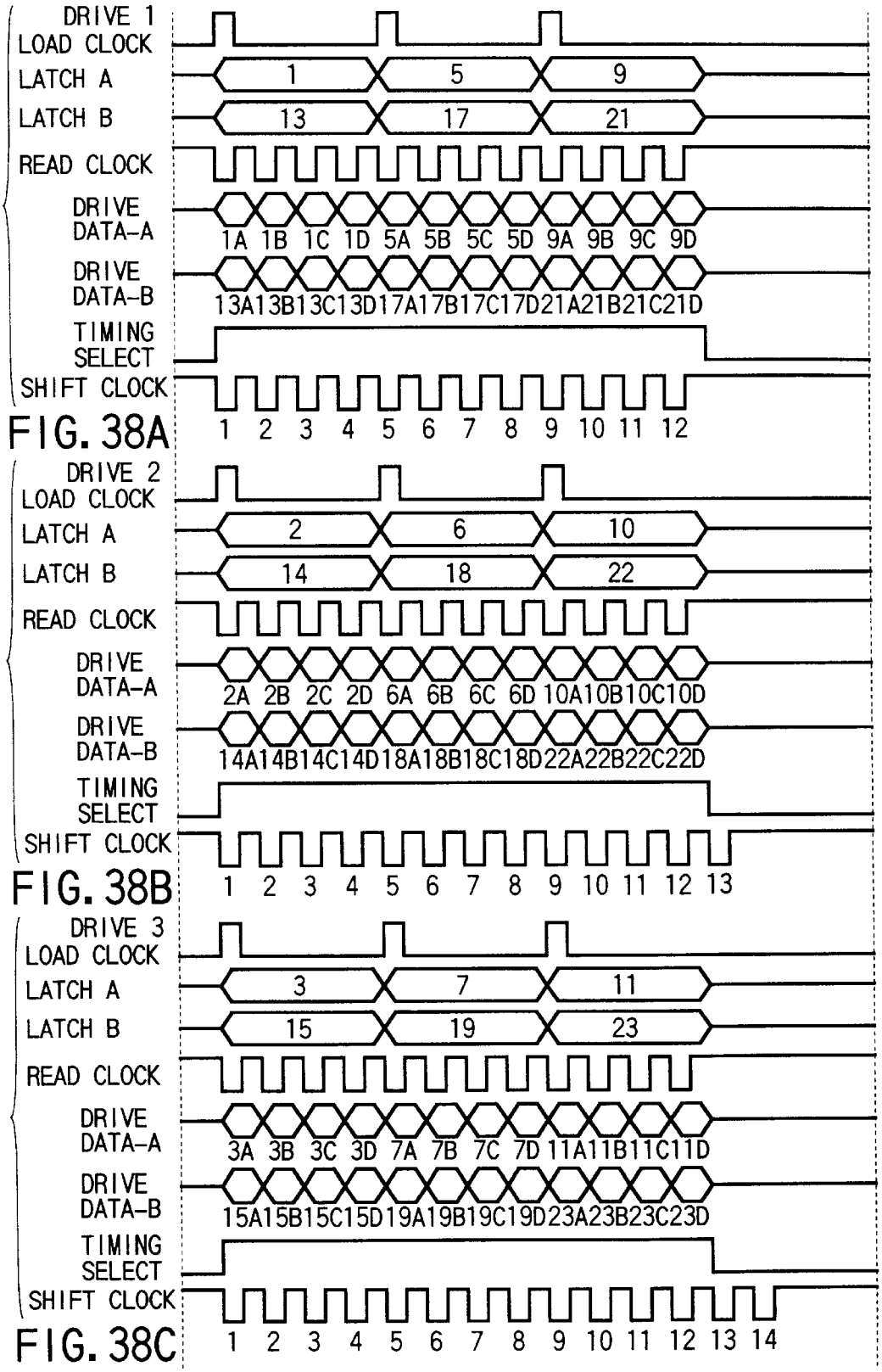
FIGS. 38A through 38C are timing charts for explaining an operation of transmitting driving data of FIG. 31.

FIG. 34 and FIG. 38A show an operation for setting the driving data corresponding to the first cycle of the operation for emitting the ink droplets.

In the beginning, in the first transmission clock, the image data corresponding to the first pixel and the image data corresponding to the thirteenth pixel is read from the line memory A71 and the line memory B72 respectively to be fetched into the latches 82 and 92 so that the AND of the output of the driving data series buffers 85 and 95 is set in the shift register element at the first stage of two shift registers 75 and 76 from respective input ports. In other words, the driving data 1A is set in the shift register A75 and the driving data 13A is set in the shift register B76.

Next, on the second clock of the transmission clock, the image data corresponding to the first pixel which is an output of the latch 82, the image data corresponding to the thirteenth pixel which is an output of the latch 92, and the driving data 1B and 13B which is AND with a second output of the driving data series buffers 85 and 95 is set. In other words, the driving data 1B is input to the shift register A75 while the driving data 13B is input to the shift register B76.

On the third transmission clock the driving data 1C and 13C is input to the shift register 75 while on the fourth transmission clock, the driving data 1D and 13D is input to the shift registers 75, 76.

On the fifth transmission clock, the image data corresponding to the fifth pixel is newly read from line memory A71 to be fetched into the latch 82 while the image data corresponding to the seventeenth pixel is read from line memory B72 to be fetched into the latch 92. The AND of these image data items and an output from the driving data series buffers 85 and 95 is obtained to transmit the driving data 5A and 17A to the shift registers A75 and B76 respectively.

Hereinafter, in the same manner, on the second transmission clock, the driving data 1A through 9D is set in the shift register A75 and the driving data 13A through 21D is set in the shift register B76 respectively. In this state, at the same timing as FIG. 5 as explained in the foregoing section, the driving data is fetched in the latch 45 so that the first cycle of the operation for emitting the ink droplets is carried out.

In this manner, at the time of setting the driving data for the first cycle of the operation for emitting the ink droplets, the image data corresponding to one image data is not input both to the shift register A75 and the shift register B76. Consequently, the driving data is input from the driving data generating section 73 to the input ports of the shift registers A75 and B76 respectively.

In FIG. 35 and FIG. 38B, an operation is explained for setting the driving data corresponding to the second cycle of the operation for emitting the ink droplets.

On the first transmission clock, the image data corresponding to the second pixel is read from line memory A71, and the image data corresponding to the fourteenth pixel is read from line memory B72 to be fetched into the latches 82 and 92 respectively. In the same manner as FIG. 34 and FIG. 38A, up to the twelfth pixel of the transmission clock, the driving data 14A through 22D is set in the shift register A75. An operation up to this stage is the same as an order for setting the driving data at the time of the first cycle of the operation for emitting the ink droplets.

Next, when the twelfth transmission clock is terminated, the timing select signal from the control unit 40 is inverted so that the input switching section 77 switches the input of the shift register A75 from the output of the AND circuit to the output at the last stage of the shift register B76.

Subsequently, on the thirteenth transmission clock, reading signals READ CLOCK for reading the driving data series buffers 85 and 95 are not sent, and only the transmission clock SHIFT CLOCK is sent to the shift registers A75 and B76. Consequently, the driving data 14A is transmitted from the last stage of the shift register B76 to the first stage of the shift register A75.

In other words, in the case where the driving data corresponding to one image data item is sent both to the shift register A75 and the shift register B76, up to the twelfth transmission clock, the driving data from the driving data generating section 73 is input to the input ports of the shift registers A75 and B76 respectively. On the thirteenth transmission clock, the driving data at the last stage of the shift register B76 is input to the input port of the shift register A75.

In this manner, the driving data 2B through 14A is set to the shift registers A75, and the driving data 14B through 22D is set in the shift register B76 so that the driving data is fetched in the latch 45. Thus the second cycle of the operation for emitting the ink droplets will be carried out. Although unstable data is input to the first stage of the shift register B76, no disadvantage is caused because ink droplets are not emitted at this element position.

After the driving data is input in an operation of twelve transmission clocks in this manner, the whole data of the shift register 74 is shifted by one clock on the thirteenth transmission clock so that the emission position of the ink droplets is shifted by one element at the time of the first cycle of the operation for emitting the ink droplets. It becomes possible to easily set the driving data without causing a damage to a continuity in the driving data series at a position extending over two shift registers A75 and A76.

FIG. 36 and FIG. 38C show an operation for setting the driving data corresponding to a third cycle of the operation for emitting the ink droplets. In an operation in accordance with the aforementioned explanation, the driving data is set. In this case, unlike the case of the second cycle of the operation for emitting the ink droplets, all the data is set in 14 transmission clock number.

In the same manner, as shown in FIG. 37, the driving data is set which corresponds to the fourth cycle of the operation for emitting the ink droplets.

Thus, the operation for emitting the ink droplets which is required for recording one line is terminated. Next, the image data on the second line is temporarily memorized in the line memories A71 and B72. On the basis of the operation same as the operation as described above, the operation for emitting the ink droplets is repeated.

As described above, in the driving circuit 3 according to the embodiment shown in FIG. 30, after the driving data is input to the shift register 74 (the shift register A75 and the shift register B76), the data of the shift register 74 is shifted so that the driving data is set at an appropriate position and two input ports are provided with the result that the transmission time can be shortened.

Besides, since a method for switching an input direction of the input port is adopted, an order for reading the image data from line memory A75 and B76 becomes simple. In other words, as shown in FIG. 33B, the image data items may be read at every four data items with the result that there is an advantage in that a complicated operation is not required such as an operation of reading the same image data a plurality of times.

When a control is made so that image data items is arranged at every four items at the time of reading the image data, it becomes possible to further simplify the image data at the time of reading the image data from line memories A75 and B76.

Thus, in this embodiment, with the ink jet recording device for emitting the ink droplets by approximately driving a plurality of piezoelectric elements with a plurality of driving data, the driving data can be set in a short time with a simple circuit structure so that a high speed recording can be realized easily.

Another Embodiment of Driving Circuit 3

In the embodiment of the driving circuit which has been explained hereinbefore, there is explained a case in which the number of the input ports is limited to two. However, the number of this input port is not limited to two. The number of the piezoelectric elements can correspond to an arbitrary value. The number of the driving data which is included in a set of the driving data series can correspond to an arbitrary value.

Besides, the setting time T required for setting the driving data for one cycle of the operation for emitting one ink droplet becomes approximately T=N/P/F where the number of the piezoelectric elements in one line is denoted by N, the number of the input ports is denoted by P, and the frequency of the transmission clock is denoted by F. As a concrete example, in the case of N=4960, P=8, and F=10 MHz, the time becomes a value on the order of T=62 $\mu$sec so that it becomes clear that a high speed setting of the driving data can be made possible.

Another Application Example of the Present Invention

In the aforementioned explanation, an ink jet recording device is described. The present invention can be applied to a data setting device for subsequently transmitting a plurality of groups each one of which is set as one group by associating a plurality of data items to each other. In such a case, the time series data is input and is subsequently transmitted to the next stage in accordance with a predetermined transmission clock, and a shift register for outputting data from an output at each stage is divided at least into a first and a second shift register, and an input port is provided respectively. A first time series data is input to the input port of the first shift register, a second time series data and time series data which is output from the output port at the last stage of the second shift register is switched to be input to the input port of the second shift register with the result that a high speed setting of data can be made possible in a simple structure.

(Another Operation of Driving data generating section 43)

Another operation of the driving data generating section 43 will be explained in detail by referring to a timing chart which is associated with the generation ad the transmission of the driving data shown in FIG. 39A and FIG. 39C.

Figures 39A, 39B, 39C:
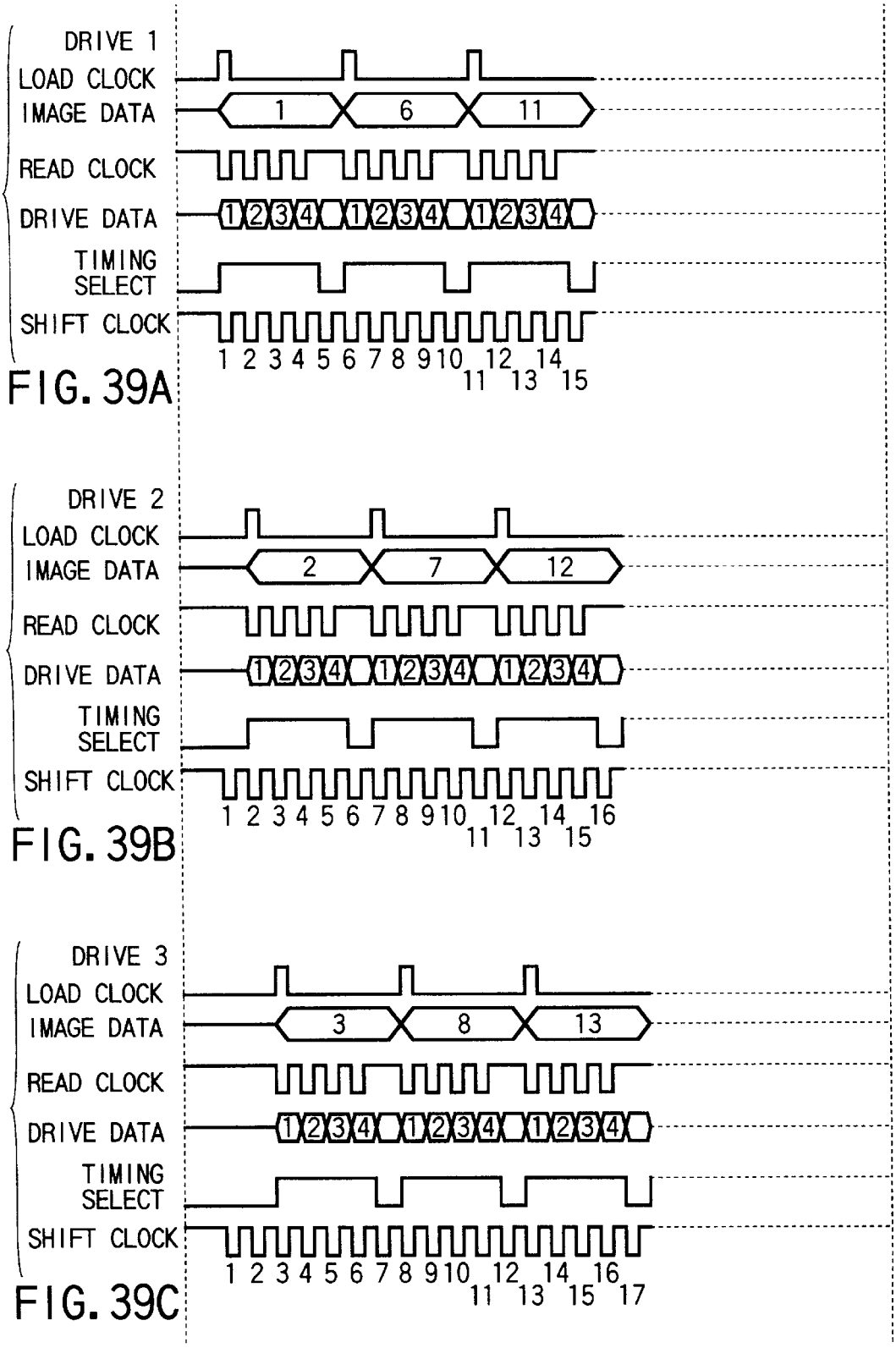
FIG. 39A through 39C are timing charts for explaining an operation of transmitting driving data of FIG. 7.

In the same manner as FIG. 8A, as shown in FIG. 39A, the driving data series is fetched into the driving data series is fetched into the driving data series buffers 55 and 65 from the driving data series setting units 54 and 64 with a load signal LOAD SIGNAL from the control unit 40 in the beginning. At this time, the image data IMAGE DATA on the first pixel is read from line memory 42 to be temporarily memorized in the latch 52. With respect to the image data on the first pixel, four driving data items DRIVE DATA are generated in synchronization with the reading signal READ CLOCK.

Here, the timing select signal TIMING SELECT from the control unit 40 is turned off, and the input of the selectors 56 and 66 is temporarily switched so that a ground signal GND is temporarily sent without out-putting data from the driving data buffers 55 and 56. At this time, the reading signal READ CLOCK is temporarily suspended for one clock portion. In other words, a non-driving signal is sent to the shift register 44 without depending on a value of the image data which is output from the latch 52. When this non-driving signal is sent to the shift register 44, the timing select signal TIMING SELECT is turned on, and the driving data series can be output.

Next, the image data on the sixth pixel which is located ahead by five pixels from the image on the first pixel is read from line memory 42, and four driving data items are generated and sent to the image data on the sixth pixel. Immediately after this, the timing select signal TIMING SELECT is inverted, and one non-driving data is sent to one shift register 44. In this manner, four driving data items and one non-driving data item are generated as one set.

Hereinafter, in the same manner, the image data which is shifted by five addresses is read from line memory 42. In other words, the driving data is set so that the ink droplets are emitted at every five positions of the piezoelectric elements.

In this manner, when 4960 driving data items are transmitted, the driving data is fetched into the latch 45 with the latch signal LATCH CLOCK so that a series of recording operations is carried out in which ink droplets are emitted at every five positions of the piezoelectric elements as previously explained in the timing chart of FIG. 5.

Since the ink droplets are emitted at every five positions of the piezoelectric elements, the emission positions are shifted by one element at the time of the next cycle of the operation for emitting the ink droplets. In other words, as shown in FIG. 39(B), the transmission of the transmission clock SHIFT CLOCK to the shift register 44 is started. The timing select signal TIMING SELECT from the control unit 40 is turned off with respect to the first transmission clock. The output of the selectors 56 and 57 is led to the sending of the non-driving data (here, a ground signal GND) without selecting the driving data series. The non-driving data serves to shift by one position the position of the piezoelectric elements which are used at the time of the previous cycle of the operation for emitting the ink droplets, and the output forcibly sets the piezoelectric elements corresponding to the tip-most end in a non-driving state.

After this, the timing select signal TIMING SELECT is turned on, a signal after the load signal LOAD CLOCK is sent in the same manner as FIG. 39A. At this time, the image data which is read from line memory 42 is read at every five pixels, such as the second pixel, the seventh pixel, the twelfth pixel, the seventeenth pixel, and so on.

In the same manner, at the time of the third cycle of the operation for emitting the ink droplets, as shown in FIG. 39C, the relation between the timing select signal TIMING SELECT and the transmission clock SHIFT CLOCK is set so that only two piezoelectric elements from the end are set in a non-driving state. Though not shown, the same operation is carried out at the time of the fourth cycle and the fifth cycles of the operation for emitting the ink droplets. The emission of all the ink droplets for one line portion is completed in the fifth cycle of the operation for emitting the ink droplets. The emission of the next line is carried out in the same operation as the operation for the first line.

A concrete example of the driving data series is shown in FIG. 9(A) and FIG. 9(B). Here, the drawings and the explanation thereof are omitted.

(Preferred Manner of Driving Method)

Next, a preferred embodiment of a method for driving a piezoelectric element in the present embodiment will be explained.

In the present embodiment, as shown in FIGS. 39A through 39C, the piezoelectric element is driven by setting each group so as to sandwich at least one of the non-driving piezoelectric elements between respective groups. At this time, it is desired that the piezoelectric elements which are driven in each cycle of the operation for emitting the ink droplets is selected and driven in the following manner.

(1) When the number of piezoelectric elements in the group is denoted by N, and the number of the non-driving elements between respective groups is denoted y M, a relation of N>M is set. At the same time, the piezoelectric elements are driven and selected in each cycle of the operation for emitting the ink droplets so that the number of the piezoelectric elements which are driven continuously in continuous and different cycles of the operation for emitting the ink droplets becomes N−M.

(2) The piezoelectric elements which are driven in each cycle of the operation for emitting the ink droplets is selected and driven so that the number of the piezoelectric elements which are continuously driven in continuous and different cycles of the operation for emitting the ink droplets is uniformed over the operation for emitting the ink droplets for one line.

(3) A group is set so as to sandwich between respective groups the non-driving piezoelectric elements in the number larger than the number of the piezoelectric elements in the group, and the piezoelectric elements which are driven in each cycle of the emission operations so that the same piezoelectric elements are not continuously driven in continuous different cycles of the operation for emitting the ink droplets is selected, and the piezoelectric elements are driven.

(4) The piezoelectric elements are driven so that the emission positions in continuous cycles of the operation for emitting the ink droplets are shifted by two or more elements in each cycle of the operation for emitting the ink droplets.

(5) The piezoelectric elements are driven so that the emission positions in continuous cycles of the operation for emitting the ink droplets are shifted by two or more elements and set in equal intervals.

Hereinafter, various driving patterns will be explained in which (1) through (5) are appropriately assembled.

(First Driving Pattern)

FIG. 40 shows part of an arrangement of the driving data in five cycles of the operation for emitting the ink droplets which is explained in FIGS. 39A through 39C. The driving data is set in the shift register 44 of FIG. 4 and corresponds to the arrangement state of the driving data which is fetched in the latch 45. In other words, the driving pattern of individual piezoelectric elements is shown. The driving pattern corresponds to the aforementioned (1), and this is an example of the case of N=4 and M=1. The number of piezoelectric elements which are continuously driven in the continuous and different cycles of the operation for emitting the ink droplets is set to N−M=3.

Here, in FIG. 40, the driving data series comprising four data items shown in FIG. 9 is described as A, B, C and D in the arrangement order. The driving data which constitutes an output of the AND circuits 57 or 67 of FIG. 7 with respect to nth image data is described as nA, nB, nC, and nD. W and no symbol in FIG. 7 show non-driving data. These description methods are the same in the following drawings.

As can be seen from FIG. 40, to the piezoelectric elements having element numbers seven through nine corresponding to the driving data 7B, 7C and 7D, for example, in the first cycle of the emission operation, the driving data 7A, 7B, and 7C are allocated in the second cycle of the emission operation. The piezoelectric elements are driven continuously over the second cycle and the third cycle of the emission operation. In the same manner, to the piezoelectric elements having element numbers eight to ten corresponding to the driving data items 7B, 7C and 7D in the second cycle of the emission operation, the driving data items 8A, 8B and 8C are allocated also in the third cycle of the emission operation so that the piezoelectric elements are continuously driven in the second cycle and the third cycle of the emission operation. Hereinafter, in the same manner, three adjacent piezoelectric elements are continuously driven in each cycle of the emission operation. On the other hand, when one piezoelectric element is driven, there is provided a period in which the piezoelectric element is not driven without fail in one cycle of the emission operation out of the continuous five cycles of the emission operation.

Figure 41:
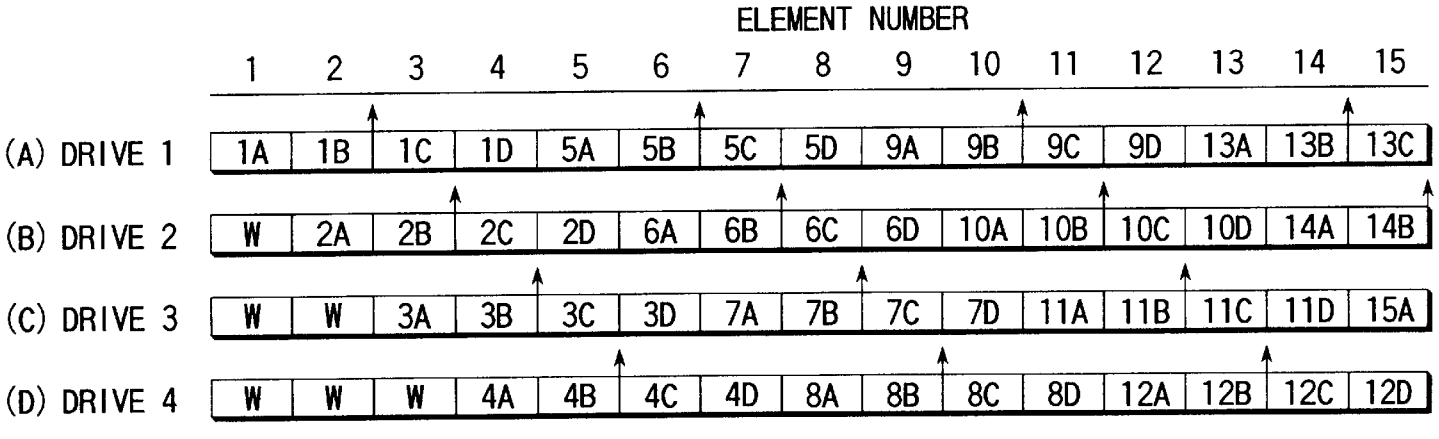
FIG. 41 is a view for explaining a relation between the arrangement of driving data and the blow-up position of the ink droplets.

FIG. 41 is a view showing a comparison with FIG. 40. There is shown a case in which the driving data is generated at an operation timing of FIG. 8A and FIG. 8B by using the driving data generating section of FIG. 7. Unlike FIGS. 39A through 39C, the non-driving data is not inserted in the midst of the generation of the driving data (M=0). As a consequence, except for the element area at the left end part shown in FIG. 40, any of the piezoelectric element is driven without repose in each cycle of the emission operation when any of the elements is noted.

In FIG. 41, the one line recording operation is terminated in four cycles of the emission operation. However, in actuality, since the next line recording operation is continuously carried out, the recording rate is high in the case where the image data is all mark, and no repose period of the driving is generated in respective piezoelectric elements. As a consequence, the piezoelectric elements which are continuously driven over a long time generate heat with the result that there arises a case in which the frequency of the ultrasonic wave which is generated changes, or in the worst case, no vibration is generated even by an application of the driving voltage and no ultrasonic wave is generated.

These phenomena largely depends on the composition of the piezoelectric elements, the manufacturing method thereof and the driving method thereof. Thus, there may be a case in which no phenomenon which will cause trouble is not generated. According to an investigation by the inventors of the present invention, it has been found that a trouble is occasionally caused in the case of a high speed recording operation.

Therefore, in the present embodiment, at least one non-driving element is arranged between the groups of the piezoelectric elements for emitting one ink droplet so that the certainty at which the same piezoelectric element is continuously driven is reduced. This procedure has an effect of stabilizing the emission of ink droplets by improving the influence of the ultrasonic wave which is generated in the driving at the adjacent position because the interval between the ink droplets which are emitted simultaneously is widened.

In a comparison between FIG. 40 and FIG. 41, the fact that the non-driving period is provided in any of the piezoelectric elements in FIG. 40 based on the embodiment is largely different from FIG. 41. However, one line image recording is carried out in five cycles of the operation for emitting the ink droplets. On the other hand, in FIG. 41, one line image recording is carried out in four cycles of the emission operation. As a consequence, there is an advantage in that an attempt can be made to shorten the recording time in FIG. 41. However, as described above, a disadvantage such as the heat generation in the piezoelectric elements is likely to be generated so that FIG. 40 has an advantage in that the lifetime of the piezoelectric elements can be prolonged, and the emission operation can be stabilized. As shown in FIG. 40, there is an advantage in that the electric power which is instantly consumed by including the non-driving piezoelectric elements in each cycle of the emission operation can be reduced.

(Second Driving Pattern)

Figure 42:
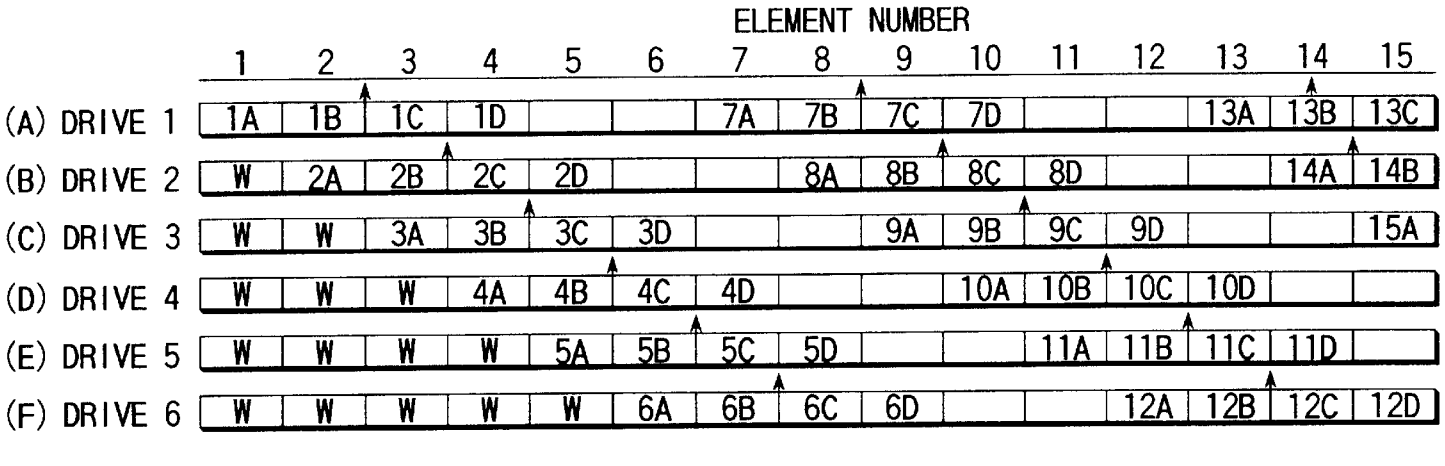
FIG. 42 is a view for explaining a relation between the arrangement of driving data and the emission position of the ink droplets.
Figure 43:
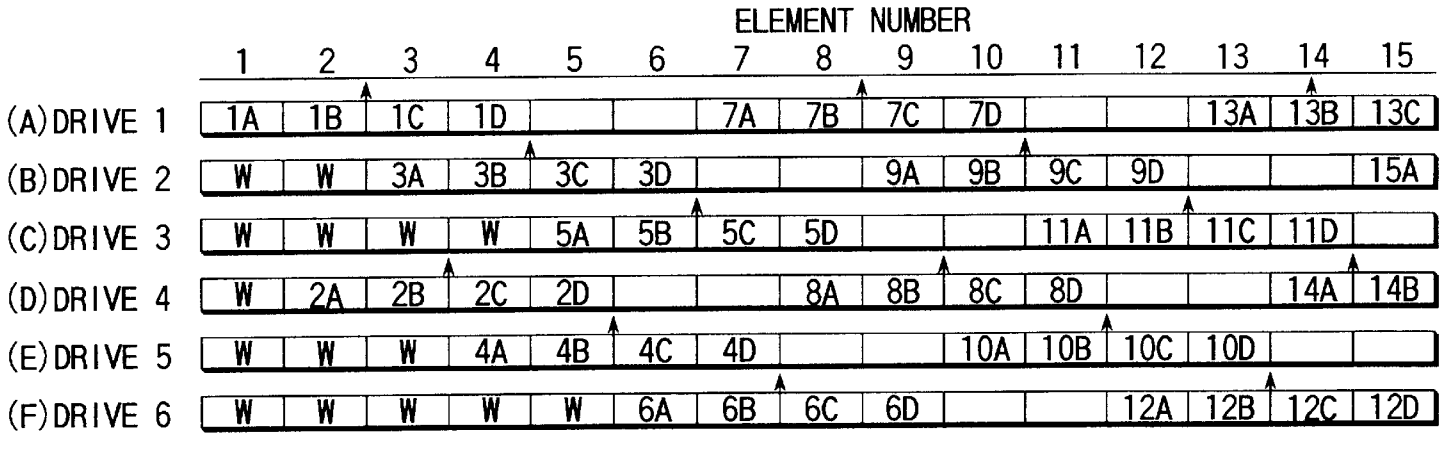
FIG. 43 is a view for explaining a relation between the arrangement of driving data and the emission position of the ink droplets.

FIG. 42 and FIG. 43 show an example in which two non-driving elements are arranged between the groups for emitting one ink droplet to carry out the emission operation in the same description method as FIG. 40. This is an example of N=4 and M=2. These examples can be realized on the basis of the operation similar to the operation timing of FIGS. 39A through 39C except for the fact that the driving data generating section of FIG. 7 is used to insert two non-driving data items. The example can be realized on the basis of the operation similar to the operation timing of FIG. 38A and FIG. 39C. Then, in an example of FIG. 42, the emission positions of the ink droplets are shifted to the right by one piezoelectric element. In an example of FIG. 43, the emission position is shifted by two elements in the same manner. In this manner, the emission position is shifted in equal intervals in each cycle of the emission operation. Consequently, the number of the piezoelectric elements which are continuously driven in the continuous emission operation can be reduced to three in an example in FIG. 42 and to two in an example in FIG. 43 respectively.

Figures 44A, 44B, 44C:
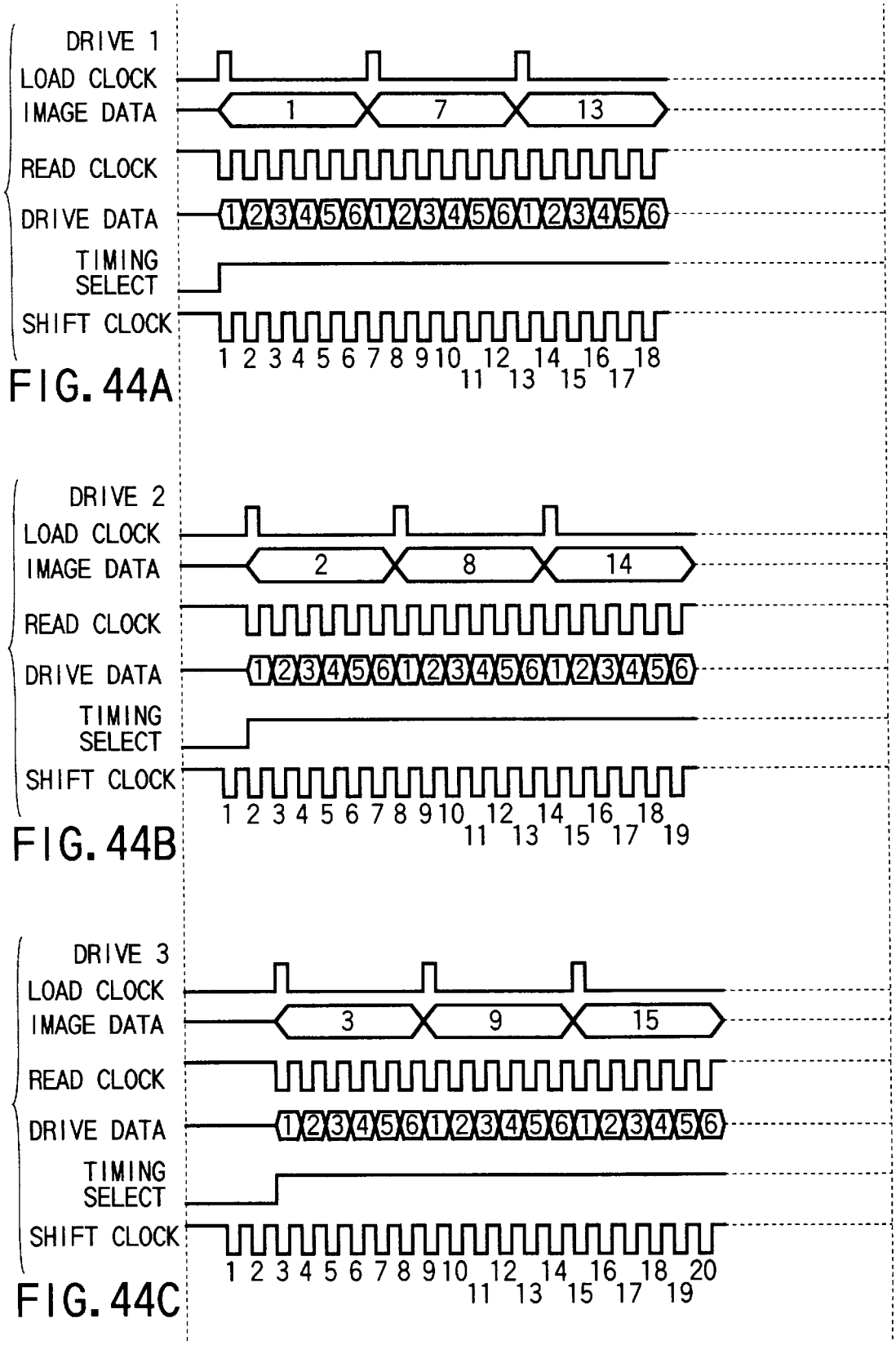
FIGS. 44A through 44C are views showing other examples of a timing chart for explaining an operation of the driving data generating section of FIG. 7.

FIGS. 44A through 44C show a timing chart for forming the emission state of FIG. 43. In this operation, the circuit structure can be simplified. FIG. 45 shows an example of the driving data series used in the operation of FIGS. 44A through 44C. This driving data series comprises six driving data items. However, the fifth and the sixth data items are both used for generating the non-driving data. Substantially, four driving data items and two non-driving data items are generated.

In the first cycle of the emission operation of FIG. 44A, the driving data series is fetched into the driving data series buffers 55 and 65 from the driving data series setting units 54 and 64 with a load signal LOAD CLOCK from the control unit 40. At this time, the image data IMAGE DATA on the first pixel is read from line memory 42 and is temporarily memorized in the latch 52. Then, in the beginning, four driving data items and two non-driving data items are generated from the driving data series shown in FIG. 45(A) and FIG. 45(B) to the image data on the first pixel in synchronization with the reading signal LOAD CLOCK. Subsequently, the driving data series is read again from the driving data series setting units 54 and 84 with the load signal LOAD CLOCK to be fetched into the driving data buffers 55 and 65. At this time, the image data IMAGE DATA on the seventh pixel is read from line memory 42 to be temporarily memorized in the latch 52. With respect to the image on the seventh pixel, six data items, namely four driving data items and two non-driving data items are generated. By repeating these operations, 4960 driving data items DRIVE DATA are output to the shift register 44 so that the generation of the driving data items with respect to the first cycle of the emission operation is completed. During this period, the timing select signal TIMING SELECT is set in an ON state unlike FIGS. 39A through 39C.

In the second cycle of the emission operation of FIG. 44B, the driving data series comprising six data items is used with respect to the image data on every sixth pixels from the image on the second image pixel to generate the driving data.

FIG. 44C shows an operation timing of the generation of the driving data in the third cycle of the emission operation. Though not shown, six cycles of the emission operation are carried out in total per one line in the same manner Hereinafter.

In this manner, by using the driving data series including the data for substantially generating the non-driving data as shown in FIG. 45, the non-driving data can be easily inserted without switching the timing select signal TIMING SELECT at the operation timing shown in FIGS. 44A through 44C.

FIG. 46(A) and FIG. 48(B) show another example of the driving data series for emitting the ink droplets by driving four piezoelectric elements. In the same manner as FIG. 45, the example is the driving data series including the data for substantially generating the non-driving data, but the number of data items (non-driving data items) is made different.

When this driving data series is used, the driving data can be appropriately generated in an operation in accordance with an operation timing shown in FIG. 44A and FIG. 44C. The operation for emitting the ink droplets for recording one line is made different depending on the number of data items constituting the driving data series. For example, since the driving data series shown in FIG. 46 comprises seven data items, the one line recording is carried out in seven cycles of the operation for emitting the ink droplets. In the case where the driving data series shown in FIG. 48 is used, one line recording may be carried out in nine cycles of the emission operation.

(Third Driving Pattern)

Figure 49:
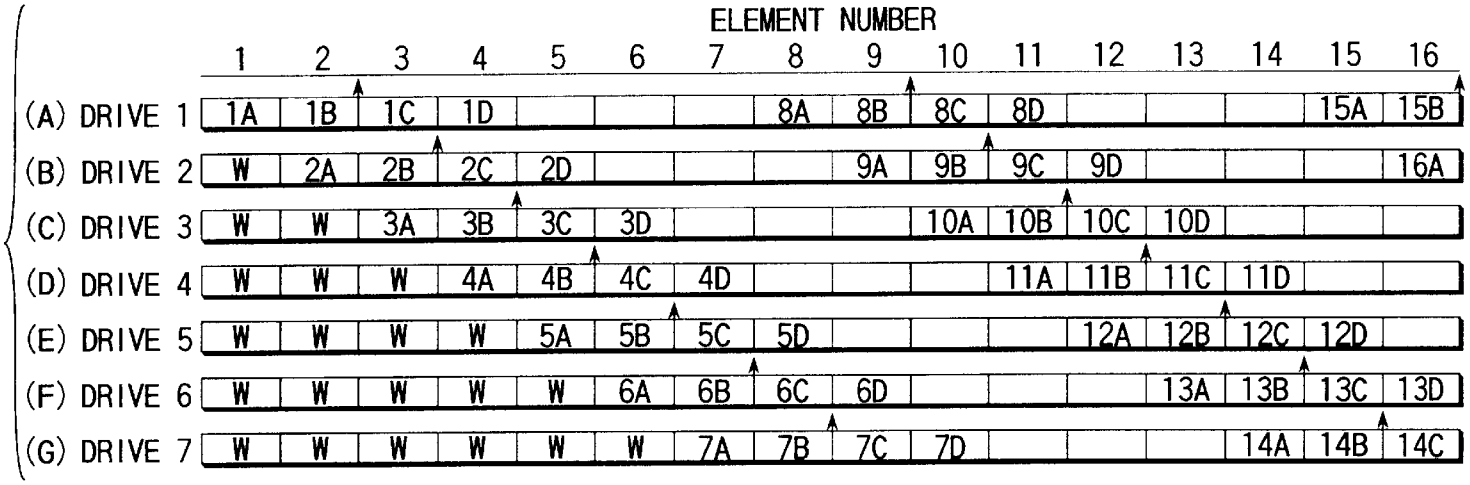
FIG. 49 is a view for explaining a relation between the arrangement of driving data and the emission position of the ink droplets.
Figure 50:
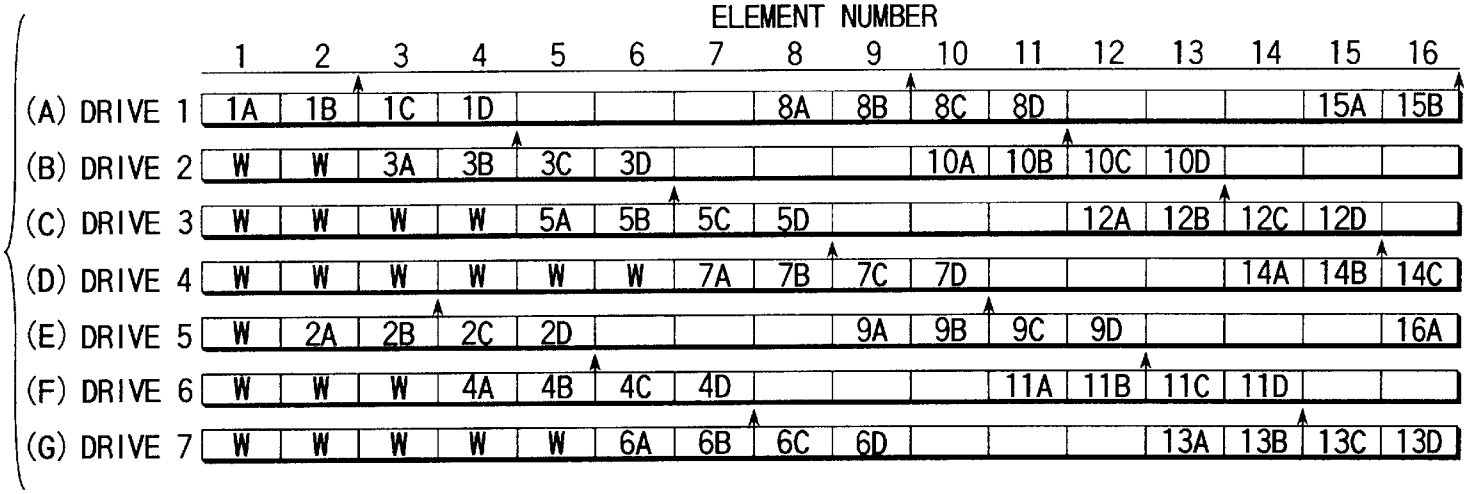
FIG. 50 is a view for explaining a relation between the arrangement of driving data and the emission position of the ink droplets.
Figure 51:
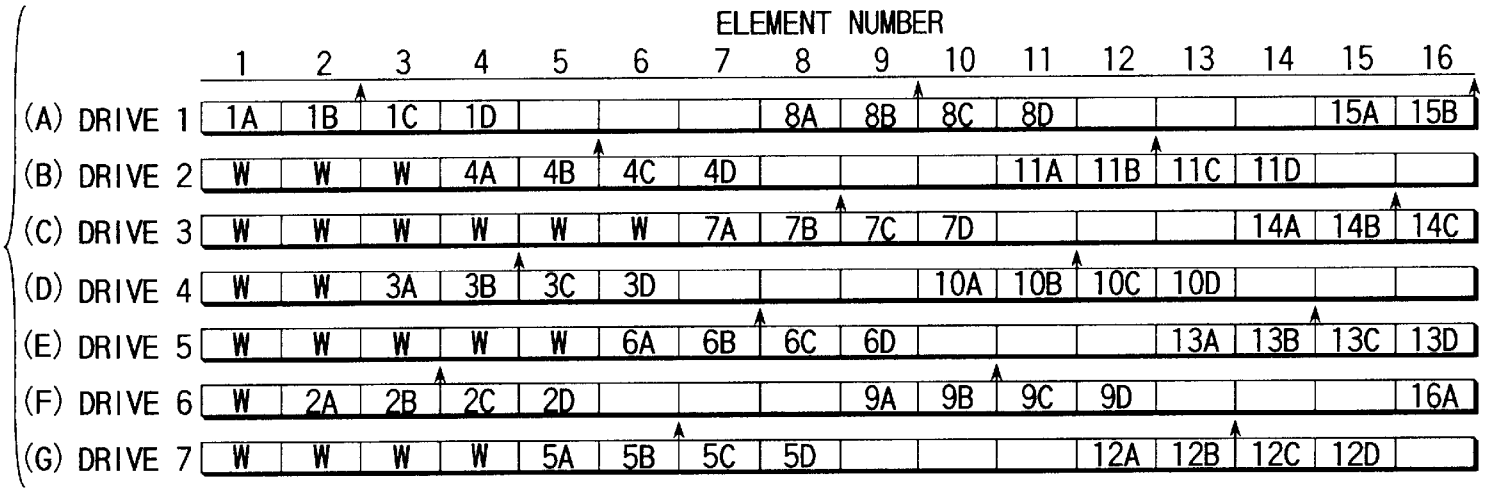
FIG. 51 is a view for explaining a relation between the arrangement of driving data and the emission position of the ink droplets.

FIG. 49(A) through FIG. 54(G) show an example showing the arrangement of the driving data and the emission position corresponding each of the emission operations in the case where the driving data is generated by using the driving data series shown in FIG. 46. The example is shown in the same description method as the example shown in the aforementioned FIG. 40. These are the cases of N=4 and M=3. FIG. 49 show an example in which the emission position is shifted by one element in continuous emission operations in continuous emission operations. FIG. 50 show an example in which N=4 and M=3 are set and the emission positions are made different by two elements. In the same manner, FIG. 51(A) to FIG. 54(G) show an example in which the emission positions in continuous operations for emitting the ink droplets are shifted by three to six elements respectively.

In these examples, the emission positions are shifted in equal intervals in all emission operations with the result that the number of piezoelectric elements which are continuously driven from the previous emission operation becomes definite in each emission operation. As a consequence, there is advantage in that the stability in the emission of the ink droplets becomes uniform in each cycle of emission operation.

Figure 54:
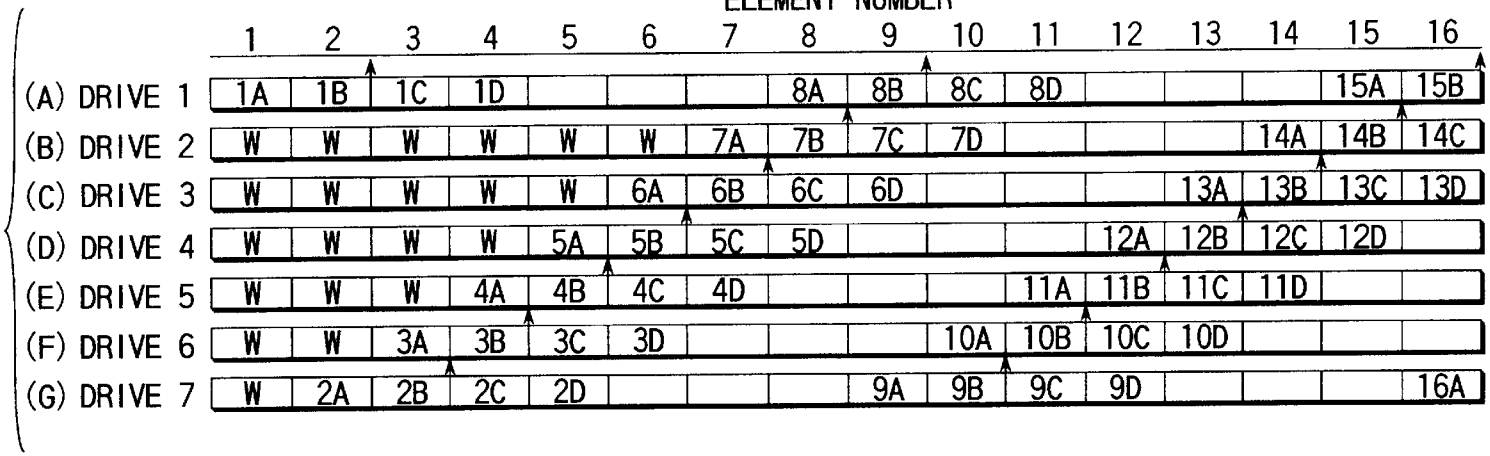
FIG. 54 is a view for explaining a relation between the arrangement of driving data and the emission position of the ink droplets.

In FIG. 49 and FIG. 54, since the emission positions are shifted by one element in each cycle of the emission operation (the emission positions are shifted in the left direction in FIG. 54), the reading of the image data may be carried out by one pixel after one pixel in order so that the handling of the line memory 42 is most simplified.

In FIG. 50 through FIG. 53, the number of the piezoelectric elements which are continuously driven in continuous emission operation is smaller than those three elements of FIG. 49. By the reason, in FIG. 50 through FIG. 53, there is an advantage in that the emission operation can be stabilized and the lifetime of the piezoelectric elements can be prolonged in high speed recording.

In FIG. 50 through FIG. 53, the number of the piezoelectric elements which are continuously driven in continuous emission operation is smallest and is only one element. In the group of seven elements which are associated with the one cycle emission of the ink droplets, one element is the minimum as an expected value. In this manner, by minimizing the expected value of the number of the piezoelectric elements which are continuously driven in two cycles of continuous emission operations (in other words, setting the number of piezoelectric elements which are continuously driven in two continuous emission operation to N−M in the same manner as the first driving pattern), the stability of the emission at the time of the high speed recording and the lifetime performance of the piezoelectric elements becomes most favorable.

Figures 55A, 55B, 55C:
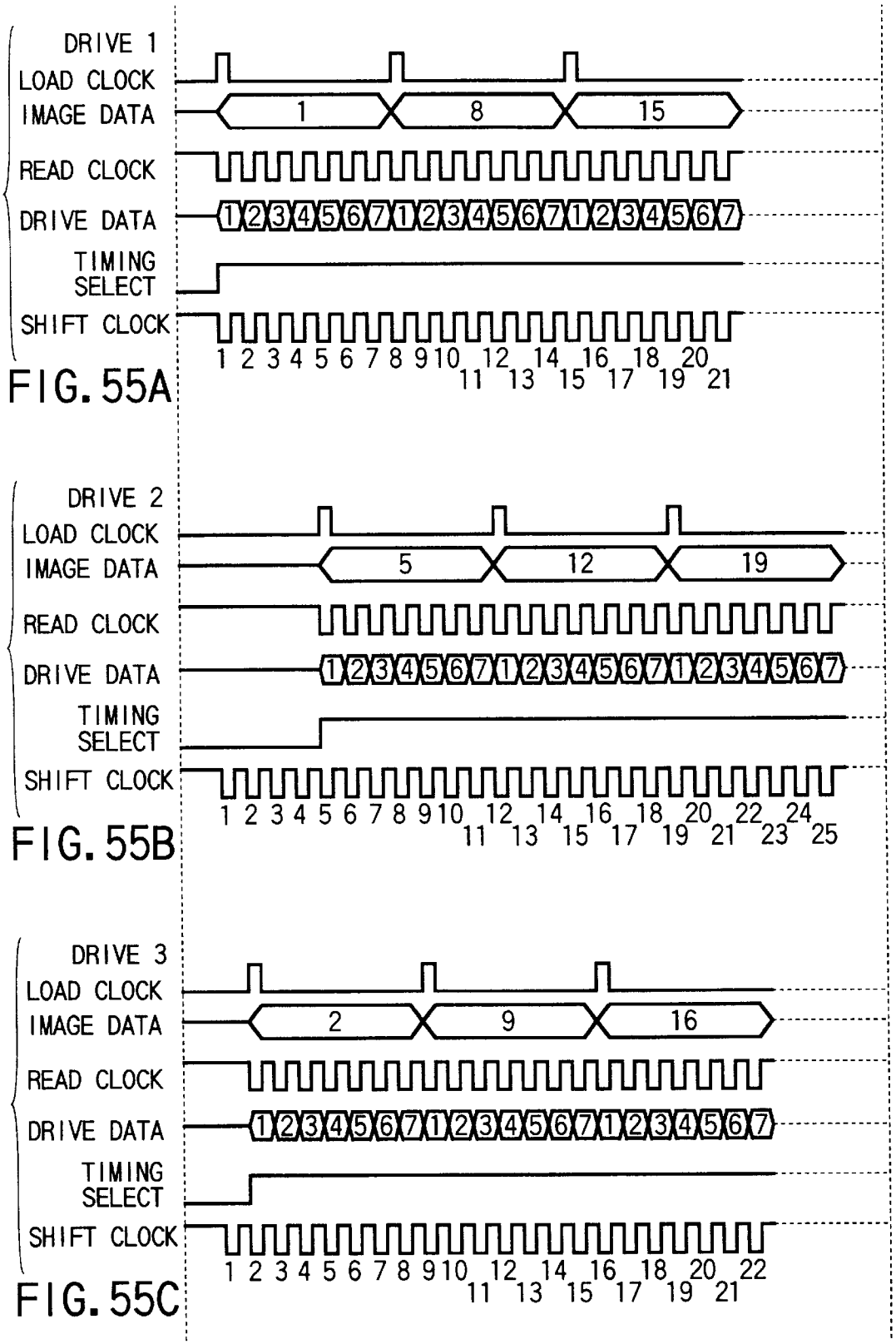
FIGS. 55A through 55C are views showing other examples of a timing chart for explaining the operation of the data generating part of FIG. 7.

The setting of these driving data items can be carried out in accordance with the operation timing of FIG. 44A to FIG. 44C. For example, FIGS. 55A through 55C show an operation timing with respect to FIG. 52. By referring to FIG. 52, an operation shown in FIG. 55A through 55C will be explained.

FIG. 55A shows a setting operation of the driving data with respect to the first cycle of the emission operation wherein every seven driving data items are generated with respect to one image data item. After seven driving data items are generated by reading the image data on the first pixel from line memory, the image data corresponding to the pixel at every seven pixels to carry out the processing. In other words, the image data corresponding to the processing is in the order of the first pixel, the eighth pixel, the fifteenth pixel, and so on.

FIG. 55B shows a setting operation of the driving data with respect to the second cycle of the emission operation wherein the image data is processed in order from the image data on the second pixel at every seven pixels to generate the driving data. At this time, before the driving data corresponding to the image data on the fifth pixel is generated, four non-driving data items are generated. Although the generation of these non-driving data items is based on the operation of the selectors 56 and 66 in FIG. 7. These operations in accordance with the previous explanation.

FIG. 55C shows a setting operation of the driving data with respect to the third cycle of the emission operation wherein the image data is processed from the image data on the second pixel in order at every seven pixels to generate the driving data. Before the driving data corresponding to the image data on the second pixel is generated, one non-driving data item is generated.

Figure 52:
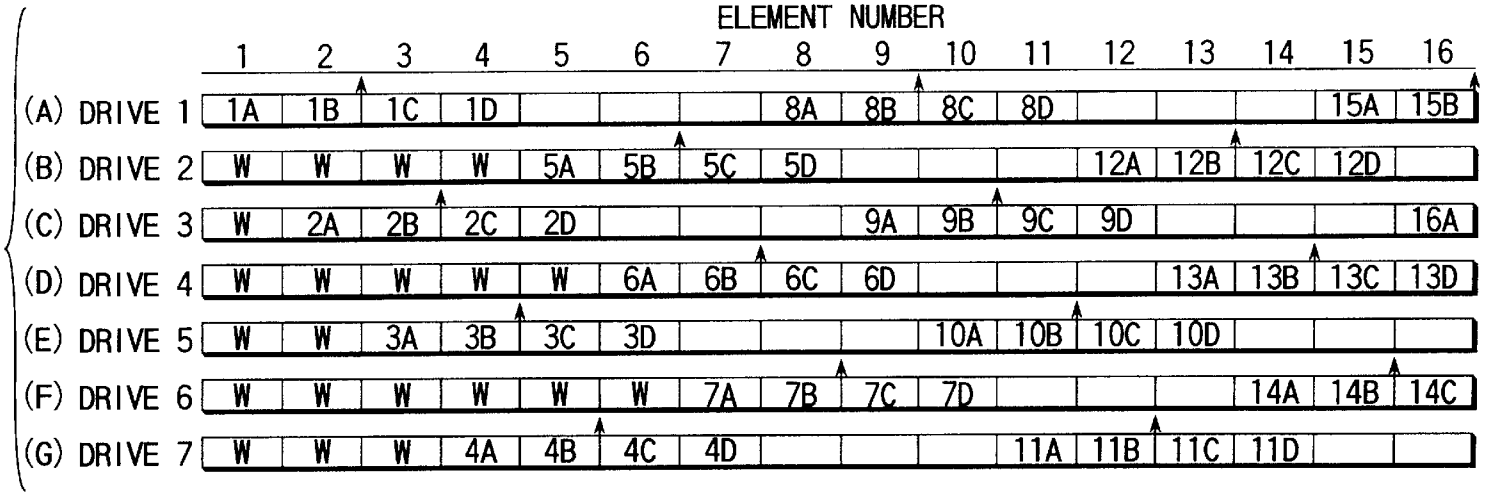
FIG. 52 is a view for explaining a relation between the arrangement of driving data and the emission position of the ink droplets.
Figure 53:
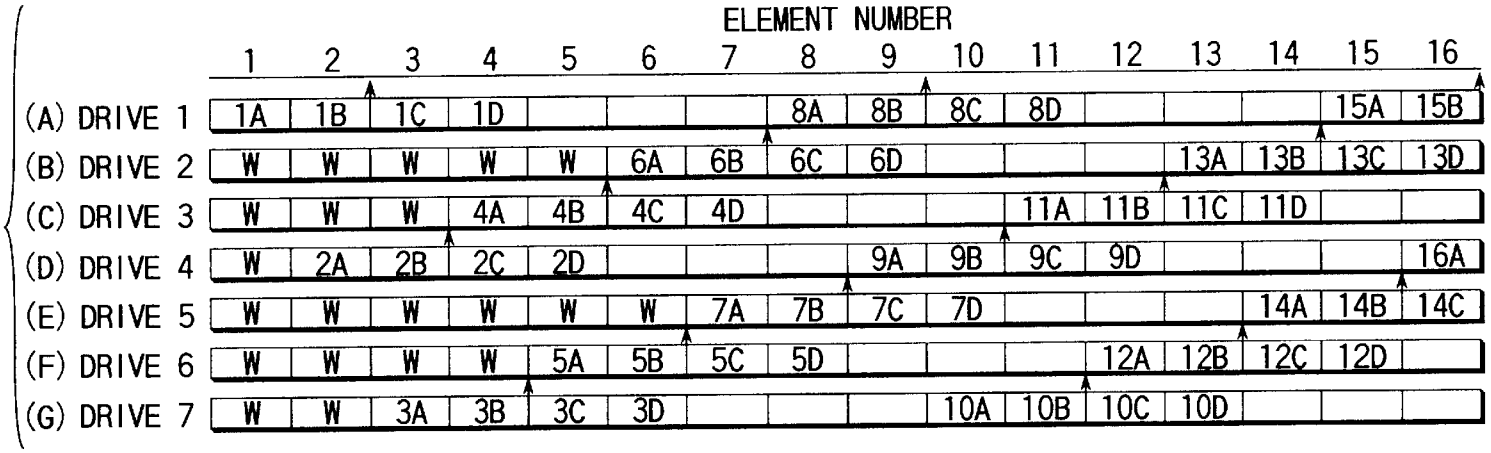
FIG. 53 is a view for explaining a relation between the arrangement of driving data and the emission position of the ink droplets.

One line operation is completed in seven cycles of the emission operation in total by repeating such operation after the fourth cycle of the operation. The state of the driving data corresponding to the one line emission operation is shown in FIG. 52. As can be seen from FIG. 52, the emission position in each cycle of the emission operation is shifted by four elements. These operations are controlled primarily with the timing select signal TIMING SELECT from the control unit 40 and the reading order of the image data from line memory.

FIG. 56 shows a reading order of the image data from line memory for an application to FIGS. 55A through 55C. In this manner, the emission position can be simply controlled by controlling reading from line memory. Besides, it is possible to rearrange the order of the image data at the time of writing the image data onto the line memory.

(Fourth Driving Pattern)

Figure 58:
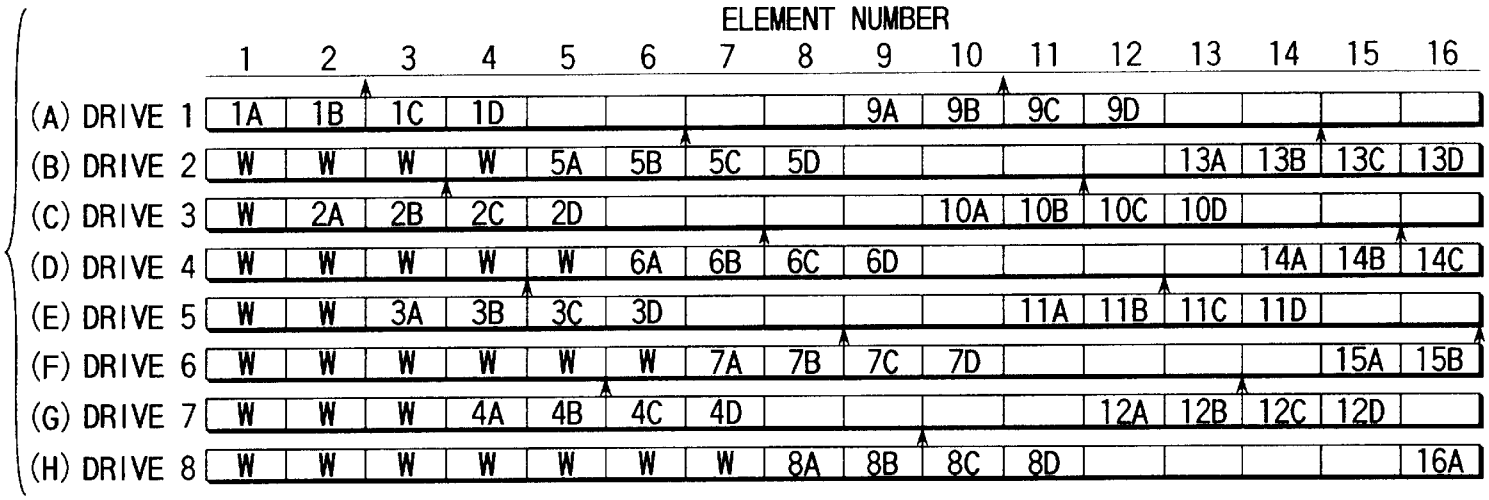
FIG. 58 is a view for explaining a relation between the arrangement of the driving data and the emission position of the ink droplets.

FIGS. 57 and 58 respectively show two examples of the arrangement of the driving data and the emission position of the ink droplets in the case where the driving data series of FIG. 47 is used. These are described in accordance with FIG. 40. The driving data series of FIG. 47 comprises four data items for generating the driving data and four data items for generating the non-driving data. This is a driving data series using eight driving data items in total. Namely, this is an example of N=4 and M=4. FIG. 57 shows an example in which the emission position is shifted by one element in each cycle of the emission operation while FIG. 58 shows an example in which the emission position is shifted by four elements in each cycle of the emission operation.

Since the number of the piezoelectric elements which are continuously driven in the continuous emission operation is three without fail in an example shown in FIG. 57, each cycle of the emission operation is carried out in an uniform manner, and a relatively uniform emission operation is carried out. On the other hand, in an example shown in FIG. 58, the number of the piezoelectric elements which are continuously driven in continuous emission operations is either non-present or only one element is present.

In the case where the number of the piezoelectric elements which are continuously driven is different in each cycle of the emission operation, the uniformity in the emission operation is lost as compared with an example shown in FIG. 57 which can cause a trouble in a stable emission operation. In an example shown in FIG. 58, the number of the piezoelectric elements which are continuously driven is one at most. Since the piezoelectric element is not continuously driven more rid than three times, an extremely stable emission operation can be carried out. Particularly, three piezoelectric elements out of four piezoelectric elements which belong to a group of the piezoelectric elements which are driven for emitting one ink droplet are not continuously driven, the emission operation can be stabilized and the lifetime of the piezoelectric elements can be prolonged. As shown in FIG. 57, in continuous emission operations, the ink droplets can be hardly affected by the influence of the infiltration of the ink droplets which attains a medium in advance at the time of emitting the ink droplets onto a medium such as paper or the like in the case where the emission position is shifted by about four elements as shown in FIGS. 58(A) through 58(H) as compared with the case where the emission position is shifted to the position of the adjacent piezoelectric element in a continuous emission operation as shown in FIG. 57. Thus there is an advantage in the improvement in the image quality.

(Fifth Driving Pattern)

Figure 59:
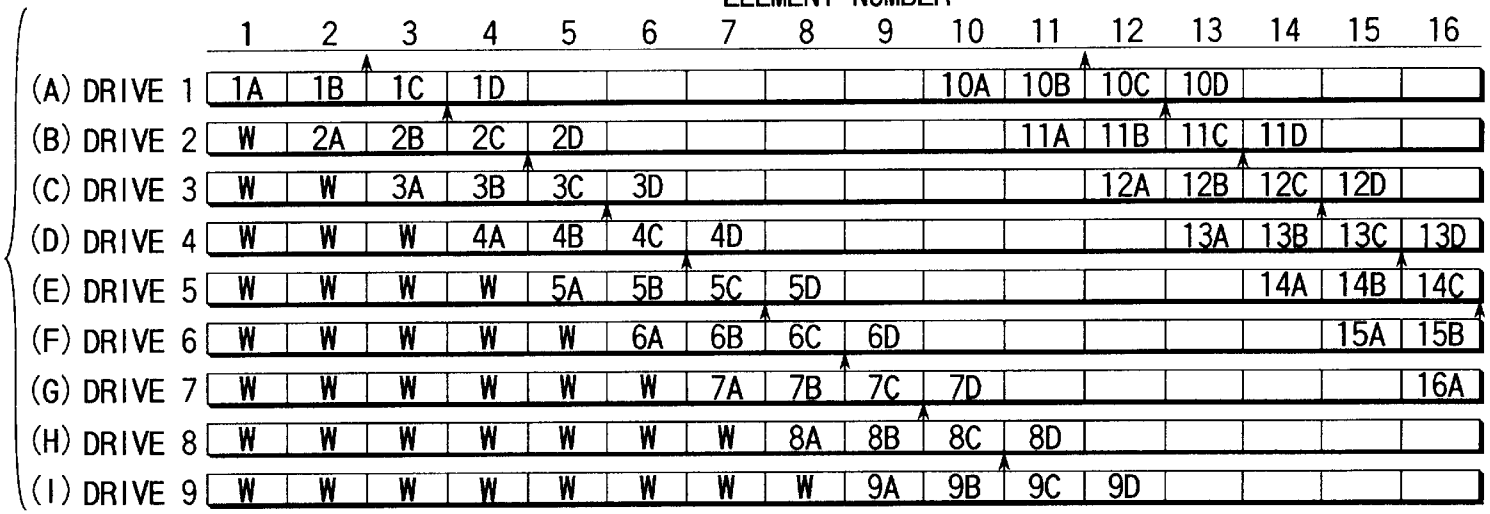
FIG. 59 is a view for explaining a relation between the arrangement of the driving data and the emission position of the ink droplets.
Figure 60:
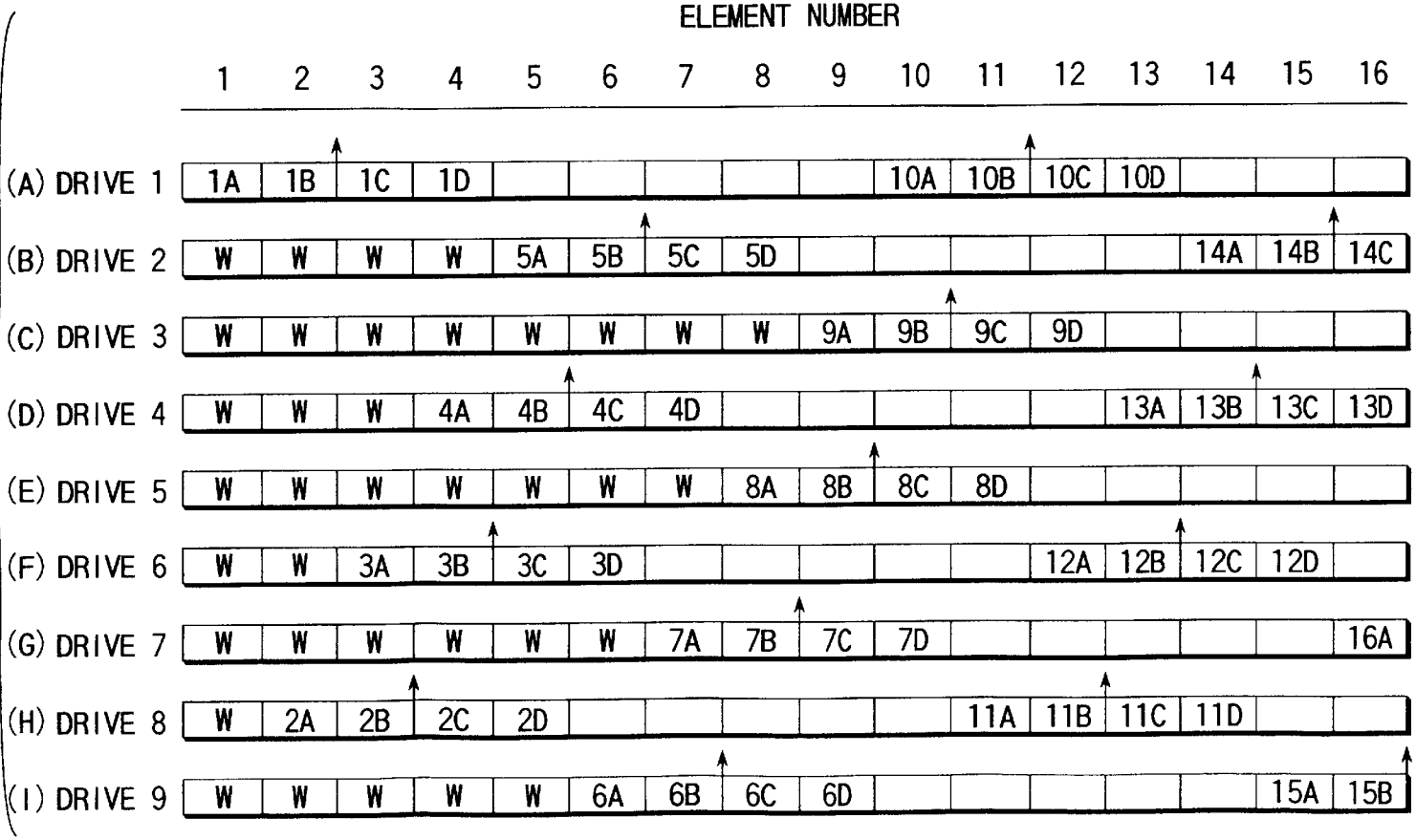
FIG. 60 is a view for explaining a relation between the arrangement of the driving data and the emission position of the ink droplets.

FIG. 59 to FIG. 60 respectively show two examples of the arrangement of the driving data and the emission position of the ink droplets in the case where the driving data series comprising nine data items shown in FIG. 48 is used. These are examples of N=4 and M=4, and are described in accordance with FIG. 40. FIG. 59 shows an example in which the emission operation is shifted by one element in each cycle of the emission operation. FIG. 60 shows an example in which the emission position is shifted by four elements in each cycle of the emission operation.

FIG. 59 shows an example in which the emission position is shifted by one element in the same manner as an example shown in FIG. 57. In the same manner as FIG. 57, a stable emission operation can be carried out in each cycle of the emission operation.

FIGS. 60(A) through 60(H) show an example in which the emission position is shifted by four elements in the same manner as FIG. 58. Unlike FIG. 58, there is no piezoelectric elements which are continuously driven at all times in each cycle of the emission operation. Thus, this is an example which is excellent in emission stability and is most excellent in the prolongation of the lifetime of the piezoelectric element. In FIG. 60, it is possible to carry out a recording operation which is hardly affected by an infiltration of the ink droplets emitted onto the medium as compared with the example shown in FIG. 59.

The reading of the image data from line memory in the example of FIG. 57 and FIG. 60 can be carried out in accordance with the procedure shown in FIG. 56.

In the aforementioned explanation, there is explained a case in which the number of the piezoelectric elements which are simultaneously driven for emitting one ink droplet is set to four. However, the present invention is not limited thereto. Four example, one ink droplet may be emitted by setting, for example, eight elements, ten elements or sixteen elements as one group.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet recording device comprising:

an ultrasonic generating element array having a plurality of ultrasonic generating elements;

a driving circuit for emitting ink droplets for each of element groups by setting a predetermined number of the ultrasonic generating elements out of said plurality of ultrasonic generating elements as one element group to drive individually each of the ultrasonic generating elements in said element group in accordance with the driving data corresponding to the image data, said driving circuit driving a plurality of element groups at the same time and a plurality of ink droplets being emitted at the same time;

a driving data series buffer for storing a driving data series, which is independent to target positions of the ink droplets, comprising at least one predetermined set of driving data for driving each of said ultrasonic generating elements in said element group; and a driving data generation circuit for reading repeatedly said driving data series which is stored in said driving data series buffer to generate the driving data, which is necessary for simultaneous emission of the ink droplets, corresponding to said image data.

2. The ink jet recording device according to claim 1, wherein said driving data series is data showing a phase of the driving data corresponding to each of said ultrasonic generating elements in said element group.

3. An ink jet recording device comprising:

an ultrasonic generating element array having a plurality of ultrasonic generating elements;

a driving circuit for emitting ink droplets for each of element groups by setting a predetermined number of the ultrasonic generating elements out of said plurality of ultrasonic generating elements as one element group to drive individually each of the ultrasonic generating elements in said element group in accordance with the driving data corresponding to the image data;

a driving data series buffer for storing first and second driving data series each of which comprises a predetermined set of driving data for driving each of said ultrasonic generating elements in said element group; and a driving data generation circuit for reading repeatedly said driving data series which is stored in said driving data series buffer to generate the driving data corresponding to said image data, wherein said first and second driving data series are data series to emit the ink droplet to mutually different positions.

4. The ink jet recording device according to claim 1, wherein said second driving data series are set to emit the ink droplets to mutually different positions, and driving data series selecting section is further provided for selecting either of said first or said second driving data series.

5. The ink jet recording device according to claim 1, wherein said first and a second driving data series are set to emit the ink droplets to mutually different positions, driving data series selecting section is further provided for selecting either of said first or said second driving data series, and said driving data series buffer stores a driving data series which is selected by said driving data series selecting section.

6. The ink jet recording device according to claim 3, wherein at least one of said first and the second driving data series includes at least one of non-driving data for setting the corresponding ultrasonic generating element in a non-driving state.

7. An ink jet recording device comprising:

an ultrasonic generating element array having a plurality of ultrasonic generating elements;

a driving circuit for emitting ink droplets for each of element groups by setting a predetermined number of the ultrasonic generating elements out of said plurality of ultrasonic generating elements as one element group to drive each of the ultrasonic generating elements in said element group in accordance with the driving data corresponding to the image data;

a plurality of shift registers including at least a first and a second shift registers for inputting driving data corresponding to each of said ultrasonic generating elements from an input port as time series data to subsequently transmit the data to a next shift register stage in accordance with a predetermined transmission clock, and outputting the driving data corresponding to each of said plurality of ultrasonic generating elements from an output at each stage;

a first input section for inputting the first driving data to the input port of said first shift register;

a second input section for inputting the second driving data to the input port of said second shift register; and an input switching section for inputting the driving data which is output from an output port at the last stage of said first shift register to an input port of said second shift register.

8. The ink jet recording device according to claim 7, wherein (a) said input switching section inputs said second driving data to the input port of said second shift register when a plurality of driving data items corresponding to the plurality of ultrasonic generating elements in said group are input to either of said first or said second shift register, while (b) said input switching section inputs the driving data which is output from the output port at the last stage of said shift register when a plurality of driving data items corresponding to the plurality of ultrasonic generating elements in said group are input both to the first and the second shift register.

9. The ink jet recording device according to claim 7, wherein said plurality of shift register further includes a third shift register, a third input section is further provided on the input port of said third shift register, and said input switching section includes a first input switching section for inputting the driving data which is output from the output port at the last stage of the first register to the input port of said second shift register, and a second input switching section for inputting the driving data which is output from the output port at the last step of the second shift register to the input port of said third shift register.

10. An ink jet recording device comprising:

an ultrasonic generating element array having a plurality of ultrasonic generating elements; and a driving circuit for setting a predetermined number of the ultrasonic generating elements out of said plurality of ultrasonic generating elements as an element group to drive individually each of the ultrasonic generating elements in said element group in accordance with the driving data corresponding to the image data thereby differentiating the emission position of the operation for emitting the ink droplets for each of the element groups to record one line image repeatedly over a plurality of times, wherein said driving circuit sets said element group so as to sandwich at least one of non-driving ultrasonic generating elements between said element groups to drive said ultrasonic generating elements by giving two or more different phases to said ultrasonic wave elements in said element group.

11. The ink jet recording device according to claim 10, wherein said driving circuit selects and drives the ultrasonic generating elements in such a manner that the number N of the ultrasonic generating elements in said element group is larger than the number M of the non-driving ultrasonic generating elements sandwiched between said element groups, and the number of ultrasonic generating elements which are continuously driven in continuous different cycles of the operation for emitting the ink droplets is set to N−M.

12. The ink jet recording device according to claim 10, wherein said driving circuit selects and drives the ultrasonic generating elements in such a manner that the number of ultrasonic generating elements in said element group is set to be equal with the number of non-driving ultrasonic generating elements between said respective element groups, and the number of ultrasonic generating elements which are continuously driven in continuous different cycles of the operation for emitting ink droplets is set to 0 or one.

13. The ink jet recording device according to claim 10, wherein the number of said non-driving ultrasonic wave generating elements is larger than the number of ultrasonic generating elements, and said driving circuit selects and drives ultrasonic wave elements so that the same ultrasonic generating elements are not continuously driven between continuous different cycles of the operation for emitting ink droplets.

14. An ink jet recording device comprising:

an ultrasonic generating element array having a plurality of ultrasonic generating element array; and a driving circuit for setting a predetermined number of ultrasonic generating elements out of said plurality of ultrasonic generating elements as an element group to drive individually each of the ultrasonic generating elements in said element groups in accordance with the driving data corresponding to the image data thereby differentiating the emission position of the operation for emitting ink droplets for each of the element groups to record one line image repeatedly over a plurality of times, wherein said driving circuit drives said ultrasonic generating elements so that the emission position of the ink droplets is shifted by two or more elements of said ultrasonic generating elements for each cycle of the emission operation.

15. The ink jet recording device according to claim 14, wherein said driving circuit sets said element group so as to sandwich at least one of non-driving ultrasonic generating elements between said groups and selects and drives ultrasonic generating elements in each cycle of the emission operation so that the number of ultrasonic generating elements which are continuously driven in continuous different cycles of the operation for emitting ink droplets becomes uniform over one line emission operation.

16. The ink jet recording device according to claim 14, wherein said driving circuit drives said ultrasonic generating elements so that the emission position in the continuous cycle of the operation for emitting the ink droplets is shifted by two or more elements and in an equal interval.

* * * * *